US009492013B2

(12) United States Patent
Battey et al.

(10) Patent No.: US 9,492,013 B2
(45) Date of Patent: Nov. 15, 2016

(54) CHAIR BACK MECHANISM AND CONTROL ASSEMBLY

(71) Applicant: Steelcase Inc., Grand Rapids, MI (US)

(72) Inventors: Robert J. Battey, Middleville, MI (US); Gary Lee Karsten, Wyoming, MI (US); Kurt R. Heidmann, Grand Rapids, MI (US); Todd T. Andres, Sparta, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 14/624,884

(22) Filed: Feb. 18, 2015

(65) Prior Publication Data

US 2015/0157128 A1 Jun. 11, 2015

Related U.S. Application Data

(63) Continuation of application No. 14/029,176, filed on Sep. 17, 2013, now Pat. No. 9,004,597, and a continuation of application No. 29/432,765, filed on Sep. 20, 2012, now Pat. No. Des. 697,726, and a (Continued)

(51) Int. Cl.
*A47C 1/024* (2006.01)
*A47C 3/026* (2006.01)

(Continued)

(52) U.S. Cl.
CPC ..... *A47C 1/032* (2013.01); *A47C 1/024* (2013.01); *A47C 1/03* (2013.01); *A47C 1/03255* (2013.01); *A47C 1/03261* (2013.01); *A47C 1/03266* (2013.01); *A47C 1/03272* (2013.01); *A47C 1/14* (2013.01); *A47C 3/30* (2013.01); *A47C 5/00* (2013.01); *A47C 5/12* (2013.01); *A47C 7/004* (2013.01); *A47C 7/006* (2013.01); *A47C 7/022* (2013.01); *A47C 7/14* (2013.01);

(Continued)

(58) Field of Classification Search
CPC ..... A47C 1/032
USPC ..... 297/301.2, 301.6, 301.7, 300.3, 300.7, 297/300.8
See application file for complete search history.

(56) References Cited

U.S. PATENT DOCUMENTS 309,750 A 12/1884 Van Campen
390,859 A 10/1888 Hiteshew (Continued)

FOREIGN PATENT DOCUMENTS

AR 015467 5/2001
AR 015468 5/2001

(Continued)

*Primary Examiner* — Rodney B White
(74) *Attorney, Agent, or Firm* — Price Heneveld LLP

(57) ABSTRACT

A chair assembly includes seat support and structures each operably coupled to a base structure, wherein the back support structure is movable between upright and reclined positions, and a biasing assembly exerting a biasing force biasing the back support structure towards the upright position, wherein the biasing force is adjustable between first and second magnitudes, and wherein the second magnitude is greater than the first magnitude. The chair assembly further includes an adjustment assembly operably coupled to the biasing assembly allowing a user to adjust the biasing force between the first and second magnitudes, wherein the adjustment assembly adjusts the biasing assembly between a first configuration corresponding to the first magnitude and a second configuration corresponding to the second magnitude, and an assist feature exerting an assist force on the biasing assembly, thereby reducing an input force required to be applied by a user.

27 Claims, 77 Drawing Sheets

Related U.S. Application Data continuation of application No. 29/432,767, filed on Sep. 20, 2012, now Pat. No. Des. 697,727.

(60) Provisional application No. 61/703,677, filed on Sep. 20, 2012, provisional application No. 61/703,667, filed on Sep. 20, 2012, provisional application No. 61/703,666, filed on Sep. 20, 2012, provisional application No. 61/703,515, filed on Sep. 20, 2012, provisional application No. 61/703,663, filed on Sep. 20, 2012, provisional application No. 61/703,659, filed on Sep. 20, 2012, provisional application No. 61/703,661, filed on Sep. 20, 2012, provisional application No. 61/754,803, filed on Jan. 21, 2013.

(51) Int. Cl.

| | |
|---|---|
| ***A47C 1/032*** | (2006.01) |
| ***A47C 7/24*** | (2006.01) |
| ***A47C 7/46*** | (2006.01) |
| ***A47C 7/54*** | (2006.01) |
| ***A47C 31/02*** | (2006.01) |
| ***A47C 1/03*** | (2006.01) |
| ***A47C 3/30*** | (2006.01) |
| ***A47C 7/02*** | (2006.01) |
| ***A47C 7/14*** | (2006.01) |
| ***A47C 7/18*** | (2006.01) |
| ***A47C 7/40*** | (2006.01) |
| ***A47C 1/14*** | (2006.01) |
| ***A47C 7/00*** | (2006.01) |
| ***A47C 7/44*** | (2006.01) |
| ***A47C 5/00*** | (2006.01) |
| ***A47C 5/12*** | (2006.01) |
| *B68G 7/12* | (2006.01) |

(52) U.S. Cl.

CPC ..... *A47C 7/185* (2013.01); *A47C 7/24* (2013.01); *A47C 7/40* (2013.01); *A47C 7/441* (2013.01); *A47C 7/443* (2013.01); *A47C 7/46* (2013.01); *A47C 7/462* (2013.01); *A47C 7/54* (2013.01); *A47C 31/02* (2013.01); *A47C 31/023* (2013.01); *B68G 7/12* (2013.01); *Y10T 29/481* (2015.01); *Y10T 29/49826* (2015.01); *Y10T 29/49947* (2015.01)

(56) References Cited

U.S. PATENT DOCUMENTS

| | | | | |
|---|---|---|---|---|
| 553,386 | A | | 1/1896 | Blair |
| 1,286,945 | A | | 12/1918 | Coates |
| 1,375,868 | A | | 4/1921 | Thompson |
| 1,686,341 | A | | 10/1928 | Nathanson |
| 2,063,732 | A | | 12/1936 | Gailey |
| 2,186,301 | A | | 1/1940 | La More |
| 2,240,802 | A | | 5/1941 | Duncan et al. |
| 2,310,366 | A | | 2/1943 | Harman |
| 2,341,124 | A | | 2/1944 | Sheldrick |
| 2,398,072 | A | | 4/1946 | Boerner |
| 2,400,705 | A | | 5/1946 | Morey et al. |
| 2,456,797 | A | | 12/1948 | Sheldrick |
| 2,471,024 | A | | 5/1949 | Cramer |
| 2,497,395 | A | | 2/1950 | Cramer |
| 2,643,704 | A | | 6/1953 | Lauterbach |
| 2,679,285 | A | | 5/1954 | Johannes |
| 2,679,286 | A | | 5/1954 | Luckhardt |
| 2,796,918 | A | | 6/1957 | Wassilli |
| 2,847,062 | A | | 8/1958 | Henrikson et al. |
| 2,859,801 | A | | 11/1958 | Moore |
| 2,894,565 | A | | 7/1959 | Crane |
| 2,985,226 | A | | 5/1961 | Ferguson et al. |
| 2,991,124 | A | | 7/1961 | Schwarz |
| 3,086,817 | A | | 4/1963 | Wilfert |
| 3,116,093 | A | | 12/1963 | Bosack |
| 3,139,305 | A | | 6/1964 | Mizelle |
| 3,261,607 | A | | 7/1966 | Horowitz et al. |
| 5,569,090 | A | | 10/1966 | Hoskins |
| 3,288,529 | A | | 11/1966 | Koch |
| 3,321,241 | A | | 5/1967 | Froelich |
| 3,334,693 | A | | 8/1967 | Badcock |
| 3,351,383 | A | | 11/1967 | Richardson |
| 3,363,943 | A | | 1/1968 | Getz et al. |
| 3,463,544 | A | | 8/1969 | Froelich |
| 3,669,499 | A | | 6/1972 | Semplonius et al. |
| 3,734,561 | A | | 5/1973 | Barecki et al. |
| 3,740,792 | A | | 6/1973 | Werner |
| 3,749,443 | A | | 7/1973 | Strien et al. |
| 3,858,936 | A | | 1/1975 | Gerken |
| 3,948,558 | A | | 4/1976 | Obermeier et al. |
| 3,973,797 | A | | 8/1976 | Obermeier et al. |
| 4,004,836 | A | * | 1/1977 | Kristensson ..... A61G 5/12 297/301.2 |
| 4,013,257 | A | | 3/1977 | Paquette |
| 4,020,717 | A | | 5/1977 | Johnson |
| 4,073,538 | A | | 2/1978 | Hunter |
| 4,073,539 | A | | 2/1978 | Caruso |
| 4,123,105 | A | | 10/1978 | Frey et al. |
| 4,133,579 | A | | 1/1979 | Springfield |
| 4,143,910 | A | | 3/1979 | Drabert et al. |
| 4,162,807 | A | | 7/1979 | Yoshimura |
| 4,200,332 | A | | 4/1980 | Brauning |
| 4,200,333 | A | | 4/1980 | Cremer et al. |
| 4,311,338 | A | | 1/1982 | Moorhouse |
| 4,331,360 | A | | 5/1982 | Roudybush et al. |
| 4,367,895 | A | | 1/1983 | Pacitti et al. |
| 4,368,917 | A | | 1/1983 | Urai |
| 4,390,210 | A | | 6/1983 | Wisniewski et al. |
| 4,408,800 | A | * | 10/1983 | Knapp ..... A47C 1/0244 297/301.6 X |
| 4,411,469 | A | | 10/1983 | Drabert et al. |
| 4,449,751 | A | | 5/1984 | Murphy et al. |
| 4,452,449 | A | | 6/1984 | Propst |
| 4,465,317 | A | | 8/1984 | Schwarz |
| 4,478,454 | A | | 10/1984 | Faiks |
| 4,493,505 | A | | 1/1985 | Yamawaki et al. |
| 4,496,190 | A | | 1/1985 | Barley |
| 4,502,728 | A | | 3/1985 | Sheldon et al. |
| 4,533,177 | A | | 8/1985 | Latone |
| 4,536,031 | A | | 8/1985 | Latone |
| 4,575,151 | A | | 3/1986 | Edstrom |
| 4,603,905 | A | | 8/1986 | Stucki |
| 4,627,663 | A | | 12/1986 | LaPointe |
| 4,630,834 | A | | 12/1986 | Muller et al. |
| 4,641,885 | A | | 2/1987 | Brauning |
| 4,652,050 | A | | 3/1987 | Stevens |
| 4,671,569 | A | | 6/1987 | Kazaoka et al. |
| 4,682,814 | A | | 7/1987 | Hansen |
| 4,709,642 | A | | 12/1987 | Briosi |
| 4,709,963 | A | | 12/1987 | Uecker et al. |
| 4,720,142 | A | | 1/1988 | Holdredge et al. |
| 4,725,095 | A | | 2/1988 | Benson et al. |
| 4,730,871 | A | | 3/1988 | Sheldon |
| 4,742,725 | A | | 5/1988 | Nagai |
| 4,744,600 | A | | 5/1988 | Inoue |
| 4,783,036 | A | | 11/1988 | Vossoughi |
| 4,787,674 | A | | 11/1988 | Inaba |
| 4,789,377 | A | | 12/1988 | Hoskins |
| 4,796,952 | A | | 1/1989 | Piretti |
| 4,810,033 | A | | 3/1989 | Kemmann |
| 4,826,123 | A | | 5/1989 | Armstrong et al. |
| 4,840,089 | A | | 6/1989 | Williamson |
| 4,840,426 | A | | 6/1989 | Elzenbeck et al. |
| 4,842,333 | A | | 6/1989 | Meiller |
| 4,844,387 | A | | 7/1989 | Fleming et al. |
| 4,856,846 | A | | 8/1989 | Lohmeyer |
| 4,865,385 | A | | 9/1989 | Suzuki |
| 4,886,316 | A | | 12/1989 | Hayama et al. |
| 4,966,411 | A | | 10/1990 | Ito et al. |
| 4,979,778 | A | | 12/1990 | Shields |
| 4,988,145 | A | | 1/1991 | Engel |
| 5,003,849 | A | | 4/1991 | Lawrie |

(56) References Cited

U.S. PATENT DOCUMENTS 5,026,117 A 6/1991 Faiks et al.
5,029,822 A * 7/1991 Selzer ..... B64D 11/06 297/301.6 X
5,029,940 A 7/1991 Golynsky et al.
5,033,791 A 7/1991 Locher
5,044,693 A 9/1991 Yokota
5,056,866 A 10/1991 Tobler
5,058,347 A 10/1991 Looman et al.
5,071,189 A 12/1991 Kratz
5,074,621 A 12/1991 McDonald
5,076,645 A 12/1991 Yokota
5,102,196 A 4/1992 Kaneda et al.
5,110,186 A 5/1992 Clark et al.
5,152,582 A 10/1992 Magnuson
5,160,184 A 11/1992 Faiks et al.
5,165,775 A 11/1992 Lisak et al.
5,193,880 A 3/1993 Keusch et al.
5,195,801 A 3/1993 Franck et al.
5,203,853 A 4/1993 Caruso
5,215,350 A 6/1993 Kato
5,217,276 A 6/1993 LaPointe et al.
5,224,758 A 7/1993 Hama et al.
5,249,839 A 10/1993 Anderson et al.
5,251,958 A 10/1993 Biggel et al.
5,286,085 A 2/1994 Minami
5,288,138 A 2/1994 Stulik et al.
5,308,145 A 5/1994 Koepke et al.
5,314,235 A 5/1994 Johnson
5,318,345 A 6/1994 Olson
5,326,155 A 7/1994 Wild
5,328,237 A 7/1994 Nasu et al.
5,333,368 A 8/1994 Kriener et al.
5,338,099 A 8/1994 Ishi et al.
5,366,274 A 11/1994 Biggel et al.
5,375,912 A 12/1994 Burness et al.
5,385,388 A 1/1995 Anderson et al.
D355,803 S 2/1995 Kemnitz
5,388,889 A 2/1995 Golynsky
5,411,316 A 5/1995 Lovegrove et al.
5,417,474 A 5/1995 Golynsky
5,423,593 A 6/1995 Nagashima
5,433,509 A 7/1995 Frankhouse et al.
5,445,436 A 8/1995 Kemnitz
5,487,591 A 1/1996 Knoblock
5,498,065 A 3/1996 Tosoni
5,511,852 A 4/1996 Kusiak et al.
5,564,783 A 10/1996 Elzenbeck et al.
5,567,012 A 10/1996 Knoblock
5,577,807 A 11/1996 Halliwill et al.
5,582,459 A 12/1996 Hama et al.
5,586,809 A 12/1996 Szmadzinski
5,588,703 A 12/1996 Itou
5,630,643 A 5/1997 Abraham et al.
5,636,898 A 6/1997 Dixon et al.
5,649,740 A 7/1997 Hodgdon
5,651,584 A 7/1997 Chenot et al.
5,655,814 A 8/1997 Gibbs
5,660,439 A 8/1997 Unwalla
5,662,381 A 9/1997 Groendal et al.
5,704,689 A 1/1998 Kim
5,716,098 A 2/1998 Lance
5,718,476 A 2/1998 Pascal et al.
5,725,276 A 3/1998 Ginat
5,725,277 A 3/1998 Knoblock
5,743,595 A 4/1998 Kirdulis
5,765,804 A 6/1998 Chadwick et al.
5,769,500 A 6/1998 Holbrook
5,772,282 A 6/1998 Stumpf et al.
5,775,774 A 7/1998 Okano
5,791,733 A 8/1998 van Hekken et al.
5,799,917 A 9/1998 Li
5,810,440 A 9/1998 Unwalla
5,853,222 A 12/1998 Roslund, Jr. et al.
5,868,467 A 2/1999 Moll
5,871,258 A 2/1999 Battey et al.
5,873,634 A 2/1999 Christensen et al.
5,902,011 A 5/1999 Hand et al.
5,909,924 A 6/1999 Roslund, Jr.
5,918,935 A 7/1999 Stulik et al.
5,944,382 A 8/1999 Ambasz
5,957,534 A 9/1999 Wilkerson et al.
5,961,184 A 10/1999 Balderi et al.
5,967,608 A 10/1999 Van Sickle
5,975,632 A 11/1999 Ginat
5,975,634 A 11/1999 Knoblock et al.
5,975,639 A 11/1999 Wilson et al.
6,015,187 A 1/2000 Clark et al.
6,027,171 A 2/2000 Partington et al.
6,030,044 A 2/2000 Kosugi et al.
6,035,901 A 3/2000 Bruner et al.
6,039,397 A 3/2000 Ginat
6,059,362 A 5/2000 Lin
6,059,368 A 5/2000 Bruner et al.
6,062,649 A 5/2000 Nagel et al.
6,079,785 A 6/2000 Peterson et al.
6,086,034 A 7/2000 Bloom et al.
6,099,076 A 8/2000 Beemer et al.
6,109,694 A 8/2000 Kurtz
6,125,521 A 10/2000 Bruner et al.
6,168,239 B1 1/2001 Conner et al.
6,185,769 B1 2/2001 Larisey, Jr. et al.
6,189,972 B1 2/2001 Chu et al.
6,224,160 B1 5/2001 Takeuchi et al.
6,234,573 B1 5/2001 Roder et al.
6,257,665 B1 7/2001 Nagamitsu et al.
6,260,921 B1 7/2001 Chu et al.
6,305,750 B1 10/2001 Buono et al.
6,367,876 B2 4/2002 Caruso et al.
6,386,634 B1 5/2002 Stumpf et al.
6,394,546 B1 5/2002 Knoblock et al.
6,394,548 B1 5/2002 Battey et al.
6,394,549 B1 5/2002 Dekraker et al.
6,419,318 B1 7/2002 Albright
6,431,649 B1 8/2002 Hensel
6,450,577 B1 9/2002 Roslund, Jr.
6,471,294 B1 10/2002 Dammermann et al.
6,499,803 B2 12/2002 Nakane et al.
6,513,222 B2 2/2003 Von Ehr et al.
6,513,874 B1 2/2003 Sander et al.
6,517,156 B1 2/2003 Lin
6,536,841 B1 3/2003 Pearce et al.
6,572,190 B2 6/2003 Koepke et al.
6,582,019 B2 6/2003 Insalaco et al.
6,585,320 B2 7/2003 Holbrook et al.
6,588,842 B2 7/2003 Stumpf et al.
6,592,090 B1 7/2003 Li
6,607,244 B2 8/2003 Stulik et al.
6,609,691 B2 8/2003 Oddsen, Jr.
6,609,755 B2 8/2003 Koepke et al.
6,612,654 B2 9/2003 Laws et al.
6,626,497 B2 9/2003 Nagamitsu et al.
6,644,749 B2 11/2003 VanDeRiet et al.
6,669,292 B2 12/2003 Koepke et al.
6,669,294 B2 12/2003 Kinoshita et al.
6,688,690 B2 2/2004 Watson et al.
6,695,404 B2 2/2004 Bruske
6,702,390 B2 3/2004 Stumpf et al.
6,702,392 B2 3/2004 Mitsuhiro
6,709,056 B2 3/2004 Bock
6,709,060 B1 3/2004 Su
6,722,741 B2 4/2004 Stumpf et al.
6,726,286 B2 4/2004 Stumpf et al.
6,729,691 B2 5/2004 Koepke et al.
6,733,080 B2 5/2004 Stumpf et al.
6,739,664 B2 5/2004 Kinoshita et al.
6,758,450 B2 7/2004 Niederman et al.
6,758,523 B2 7/2004 VanDeRiet et al.
6,761,406 B2 7/2004 Kinoshita et al.
6,769,657 B1 8/2004 Huang
6,786,544 B1 9/2004 Muraishi
6,793,284 B1 9/2004 Johnson et al.
6,837,546 B2 1/2005 VanDeRiet et al.
D503,300 S 3/2005 Olson
6,874,852 B2 4/2005 Footitt

(56) References Cited

U.S. PATENT DOCUMENTS 6,874,853 B2 * 4/2005 Wild ..... A47C 1/03255 297/300.3 X
6,913,315 B2 7/2005 Ball et al.
6,913,316 B2 7/2005 Kinoshita et al.
6,923,503 B2 8/2005 Sangiorgio
6,929,327 B2 8/2005 Piretti
6,935,689 B2 8/2005 Horiki et al.
6,945,602 B2 9/2005 Fookes et al.
6,945,603 B2 9/2005 Elzenbeck
6,955,402 B2 10/2005 Vanderiet et al.
6,957,861 B1 10/2005 Chou et al.
6,966,604 B2 11/2005 Stumpf et al.
6,969,121 B2 11/2005 Drajan
6,981,743 B2 1/2006 Edwards et al.
6,997,515 B2 2/2006 Gupta et al.
7,004,544 B2 2/2006 Mitjans
7,014,269 B2 3/2006 Coffield et al.
7,066,536 B2 6/2006 Williams et al.
7,066,537 B2 6/2006 Coffield et al.
7,066,538 B2 6/2006 Machael et al.
7,066,549 B2 6/2006 Dennon et al.
7,080,884 B2 7/2006 Daeschle et al.
7,097,247 B2 8/2006 Battey et al.
7,104,604 B1 9/2006 Kang
7,114,777 B2 10/2006 Knoblock et al.
7,118,259 B2 10/2006 Fladhammer
7,128,373 B2 10/2006 Kurtycz et al.
7,131,692 B2 11/2006 Huang
7,134,722 B2 11/2006 Ueda et al.
7,137,670 B2 11/2006 Gupta et al.
7,147,285 B2 12/2006 Lin
7,213,880 B2 5/2007 Schmitz et al.
7,213,886 B2 5/2007 Schmitz et al.
7,216,933 B2 5/2007 Sander
7,216,936 B2 5/2007 Peterson
7,234,772 B2 6/2007 Wells
7,234,775 B2 6/2007 Serber
7,249,802 B2 7/2007 Schmitz et al.
7,264,312 B1 9/2007 Wang
7,267,405 B2 9/2007 Tin
7,270,378 B2 9/2007 Wilkerson et al.
7,273,253 B2 9/2007 Deimen et al.
7,281,764 B2 10/2007 Thole
7,293,833 B2 11/2007 Takeuchi et al.
7,293,837 B2 11/2007 Assmann et al.
7,303,230 B2 12/2007 Munn et al.
7,303,232 B1 12/2007 Chen et al.
7,322,653 B2 1/2008 Dragusin
7,331,633 B2 2/2008 Balensiefer et al.
7,344,194 B2 3/2008 Maier et al.
7,376,557 B2 5/2008 Specht et al.
7,393,054 B2 7/2008 McQueen et al.
7,399,036 B2 7/2008 Kowal et al.
7,419,222 B2 9/2008 Schmitz et al.
7,425,037 B2 9/2008 Schmitz et al.
7,429,080 B2 9/2008 Walker et al.
7,458,637 B2 12/2008 Norman et al.
7,472,962 B2 1/2009 Caruso et al.
7,500,718 B2 3/2009 Fookes
7,513,569 B2 4/2009 Curiger
7,530,637 B1 5/2009 Wu
7,566,039 B2 7/2009 Hung
7,594,700 B2 9/2009 Stumpf et al.
7,600,814 B2 10/2009 Link
7,625,045 B2 12/2009 Hatcher et al.
7,665,805 B2 2/2010 Ueda
7,677,515 B2 3/2010 Oddsen, Jr. et al.
7,677,654 B2 3/2010 Enberg et al.
7,681,956 B2 3/2010 Huang
7,686,399 B2 3/2010 Heidmann et al.
7,695,067 B2 4/2010 Goetz et al.
7,712,833 B2 5/2010 Ueda
7,717,513 B2 5/2010 Ueda
7,726,740 B2 6/2010 Masunaga
7,731,286 B2 6/2010 Wu
7,735,923 B2 6/2010 Roslund et al.
7,740,315 B2 6/2010 Ball et al.
7,784,870 B2 8/2010 Machael et al.
7,794,017 B2 9/2010 Kan et al.
7,794,022 B2 9/2010 Caruso et al.
7,798,573 B2 9/2010 Pennington et al.
7,806,478 B1 10/2010 Cvek
7,806,481 B2 10/2010 Eberlein
7,823,976 B2 * 11/2010 Mackert ..... A47C 1/03283 297/301.7 X
7,841,570 B2 11/2010 Mileos et al.
7,841,666 B2 11/2010 Schmitz et al.
7,850,244 B2 12/2010 Salewski
7,857,388 B2 12/2010 Bedford et al.
7,866,749 B2 1/2011 Costaglia et al.
7,887,137 B2 2/2011 Fisher et al.
7,896,439 B2 3/2011 Kan et al.
7,997,652 B2 8/2011 Roslund et al.
D645,682 S 9/2011 Nakamura et al.
8,025,334 B2 9/2011 Schmitz et al.
8,029,060 B2 10/2011 Parker et al.
8,047,612 B2 11/2011 Titz
8,052,213 B2 11/2011 Dahlbacka et al.
8,070,230 B2 12/2011 Krob et al.
8,087,729 B2 1/2012 Kladde
8,210,611 B2 7/2012 Aldrich et al.
8,251,448 B2 8/2012 Machael et al.
9,004,597 B2 * 4/2015 Battey ..... A47C 1/032 297/285
2001/0028188 A1 10/2001 Stumpf et al.
2002/0003368 A1 1/2002 Vanderiet et al.
2002/0180252 A1 12/2002 Frenkler et al.
2003/0107252 A1 6/2003 Kinoshita et al.
2003/0151287 A1 8/2003 Ueda et al.
2004/0000805 A1 1/2004 VanDeRiet et al.
2004/0124679 A1 7/2004 Teppo et al.
2004/0155509 A1 8/2004 Smith
2004/0212235 A1 10/2004 Elzenbeck
2005/0035638 A1 2/2005 Pennington et al.
2005/0062323 A1 3/2005 Dicks
2005/0093354 A1 5/2005 Ball
2005/0121954 A1 6/2005 Coffield et al.
2005/0231013 A1 10/2005 Knoblock et al.
2006/0103221 A1 5/2006 Kleist
2006/0181127 A1 8/2006 Pennington et al.
2007/0108818 A1 5/2007 Ueda et al.
2007/0108821 A1 5/2007 Ueda
2007/0170759 A1 7/2007 Nolan et al.
2007/0290537 A1 12/2007 Lin
2007/0290539 A1 12/2007 Hosoe et al.
2008/0272636 A1 11/2008 Machael et al.
2009/0001793 A1 1/2009 Knoblock et al.
2009/0001794 A1 1/2009 Pennington et al.
2009/0127905 A1 5/2009 Schmitz et al.
2009/0127914 A1 5/2009 Igarashi et al.
2009/0167071 A1 7/2009 Cassaday
2009/0184553 A1 7/2009 Dauphin
2009/0272613 A1 11/2009 Kawai et al.
2009/0302662 A1 12/2009 Groelsma et al.
2009/0315376 A1 * 12/2009 Nishiwaki ..... A61G 5/006 297/301.2
2010/0007190 A1 1/2010 Johnson et al.
2010/0164262 A1 7/2010 Okimura et al.
2010/0237674 A1 9/2010 Lee
2010/0259081 A1 10/2010 Kuno
2010/0259082 A1 10/2010 Votteler
2010/0270844 A1 10/2010 Hood
2011/0012395 A1 1/2011 Roslund et al.
2011/0031793 A1 2/2011 Machael et al.
2011/0068613 A1 3/2011 Breitkreuz
2011/0193387 A1 8/2011 Kim
2011/0233979 A1 9/2011 An
2011/0241403 A1 10/2011 Yamaguchi et al.
2011/0272994 A1 11/2011 Walser
2012/0007400 A1 1/2012 Behar et al.

(56) References Cited

U.S. PATENT DOCUMENTS

| | | | |
|---|---|---|---|
| 2012/0025578 | A1 | 2/2012 | Cvek |
| 2012/0032484 | A1 | 2/2012 | Cvek |

FOREIGN PATENT DOCUMENTS

| | | |
|---|---|---|
| AU | 2004200744 | 3/2004 |
| CA | 2384668 | 12/1996 |
| CA | 2162782 | 5/1997 |
| CA | 2525902 | 7/2002 |
| CA | 2782824 | 10/2007 |
| DE | 3700862 | 7/1988 |
| DE | 3743013 | 6/1989 |
| EP | 0085670 | 8/1983 |
| EP | 0155130 | 9/1985 |
| EP | 0240389 | 10/1987 |
| EP | 0281845 | 9/1988 |
| EP | 0309804 | 4/1989 |
| EP | 0363833 | 4/1990 |
| EP | 0435297 | 7/1991 |
| EP | 0517206 | 12/1992 |
| EP | 0619966 | 10/1994 |
| EP | 0645976 | 4/1995 |
| EP | 0850005 | 2/1997 |
| EP | 0836402 | 4/1998 |
| EP | 0871383 | 10/1998 |
| EP | 1033927 | 9/2000 |
| EP | 1082037 | 3/2001 |
| EP | 1191863 | 4/2002 |
| EP | 1192879 | 4/2002 |
| EP | 1247474 | 10/2002 |
| EP | 1319355 | 6/2003 |
| EP | 1454569 | 9/2004 |
| EP | 1579787 | 9/2005 |
| EP | 1716785 | 11/2006 |
| EP | 1719435 | 11/2006 |
| EP | 1855566 | 11/2007 |
| EP | 1855567 | 11/2007 |
| EP | 1855569 | 11/2007 |
| EP | 1874161 | 1/2008 |
| EP | 1911374 | 4/2008 |
| EP | 1915925 | 4/2008 |
| EP | 1931232 | 6/2008 |
| EP | 1976414 | 10/2008 |
| EP | 1998649 | 12/2008 |
| EP | 2068677 | 6/2009 |
| EP | 2070444 | 6/2009 |
| EP | 2095741 | 9/2009 |
| EP | 2187782 | 5/2010 |
| EP | 2233044 | 9/2010 |
| EP | 2339943 | 7/2011 |
| EP | 2351500 | 8/2011 |
| HK | 1061959 | 7/2007 |
| JP | 10179315 | 7/1998 |
| JP | 2006204802 | 8/2006 |
| JP | 2006311900 | 11/2006 |
| JP | 2007152145 | 6/2007 |
| JP | 2007175520 | 7/2007 |
| JP | 2008055134 | 3/2008 |
| JP | 2008080089 | 4/2008 |
| JP | 2008104568 | 5/2008 |
| JP | 2011041614 | 3/2011 |
| JP | 2013022078 | 2/2013 |
| JP | 2013039340 | 2/2013 |
| KR | 20050116218 | 12/2005 |
| WO | 8805276 | 7/1988 |
| WO | 0170073 | 9/2001 |
| WO | 0232269 | 4/2002 |
| WO | 02102197 | 12/2002 |
| WO | 02102199 | 12/2002 |
| WO | 03068025 | 8/2003 |
| WO | 2006094261 | 9/2006 |
| WO | 2006119209 | 11/2006 |
| WO | 2007112236 | 10/2007 |
| WO | 2008018117 | 2/2008 |
| WO | 2008112918 | 9/2008 |
| WO | 2008112919 | 9/2008 |
| WO | 2010071282 | 6/2010 |
| WO | 2011022856 | 3/2011 |
| WO | 2011156536 | 12/2011 |
| WO | 2012170863 | 4/2013 |

* cited by examiner 77b
72b
75b
73b
77b
70b
76b
16b
46b
58b
52b
68b
54b
60b
50b
64b
66b
66b
139b
56b
88b
94b
48b
90b
92b
62b
52b
123b
44b
47b
40b
78b
84b
96b
123b
82b
43b
45b
42b
131b
137b
51b
53b
80b
59b
57b
135b
55b
135b
38b
36b
32b 34b
132b
38b

CHAIR BACK MECHANISM AND CONTROL ASSEMBLY

CROSS REFERENCE TO RELATED APPLICATIONS

This application is a continuation of U.S. patent application Ser. No. 14/029,176, filed Sep. 17, 2013, now U.S. Pat. No. 9,004,597 B2, entitled "CHAIR BACK MECHANISM AND CONTROL ASSEMBLY," which claims benefit of U.S. Provisional Patent Application No. 61/703,677, filed on Sep. 20, 2012, entitled "CHAIR ASSEMBLY," U.S. Provisional Patent Application No. 61/703,667, filed on Sep. 20, 2012, entitled "CHAIR ARM ASSEMBLY," U.S. Provisional Patent Application No. 61/703,666, filed on Sep. 20, 2012, entitled "CHAIR ASSEMBLY WITH UPHOLSTERY COVERING," U.S. Provisional Patent Application No. 61/703,515, filed on Sep. 20, 2012, entitled "SPRING ASSEMBLY AND METHOD," U.S. Provisional Patent Application No. 61/703,663, filed on Sep. 20, 2012, entitled "CHAIR BACK MECHANISM AND CONTROL ASSEMBLY," U.S. Provisional Patent Application No. 61/703,659, filed on Sep. 20, 2012, entitled "CONTROL ASSEMBLY FOR CHAIR," U.S. Provisional Patent Application No. 61/703,661 filed on Sep. 20, 2012, entitled "CHAIR ASSEMBLY," U.S. Provisional Patent Application No. 61/754,803 filed on Jan. 21, 2013, entitled "CHAIR ASSEMBLY WITH UPHOLSTERY COVERING," U.S. Design patent application No. 29/432,765 filed on Sep. 20, 2012 entitled "CHAIR," now U.S. Design Pat. No. D697,726, and U.S. Design patent application No. 29/432,767, filed on Sep. 20, 2012, entitled "CHAIR," now U.S. Design Pat. No. D697,727, the entire disclosures of which are incorporated herein by reference.

BACKGROUND OF THE INVENTION

The present invention relates to a chair back mechanism and related control assembly for a chair assembly, and in particular to a reclinable back with a flexible back support assembly and a flexible lumbar region, and a control assembly for manipulating and controlling components of the chair back mechanism.

SUMMARY OF THE INVENTION

One aspect of the present invention is a chair assembly that includes a seat support structure operably coupled to the base structure, wherein the seat support structure is adapted to support a seated user thereon, a back support structure operably coupled to the base structure, wherein the back support structure is adapted to move between an upright position and a reclined position, and at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude. The chair assembly further includes an adjustment assembly operably coupled to the at least one biasing assembly allowing a seated user to adjust the biasing force between the first and second magnitudes, wherein the adjustment assembly adjusts the at least one biasing assembly between a first configuration corresponding to the first magnitude of the biasing force and a second configuration corresponding to the second magnitude of the biasing force, and an assist feature exerting an assist force on the biasing assembly, thereby reducing an input force required to be applied by a user to adjust the biasing force of the second magnitude to the first magnitude along at least a majority of a full range of travel of the adjustment assembly.

Another aspect of the present invention is a chair assembly that includes a seat support structure operably coupled to the base structure, wherein the seat support structure is adapted to support a seated user thereon, a back support structure operably coupled to the base structure, wherein the back support structure is adapted to move between an upright position and a reclined position, and at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude. The chair assembly further includes an adjustment assembly operably coupled to the at least one biasing assembly allowing a seated user to adjust the biasing force between the first and second magnitudes by exerting an input force, wherein the adjustment assembly adjusts the at least one biasing assembly between a first configuration corresponding to the first magnitude of the biasing force and a second configuration corresponding to the second magnitude of the biasing force, and wherein the input force required to adjust the biasing force from the first magnitude to the second magnitude increases as the biasing force is increased along a substantial full range of travel of the adjustment assembly.

Still another aspect of the present invention is a chair assembly that includes a seat support structure operably coupled to the base structure, wherein the seat support structure is adapted to support a seated user thereon, a back support structure operably coupled to the base structure, wherein the back support structure is adapted to move between an upright position and a reclined position, and at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude. The chair assembly further includes an adjustment assembly operably coupled to the at least one biasing assembly allowing a seated user to adjust the biasing force between the first and second magnitudes, wherein the adjustment assembly adjusts the at least one biasing assembly between a first configuration corresponding to the first magnitude of the biasing force and a second configuration corresponding to the second magnitude of the biasing force, and an assist feature exerting an assist force on the biasing assembly, thereby substantially reducing an input force required to be applied by a user to adjust the biasing force of the second magnitude to the first magnitude.

These and other features, advantages, and objects of the present invention will be further understood and appreciated by those skilled in the art by reference to the following specification, claims, and appended drawings.

DETAILED DESCRIPTION OF THE PREFERRED EMBODIMENTS

Figure 1:
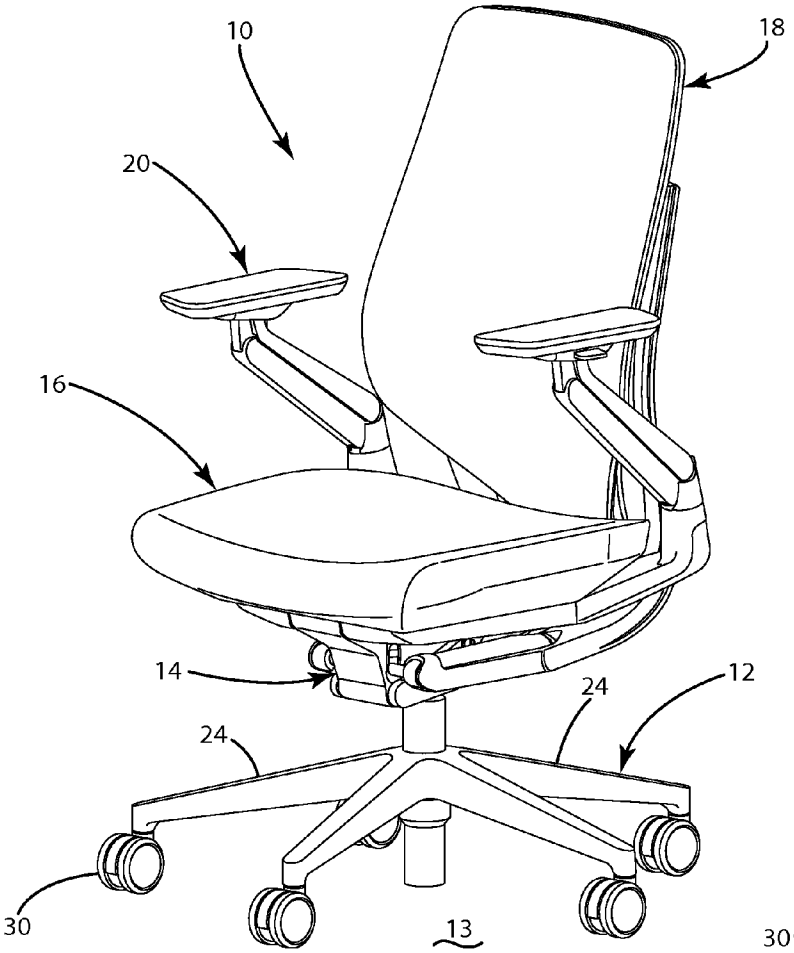
FIG. 1 is a front perspective view of a chair assembly embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise. Various elements of the embodiments disclosed herein may be described as being operably coupled to one another, which includes elements either directly or indirectly coupled to one another. Further, the term "chair" as utilized herein encompasses various seating arrangements of office chairs, vehicle seating, home seating, stadium seating, theater seating, and the like.

Figure 2:
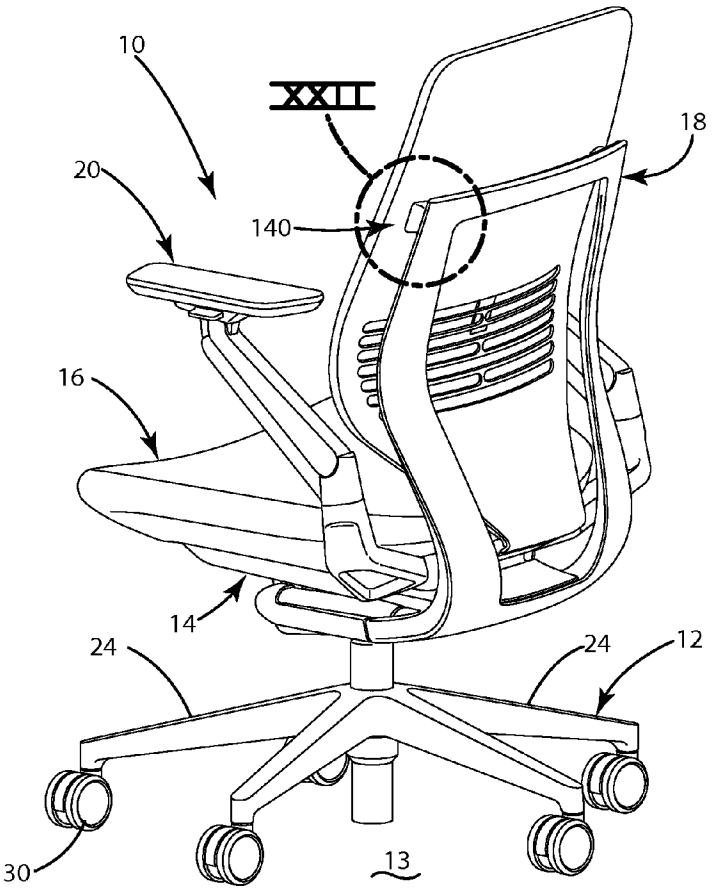
FIG. 2 is a rear perspective view of the chair assembly.
Figure 4:
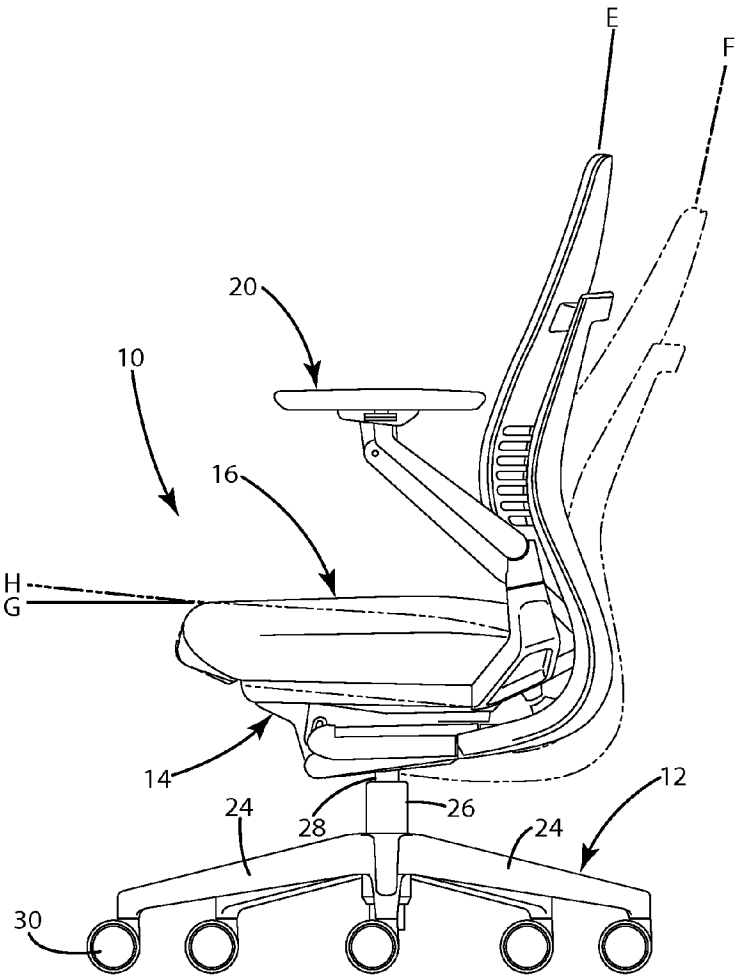
FIG. 4 is a side elevational view of the chair assembly showing the chair assembly in an upright position and in a reclined position in dashed line.
Figure 3:
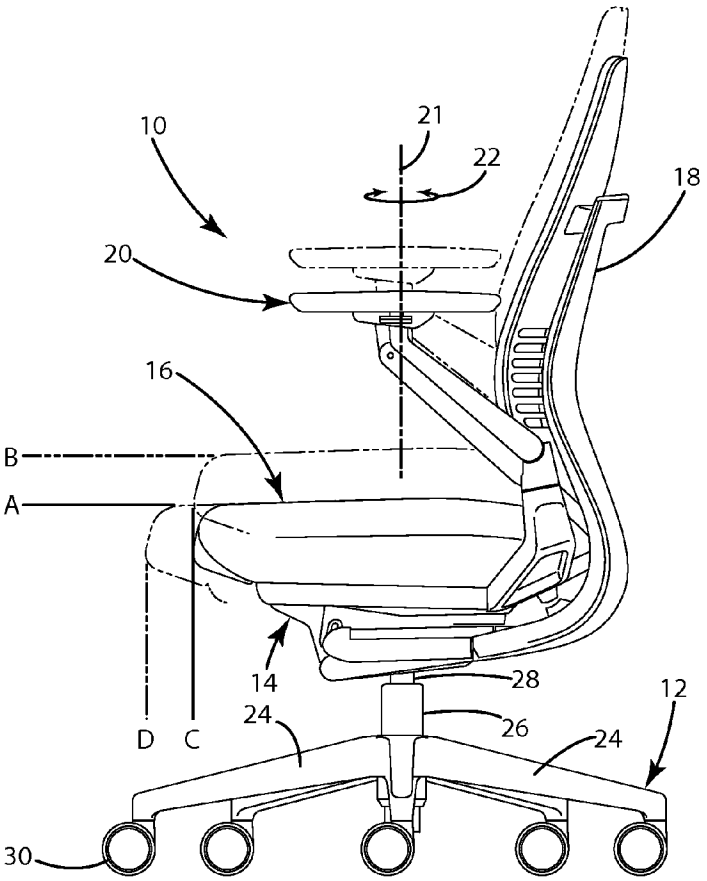
FIG. 3 is a side elevational view of the chair assembly showing the chair assembly in a lowered position and in a raised position in dashed line, and a seat assembly in a retracted position and an extended position in dashed line.

The reference numeral 10 (FIGS. 1 and 2) generally designates a chair assembly embodying the present invention. In the illustrated example, the chair assembly 10 includes a castered base assembly 12 abutting a supporting floor surface 13, a control or support assembly 14 supported by the castered base assembly 12, a seat assembly 16 and back assembly 18 each operably coupled with the control assembly 14, and a pair of arm assemblies 20. The control assembly 14 (FIG. 3) is operably coupled to the base assembly 12 such that the seat assembly 16, the back assembly 18 and the arm assemblies 20 may be vertically adjusted between a fully lowered position A and a fully raised position B, and pivoted about a vertical axis 21 in a direction 22. The seat assembly 16 is operably coupled to the control assembly 14 such that the seat assembly 16 is longitudinally adjustable with respect to the control assembly 14 between a fully retracted position C and a fully extended position D. The seat assembly 16 (FIG. 4) and the back assembly 18 are operably coupled with the control assembly 14 and with one another such that the back assembly 18 is movable between a fully upright position E and a fully reclined position F, and further such that the seat assembly 16 is movable between a fully upright position G and a fully reclined position H corresponding to the fully upright position E and the fully reclined position F of the back assembly 18, respectively.

The base assembly 12 includes a plurality of pedestal arms 24 radially extending and spaced about a hollow central column 26 that receives a pneumatic cylinder 28 therein. Each pedestal arm 24 is supported above the floor surface 13 by an associated caster assembly 30. Although the base assembly 12 is illustrated as including a multiple-arm pedestal assembly, it is noted that other suitable supporting structures maybe utilized, including but not limited to fixed columns, multiple leg arrangements, vehicle seat support assemblies, stadium seating arrangements, home seating arrangements, theater seating arrangements, and the like.

Figure 5A:
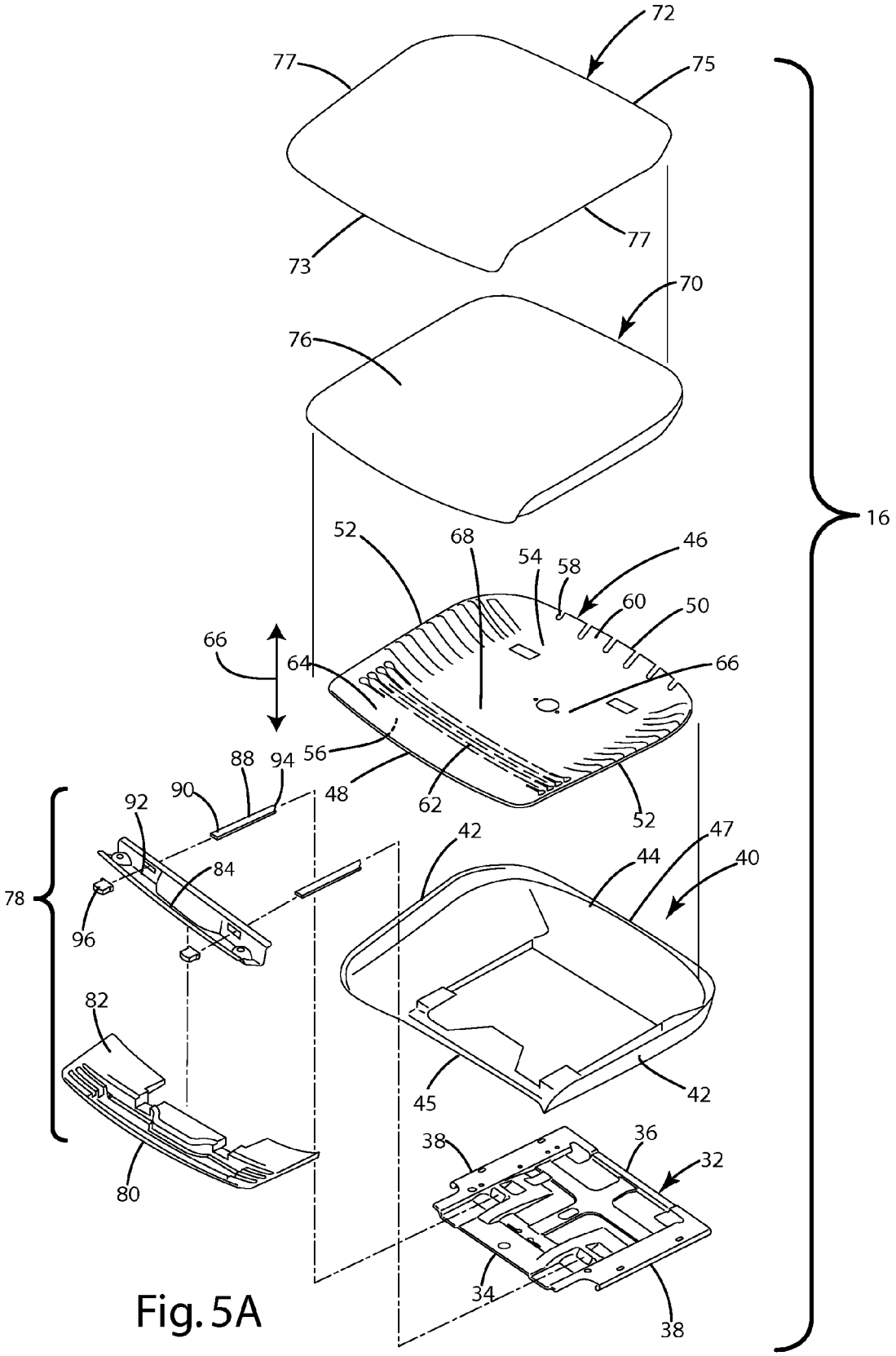
FIG. 5A is an exploded view of the seat assembly.
Figure 5B:
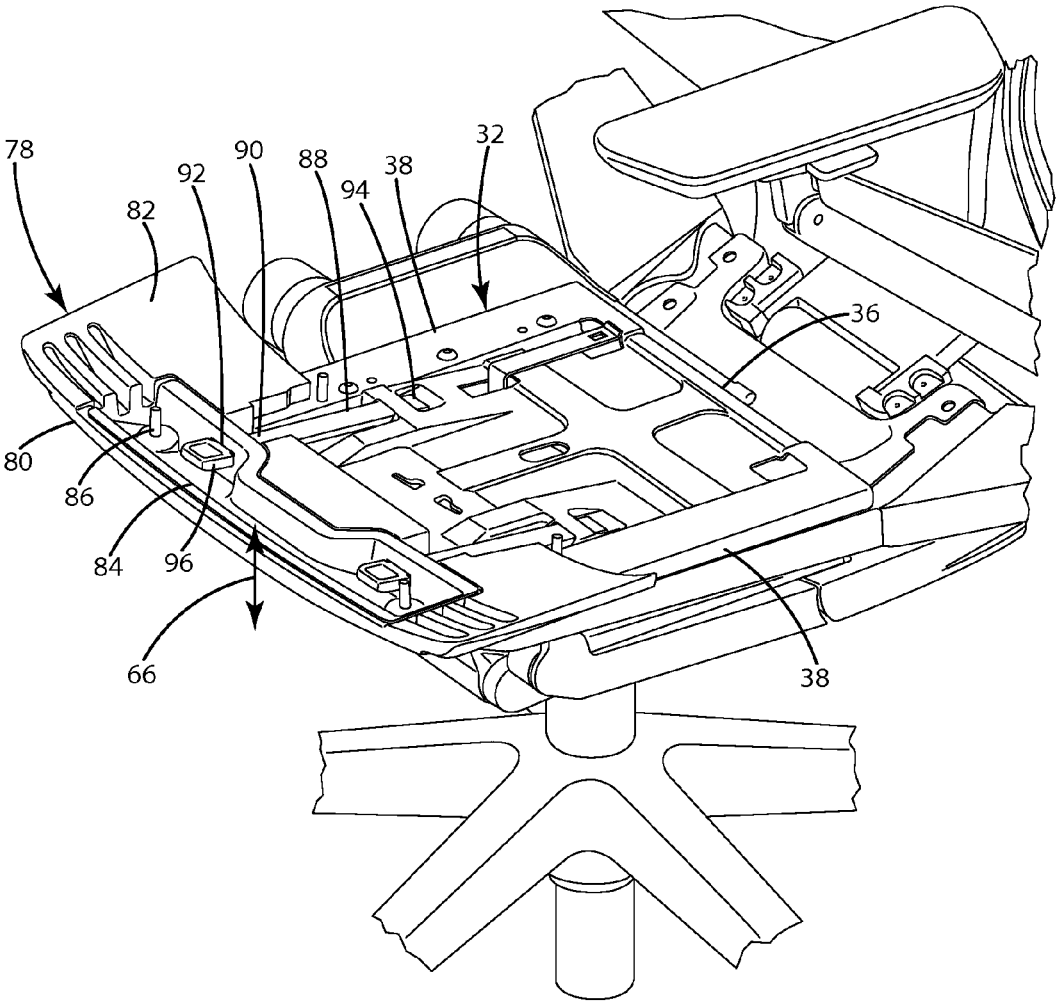
FIG. 5B is an enlarged perspective view of the chair assembly with a portion of the seat assembly removed to illustrate a spring support assembly.

The seat assembly 16 (FIG. 5A) includes a relatively rigid seat support plate 32 having a forward edge 34, a rearward edge 36, and a pair of C-shaped guide rails 38 defining the side edges of the seat support plate 32 (FIG. 5B) and extending between the forward edge 34 and the rearward edge 36. The seat assembly 16 further includes a flexibly resilient outer seat shell 40 having a pair of upwardly turned side portions 42 and an upwardly turned rear portion 44 that cooperate to form an upwardly disposed generally concave shape, and a forward edge 45. In the illustrated example, the seat shell 40 is comprised of a relatively flexible material such as a thermoplastic elastomer (TPE). In assembly, the outer seat shell 40 is secured and sandwiched between the seat support plate 32 and a plastic, flexibly resilient seat pan 46 which is secured to the seat support plate 32 by a plurality of mechanical fasteners. The seat pan 46 includes a forward edge 48, a rearward edge 50, side edges 52 extending between the forward edge 48 and the rearward edge 50, and a top surface 54 and a bottom surface 56 that cooperate to form an upwardly disposed generally concave shape. In the illustrated example, the seat pan 46 includes a plurality of longitudinally extending slots 58 extending forwardly from the rearward edge 50. The slots 58 cooperate to define a plurality of fingers 60 therebetween, each finger 60 being individually flexibly resilient. The seat pan 46 further includes a plurality of laterally oriented, elongated apertures 62 located proximate the forward edge 48. The apertures 62 cooperate to increase the overall flexibility of the seat pan 46 in the area thereof, and specifically allow a forward portion 64 of the seat pan 46 to flex in a vertical direction 66 with respect to a rearward portion 68 of the seat pan 46, as discussed further below. The seat assembly 16 further includes a foam cushion member 70 having an upper surface 76, and that rests upon the top surface 54 of the seat pan 46 and is cradled within the outer seat shell 40. The seat assembly 16 further includes a fabric seat cover 72 having a forward edge 73, a rearward edge 75, and a pair of side edges 77 extending between the forward edge 73 and rearward edge 75. A spring support assembly 78 (FIGS. 5A and 5B) is secured to the seat assembly 16 and is adapted to flexibly support the forward portion 64 of the seat pan 46 for flexure in the vertical direction 66. In the illustrated example, the spring support assembly 78 includes a support housing 80 comprising a foam and having side portions 82 defining an upwardly concave arcuate shape. The spring support assembly 78 further includes a relatively rigid attachment member 84 that extends laterally between the side portions 82 of the support housing 80 and is located between the support housing 80 and the forward portion 64 of the seat pan 46. A plurality of mechanical fasteners 86 secure the support housing 80 and the attachment member 84 to the forward portion 64 of the seat pan 46. The spring support assembly 78 further includes a pair of cantilever springs 88 each having a distal end 90 received through a corresponding aperture 92 of the attachment member 84, and a proximate end 94 secured to the seat support plate 32 such that the distal end 90 of each cantilever spring 88 may flex in the vertical direction 66. A pair of linear bearings 96 are fixedly attached to the attachment member 84 and aligned with the apertures 92 thereof, such that each linear bearing 96 slidably receives the distal end 90 of a corresponding cantilever spring 88. In operation, the cantilever springs 88 cooperate to allow the forward portion 64 of the seat pan 46, and more generally the entire forward portion of seat assembly 16 to flex in the vertical direction 66 when a seated user rotates forward on the seat assembly 16 and exerts a downward force on the forward edge thereof.

Figure 6:
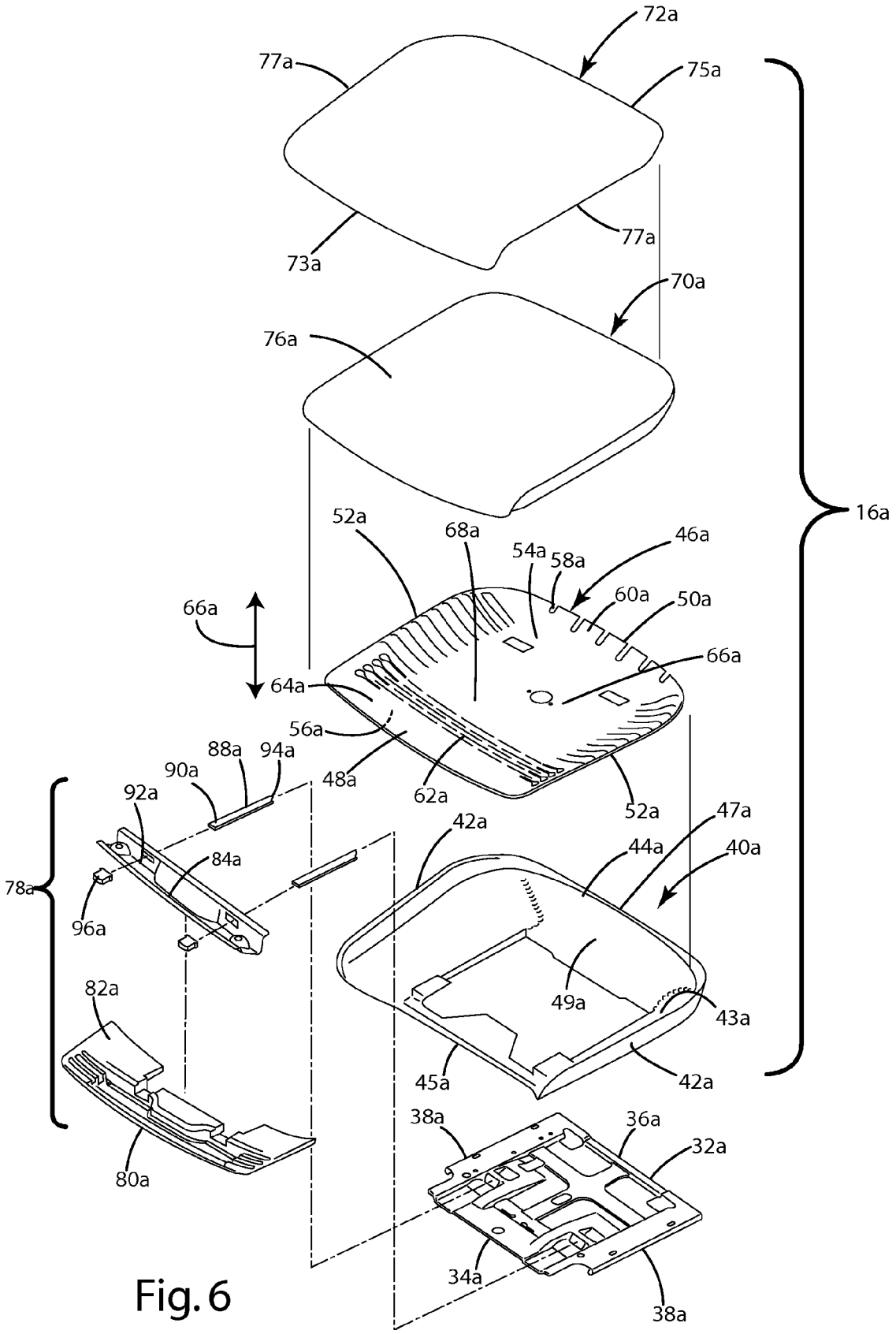
FIG. 6 is an exploded perspective view of the seat assembly.

The reference numeral 16*a* (FIG. 6) generally designates another embodiment of the seat assembly of the present invention. Since the seat assembly 16*a* is similar to the previously described seat assembly 16, similar parts appearing in FIG. 5A and FIGS. 6-10, respectively are represented by the same, corresponding reference numeral, except for the suffix "a" in the numerals of the latter in the illustrated example. The seat assembly 16*a* includes a relatively rigid seat support plate 32*a* having a forward edge 34*a*, a rearward edge 36*a*, and a pair of C-shaped guide rails 38*a* defining the side edges of the seat support plate 32*a* and extending between the forward edge 34*a* and the rearward edge 36*a*. The seat assembly 16*a* further includes a flexibly resilient outer seat shell 40*a* (FIGS. 6 and 7) having a pair of upwardly turned side portions 42*a* each terminating in a side edge 43*a*, a forward edge 45*a*, and an upwardly turned rear portion 44*a* that terminates in a rear edge 47*a* and includes a flap portion 49*a*, wherein the side portions 42*a* and rear portion 44*a* cooperate to form a three-dimensional upwardly disposed generally concave shape. The seat shell 40*a* is comprised of a relatively flexible material such as a thermoplastic elastomer (TPE) and is molded as a single integral piece. In assembly, described in further detail below, the outer seat shell 40*a* is secured and sandwiched between the seat support plate 32*a* and a plastic, flexibly resilient seat pan 46*a* which is secured to the seat support plate 32*a* by a plurality of mechanical fasteners. The seat pan 46*a* includes a forward edge 48*a*, a rearward edge 50*a*, side edges 52*a* extending between the forward edge 48*a* and the rearward edge 50*a*, a top surface 54*a* and a bottom surface 56*a* that cooperate to form an upwardly disposed generally concave shape. In the illustrated example, the seat pan 46*a* includes a plurality of longitudinally extending slots 58*a* extending forwardly from the rearward edge 50*a*. The slots 58*a* cooperate to define a plurality of fingers 60*a* therebetween, each finger 60*a* being individually flexibly resilient. The seat pan 46*a* further includes a plurality of laterally oriented, elongated apertures 62*a* located proximate the forward edge 48*a*. The apertures 62*a* cooperate to increase the overall flexibility of the seat pan 46*a* in the area thereof, and specifically allow a forward portion 64*a* of the seat pan 46*a* to flex in a vertical direction 66*a* with respect to a rearward portion 68*a* of the seat pan 46*a*, as discussed further below. The seat assembly 16*a* further includes a foam cushion member 70*a* having an upper surface 76*a*, and that rests upon the top surface 54*a* of the seat pan 46*a* and is cradled within the outer seat shell 40*a*. The seat assembly 16*a* further includes a fabric seat cover 72*a* having a forward edge 73*a*, a rearward edge 75*a* and a pair of side edges 77*a* extending therebetween. The seat assembly 16*a* is supported by a spring support assembly 78*a* (FIG. 6) that is similar in construction and operation as the previously described spring support assembly 78.

Figure 7:
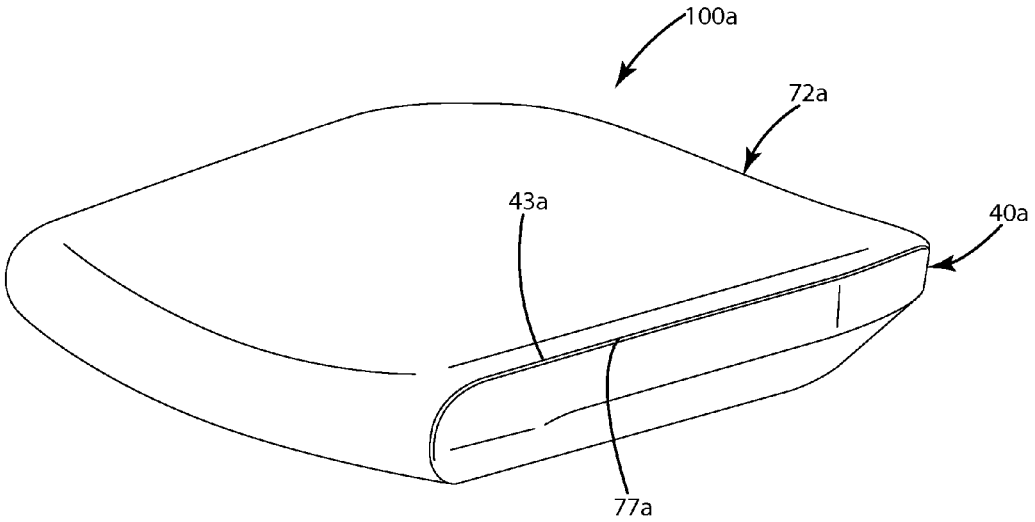
FIG. 7 is a top perspective view of the seat assembly.
Figure 8:
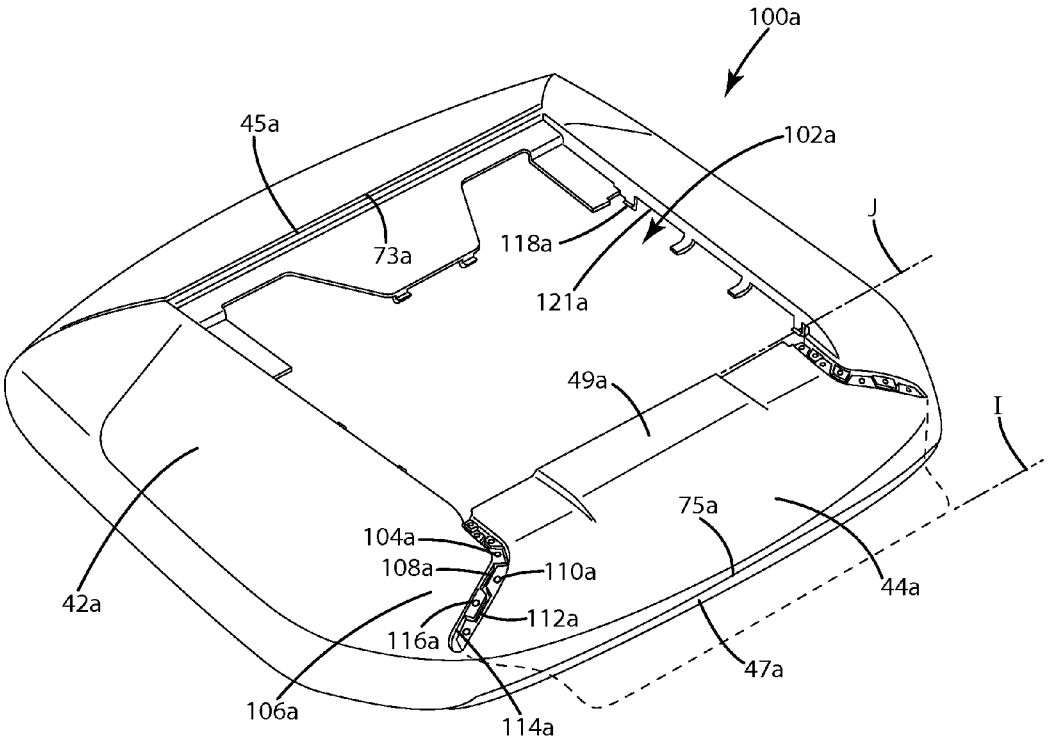
FIG. 8 is a bottom perspective view of the seat assembly.
Figure 9:
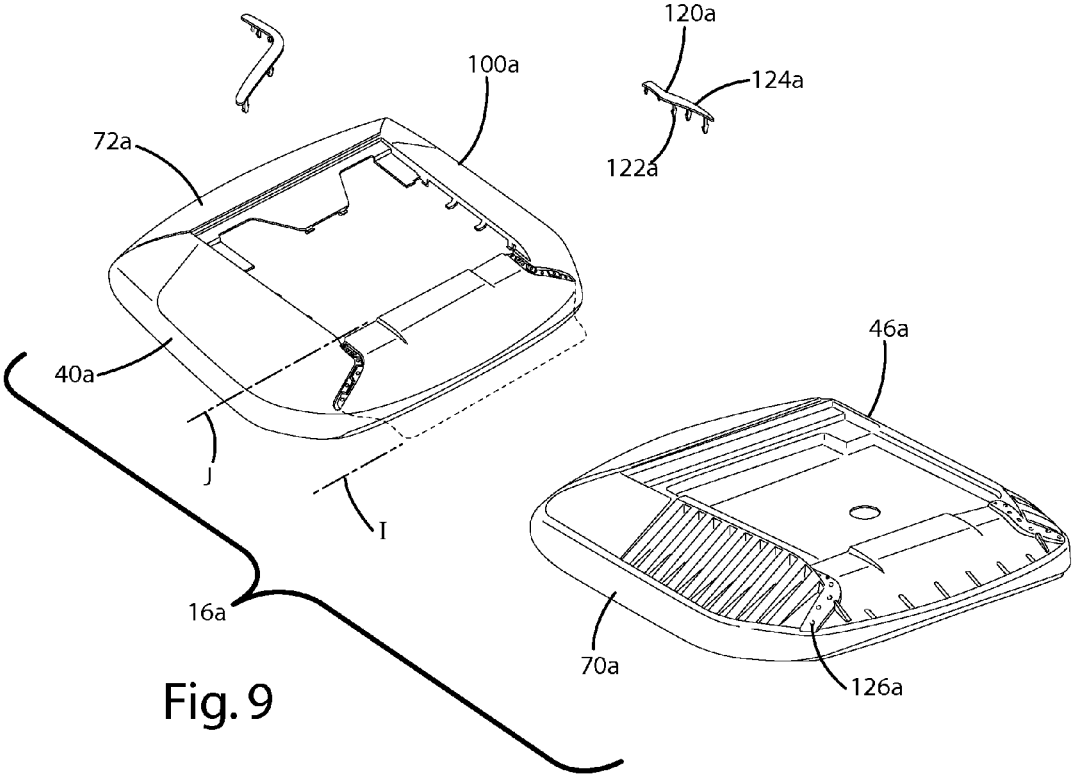
FIG. 9 is an exploded bottom perspective view of the cover assembly and the seat assembly.
Figure 10:
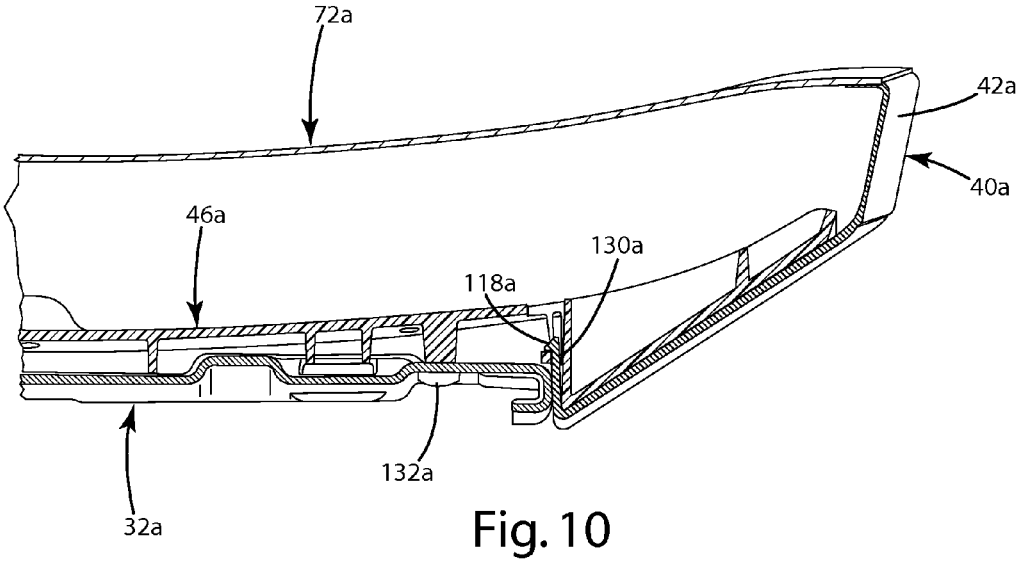
FIG. 10 is a cross-sectional view of the cover assembly.

As best illustrated in FIGS. 7 and 8, the flexible resilient seat shell 40*a* and the fabric seat cover 72*a* cooperate to form an upholstery cover assembly or cover 100*a*. Specifically, the side edges 43*a* of the seat shell 40*a* and the side edges 77*a* of the seat cover 72*a*, the forward edge 45*a* of the seat shell 40*a* and the forward edge 73*a* of the seat cover

72*a*, and the rear edge 47*a* of the seat shell 40*a* and the rear edge 75*a* of the seat cover 72*a* are respectively attached to one another to form the cover 100*a* and to define an interior space 102*a* therein.

The flap portion 49*a* of the seat shell 40*a* includes a pair of corner edges 104*a* each extending along a corner 106*a* of the seat shell 40*a* located between the rear portion 44*a* and respective side portions 42*a*, such that the flap portion 49*a* is movable between an open position I and a closed position J. In the illustrated example, each corner edge 104*a* of the flap portion 49*a* includes a plurality of tabs 108*a* spaced along the corner edge 104*a* and each including an aperture 110*a* extending therethrough. The tabs 108*a* of the corner edge 104*a* are interspaced with a plurality of tabs 112*a* spaced along a corner edge 114*a* of each side portion 42*a*. Each of the tabs 112*a* includes an aperture 116*a* that extends therethrough. The seat shell 40*a* also includes a plurality of integrally-molded coupling tabs 118*a* spaced about an inner edge 121*a* of the seat shell 40*a* and each having a Z-shaped, cross-section configuration.

In assembly, the upholstery cover assembly 100*a* (FIG. 9) is constructed from the seat shell 40*a* and seat cover 72*a* as described above. The seat pan 46*a*, the cushion member 70*a* and the spring support assembly 78*a* are then arranged with respect to one another assembled with the upholstery cover assembly 100*a* by positioning the flap 49*a* in the open position I, positioning the seat pan 46*a*, the cushion member 70*a* and spring support assembly 78*a* within the interior space 102*a*, and then moving the flap 49*a* to the closed position J. A pair of quick-connect fasteners 120*a* each include a plurality of snap couplers 122*a* spaced along the length of an L-shaped body portion 124*a*. In assembly, the snap couplers 122*a* are extended through the apertures 110*a*, 116*a* of the tabs 108*a*, 112*a*, and are snapably received within corresponding apertures 126*a* of the seat pan 46*a*, thereby securing the corner edges 104*a*, 114*a* to the seat pan 46*a* and the flap portion 49*a* in the closed position J.

Further in assembly, the coupling tabs 118*a* (FIG. 10) are positioned within corresponding apertures 130*a* of the seat pan 46*a*, such that the cover assembly 100*a* is temporarily secured to the seat pan 46*a*, thereby allowing further manipulation of the cover seat assembly 16*a* during assembly while maintaining connection and alignment of the cover assembly 100*a* with the seat pan 46*a*. As used herein, "temporarily securing" is defined as a securing not expected to maintain the securement of the cover assembly 100*a* to the seat pan 46*a* by itself during normal use of the chair assembly throughout the normal useful life of the chair assembly. The support plate 32*a* is then secured to an underside of the seat pan 46*a* by a plurality of screws 132*a*, thereby sandwiching the coupling tabs 118*a* between the support plate 32*a* and the seat pan 46*a*, and permanently securing the cover assembly 100*a* to the seat pan 46*a*. As used herein, "permanently securing" is defined as a securing expected to maintain the securement of the cover assembly to the seat pan 46*a* during normal use of the chair assembly throughout the normal useful life of the chair assembly.

Figure 11:
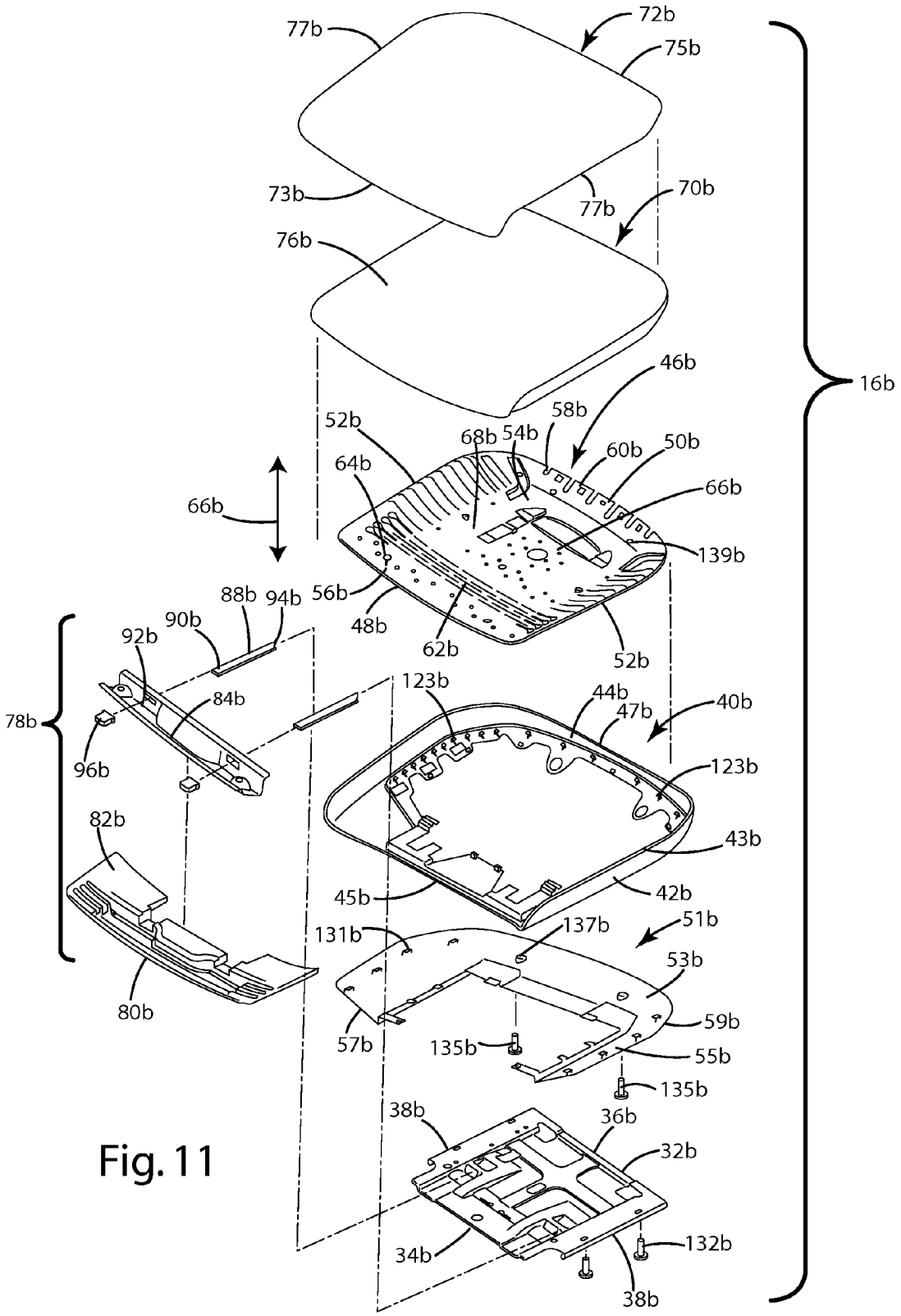
FIG. 11 is an exploded perspective view of an alternative embodiment of the seat assembly.

The reference numeral 16*b* (FIG. 11) generally designates another embodiment of the seat assembly. Since the seat assembly 16*b* is similar to the previously described seat assemblies 16 and/or seat assembly 16*a*, similar parts appearing in FIGS. 5A-10 and FIGS. 11-17 respectively are represented by the same, corresponding reference numeral, except for the suffix "b" in the numerals of the latter. In the illustrated example, the seat assembly 16*b* is similar in configuration and construction to the seat assembly 16 and the seat assembly 16*a*, with the most notable exception being an alternatively, configured and constructed outer seat shell 40*b* and upholstery cover 100*b*.

The seat assembly 16*b* (FIG. 11) includes a flexibly resilient outer seat shell 40*b* having a pair of upwardly turned side portions 42*b* each terminating in a side edge 43*b*, a forward edge 45*b*, and an upwardly turned rear portion 44*b* that terminates in a rear edge 47*b*, wherein the side portions 42*b* and rear portion 44*b* cooperate to form a three-dimensional upwardly disposed generally concave shape. The seat shell 40*b* is comprised of a relatively flexible material such as a thermoplastic elastomer (TPE) and is molded as a single integral piece. In assembly, described in further detail below, the outer seat shell 40*b* is secured and sandwiched between the seat support plate 32*b*, a plastic, flexibly resilient seat pan 46*b* and a plastic, substantially rigid overlay 51*b*, each of which is secured to the seat support plate 32*b* by a plurality of mechanical fasteners. The overlay 51*b* has an upwardly arcuate shape and includes a rear wall 53*b* and a pair of forwardly-extending sidewalls 55*b* each including a forward-most edge 57*b*, and wherein the rear wall 53*b* and sidewalls 55*b* cooperate to form an uppermost edge 59*b*. The seat pan 46*b* includes a forward edge 48*b*, a rearward edge 50*b*, side edges 52*b* extending between the forward edge 48*b* and the rearward edge 50*b*, a top surface 54*b* and a bottom surface 56*b* that cooperate to form an upwardly disposed generally concave shape.

Figure 12:
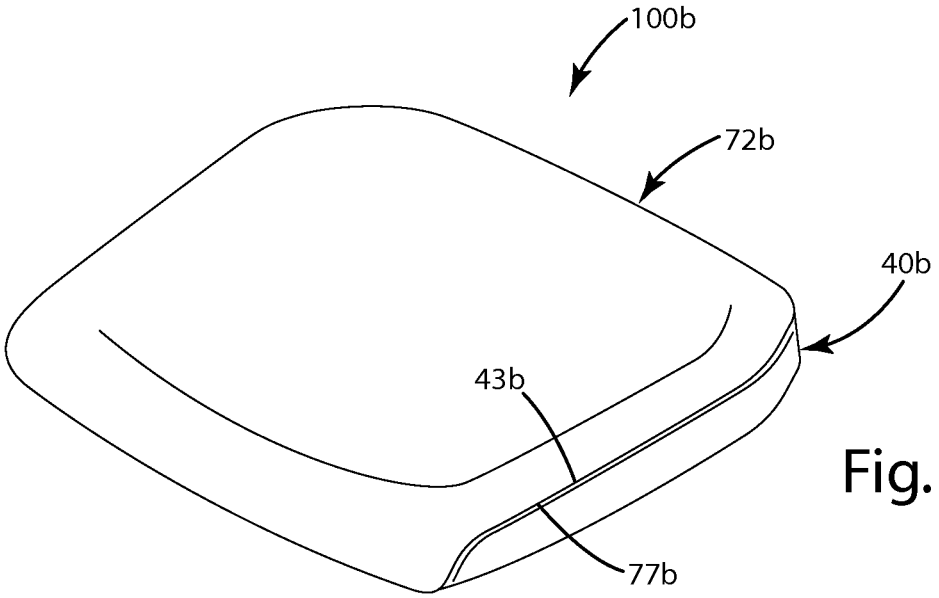
FIG. 12 is a top perspective view of the alternative embodiment of the seat assembly.
Figure 13:
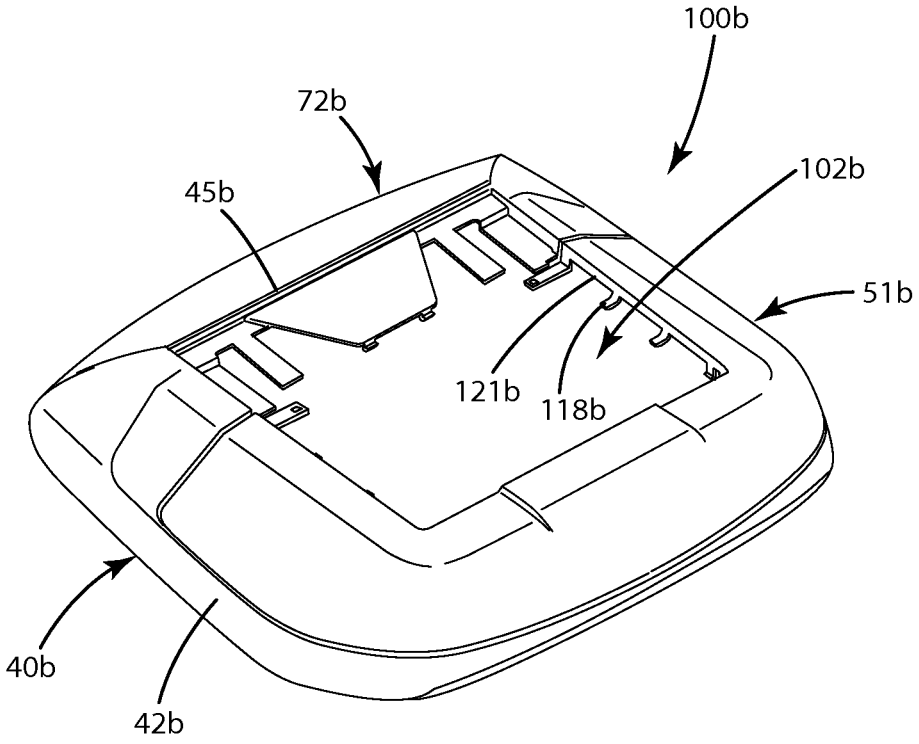
FIG. 13 is a bottom perspective view of the alternative embodiment of the seat assembly.
Figure 14:
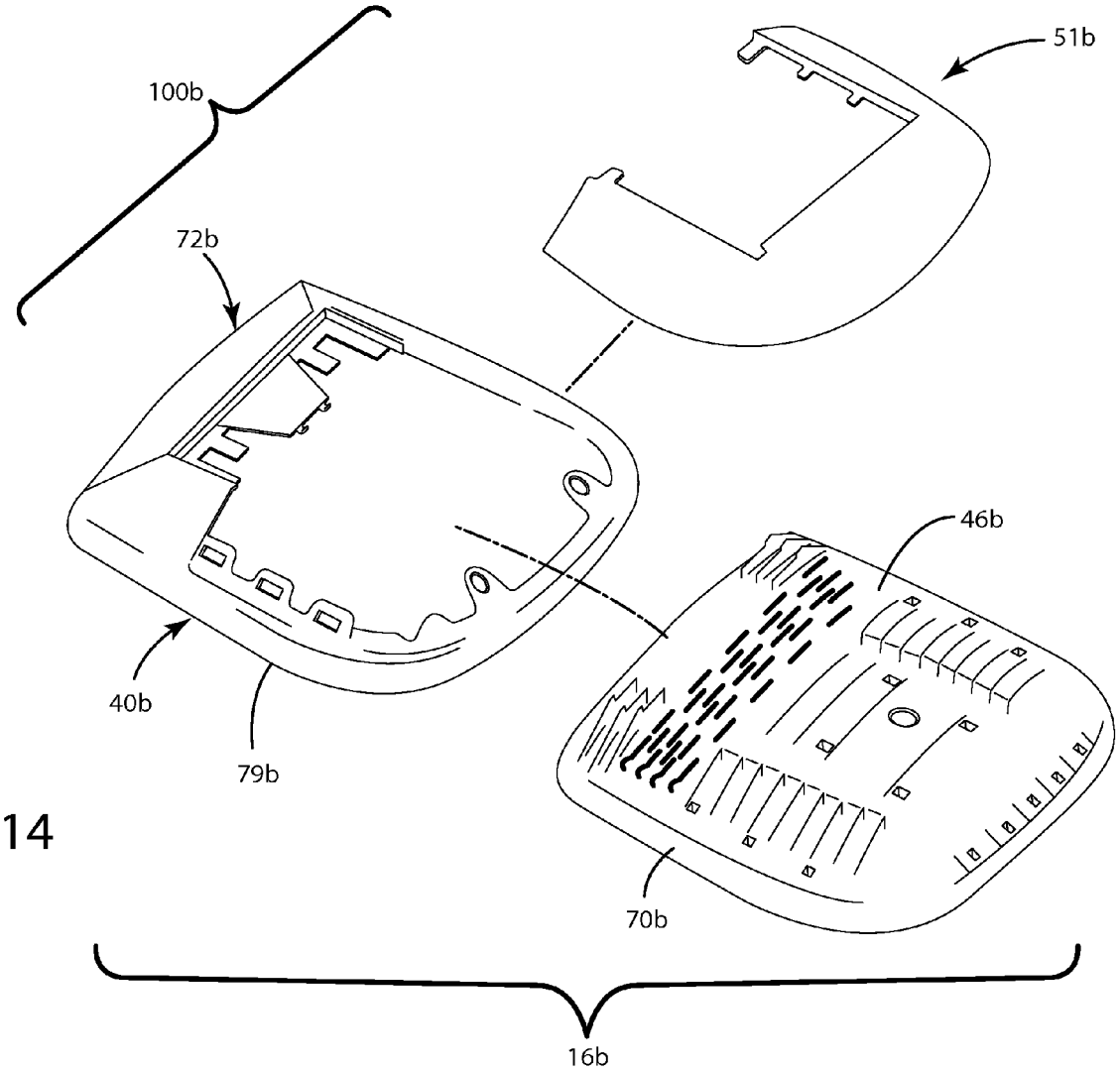
FIG. 14 is an exploded bottom perspective view of the alternative embodiment of the seat assembly.

As best illustrated in FIGS. 12 and 13, the flexible resilient seat shell 40*b*, the fabric seat cover 72*b* and the overlay 51*b* cooperate to form an upholstery cover assembly or cover 100*b*. In the illustrated example, the side edges 43*b* of the seat shell 40*b* and the side edges 77*b* of the seat cover 72*b*, the forward edge 45*b* of the seat shell 40*b* and the forward edge 73*b* of the seat cover 72*b*, and the rear edge 47*b* of the seat shell 40*b* and the rear edge 75*b* of the seat cover 72*b* are respectively attached to one another, such that the seat shell 40*b* and the fabric seat cover 72*b* cooperate with the overlay 51*b* to form the cover 100*b* and to define an interior space 102*b* therein. The seat shell 40*b* also includes a plurality of integrally-molded coupling tabs 118*b* spaced about an inner edge 121*b* of the seat shell 40*b* and each having a Z-shaped, cross-section configuration.

Figure 15:
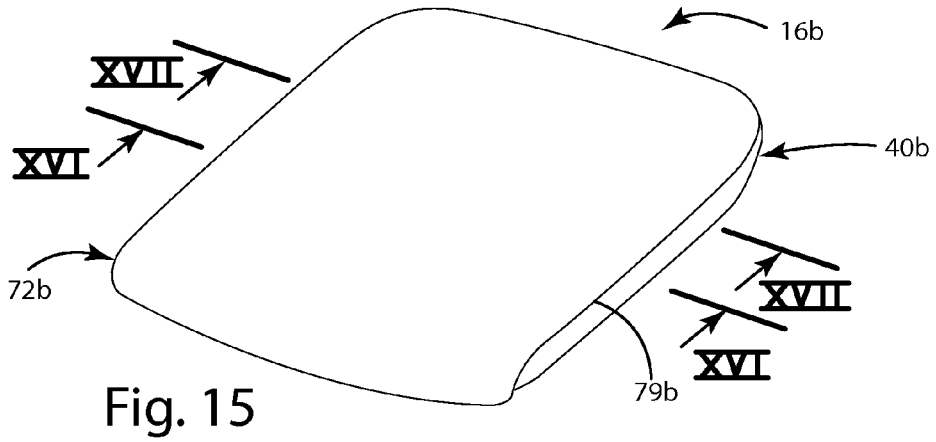
FIG. 15 is a top perspective view of a second alternative embodiment of the seat assembly.
Figure 16:
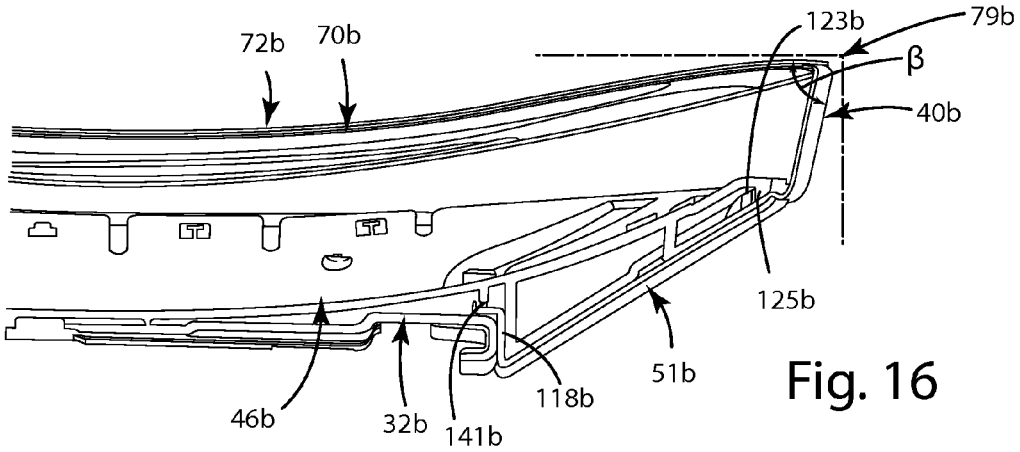
FIG. 16 is a cross-sectional view of the second alternative embodiment of the seat assembly taken along the line XVI-XVI, FIG. 15.
Figure 17:
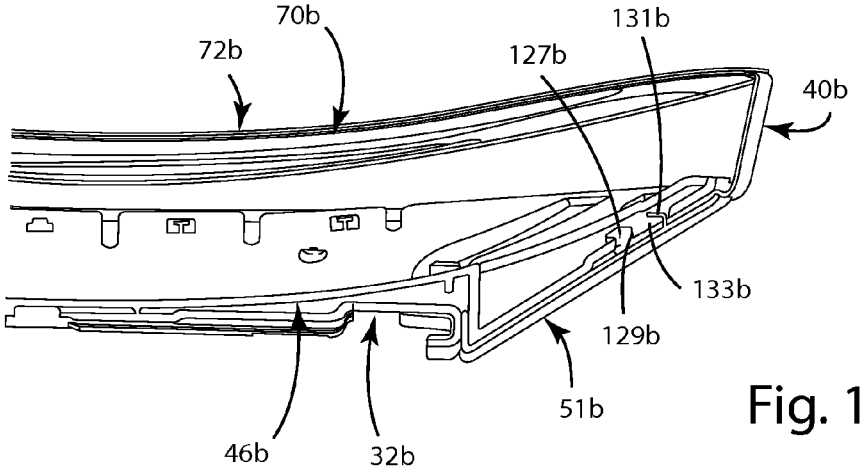
FIG. 17 is a cross-sectional view of the second alternative embodiment of the seat assembly taken along the line XVII-XVII, FIG. 15.
Figure 19:
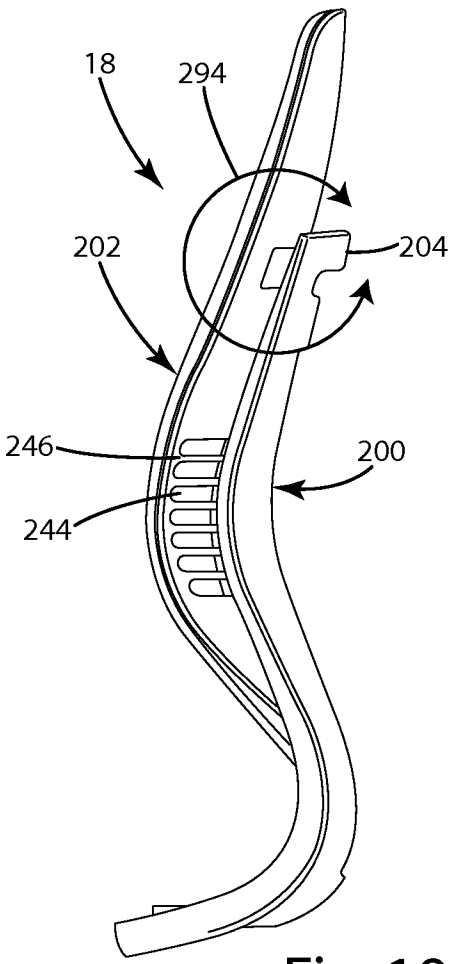
FIG. 19 is a side elevational view of the back assembly.

In assembly, the seat shell 40*b* (FIG. 14) and seat cover 72*b* of the upholstery cover 100*b* are coupled to one another as described above. As best illustrated in FIGS. 15 and 16, the side portions 42*b* of the seat shell 40*b* are coupled to the fabric seat cover 72*b* so as to define a corner 79*b* therebetween. It is noted that use of both the fabric material of the fabric seat cover 72*b* and the TPE of the seat shell 40*b* provides a sharp and crisp aesthetic corner angle β of 90° or less while simultaneously providing a soft, resilient deformable feel for the user. The seat pan 46*b*, the cushion member 70*b* and the spring support assembly 78*b* are then arranged with respect to one another and positioned within the interior space 102*b* of the cover 100*b*. The shell 40*b* is then secured to the seat pan 46*b* for displacement in a lateral direction by a plurality of integral hook-shaped couplers 123*b* spaced about the periphery of the shell 40*b* and which engage a downwardly-extending trim portion 125*b* extending about the side and rear periphery of the seat pan 46*b*. The shell 40*b* (FIG. 17) further includes a plurality of Z-shaped couplers 127*b* integral with the shell 40*b* and received within corresponding apertures 129*b* of the seat pan 46*b*, thereby temporarily securing the shell 40*b* to the seat pan 46*b* with respect to vertical displacement.

Further in assembly, the overlay 51*b* (FIG. 17) includes a plurality of integrally formed, L-shaped hooks 131*b* spaced along the sidewalls 55*b* and that slidably engage a corresponding plurality of angled couplers 133*b* integrally formed with the seat pan 46*b*. Specifically, the hooks 131*b* engage the couplers 133*b* as the overlay 51*b* is slid forwardly with respect to the seat pan 46*b*. The overlay 51*b* is then secured in place by a pair of screws 135*b* that extend through corresponding apertures 137*b* of the overlay 51*b* and are threadably received within corresponding bosses 139*b* of the seat pan 46*b*, thereby trapping the couplers 127*b* within the apertures 129*b*. The support plate 32*b* is then secured to an underside of the seat pan 46*b* by a plurality of screws 132*b*, thereby sandwiching a plurality of spaced coupling tabs 141*b* integral with the overlay 51*b* between the support plate 32*b* and the seat pan 46*b*, and permanently securing the cover assembly 100*b* to the seat pan 46*b*. It is noted that the terms "temporarily securing" and "permanently securing" are previously defined herein.

Figure 11A:
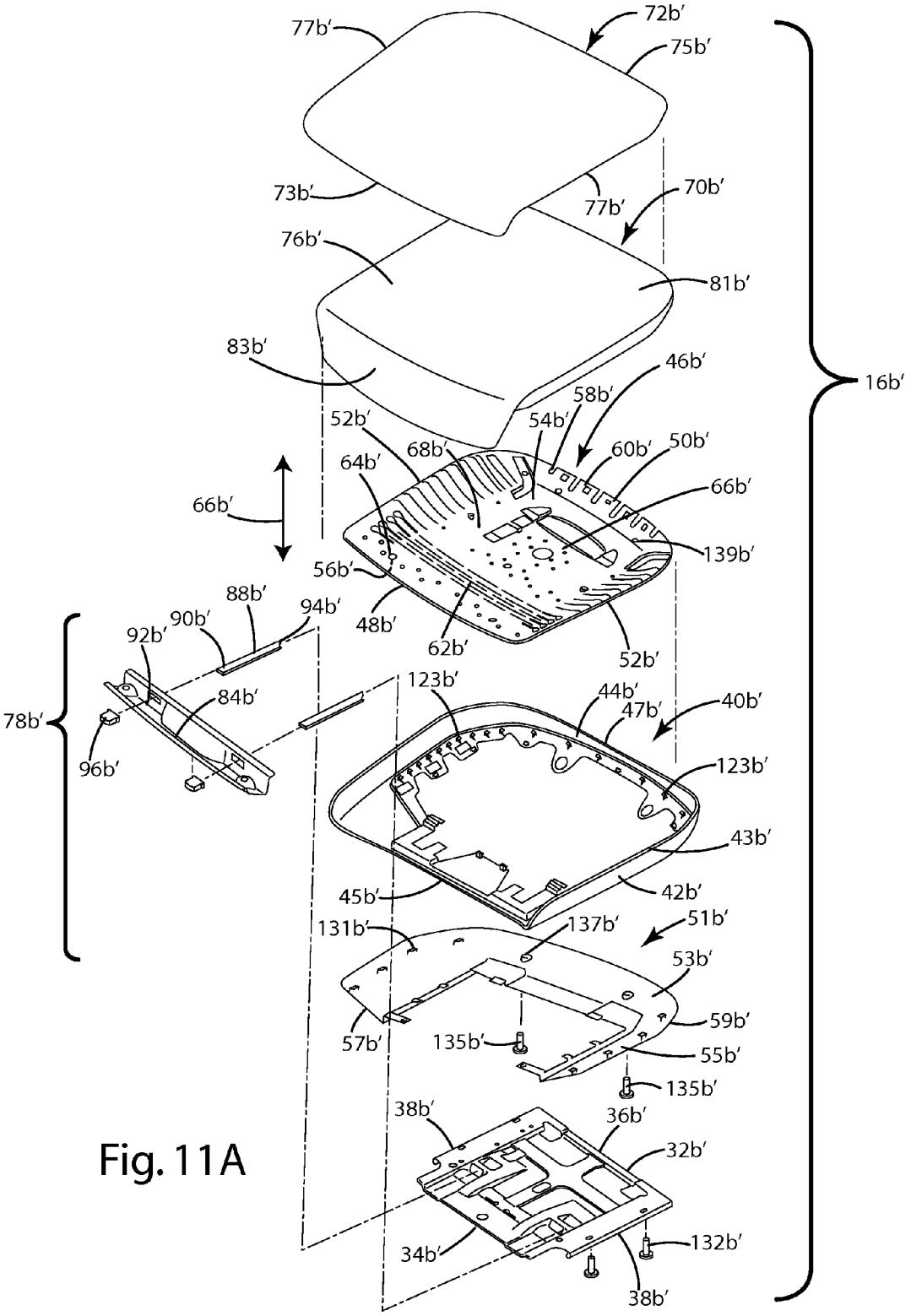
FIG. 11A is an exploded perspective view of another alternative embodiment of the seat assembly.

The reference numeral 16*b*' (FIG. 11A) generally designates another embodiment of the seat assembly. Since the seat assembly 16*b*' is similar to the previously described seat assembly 16*b*, similar parts appearing in FIG. 11 and FIG. 11A respectively are represented by the same, corresponding reference numeral, except for the suffix "'" in the numerals of the latter. In the illustrated example, the seat assembly 16*b*' is similar in configuration and construction to the seat assembly 16*b*, with the most notable exception being an alternatively configured foam cushion member 70*b*'. The cushion member 70*b*' includes a first portion 81*b*' and a second portion 83*b*'. In assembly, the first portion 81*b*' of the cushion member 70*b*' is positioned over the seat pan 46*b*'. The attachment member 84*b*' is secured to an underside of the seat pan 46*b*' by mechanical fasteners such as screws (not shown). The second portion 83*b*' of the cushion member 70*b*' is then wrapped about the front edge 48*b*' of the seat pan 46*b*' and the attachment member 84*b*', and secured to the attachment member 84*b*' by an adhesive. The combination of the seat pan 46*b*', the cushion member 70*b*' and the attachment member 84*b*' is assembled with the seat support plate 32*b*', to which the spring members 88*b*' are previously attached, and the linear bearing 96*b*' are attached thereto.

The back assembly 18 (FIGS. 18-20B) includes a back frame assembly 200 and a back support assembly 202 supported thereby. The back frame assembly 200 is generally comprised of a substantially rigid material such as metal, and includes a laterally extending top frame portion 204, a laterally extending bottom frame portion 206, and a pair of curved side frame portions 208 extending between the top frame portion 204 and the bottom frame portion 206 and cooperating therewith to define an opening 210 having a relatively large upper dimension 212 and a relatively narrow lower dimension 214.

Figures 29A, 29B:
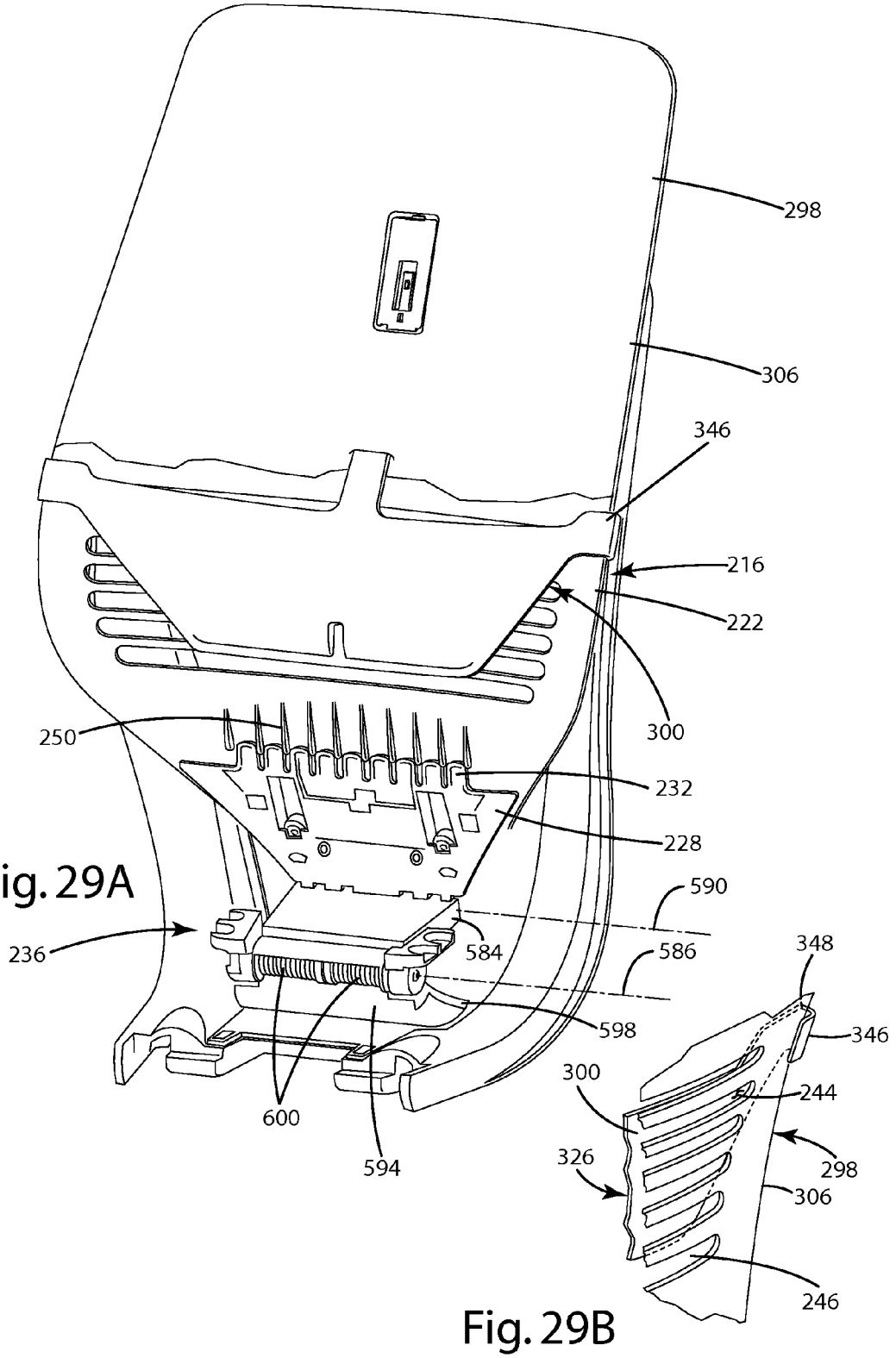
FIG. 29A is a perspective view of the back assembly, wherein a portion of the comfort member is cut away.
FIG. 29B is an enlarged perspective view of a portion of the back assembly.

The back assembly 18 further includes a flexibly resilient, plastic back shell 216 having an upper portion 218, a lower portion 220, a pair of side edges 222 extending between the upper portion 218 and a lower portion 220, a forwardly facing surface 224 and a rearwardly facing surface 226, wherein the width of the upper portion 218 is generally greater than the width of the lower portion 220, and the lower portion 220 is downwardly tapered to generally follow the rear elevational configuration of the frame assembly 200. A lower reinforcement member 228 (FIG. 29A) attaches to hooks 230 of lower portion 220 of back shell 216. The reinforcement member 228 includes a plurality of protrusions 232 that engage a plurality of reinforcement ribs 250 of the back shell 216 to prevent side-to-side movement of lower reinforcement member 228 relative to back shell 216, while the reinforcement member 228 pivotably interconnects back control link 236 to lower portion 220 of back shell 216 at pivot point or axis 590, each as described below.

Figure 21:
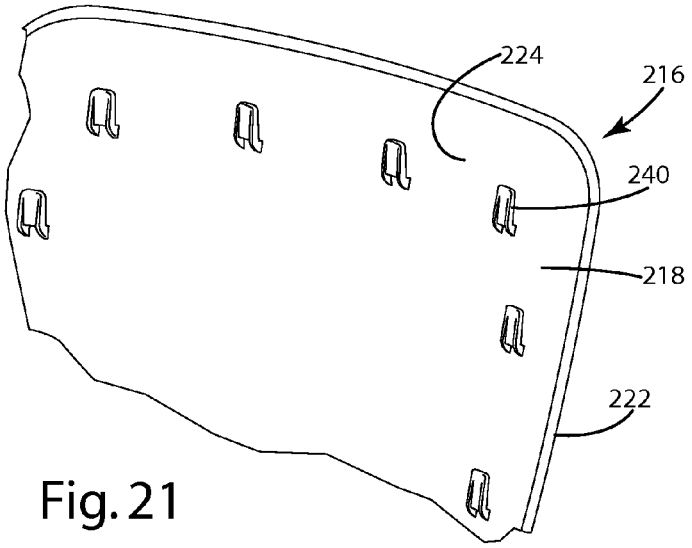
FIG. 21 is an enlarged perspective view of an area XXI, FIG. 20A.
Figure 22:
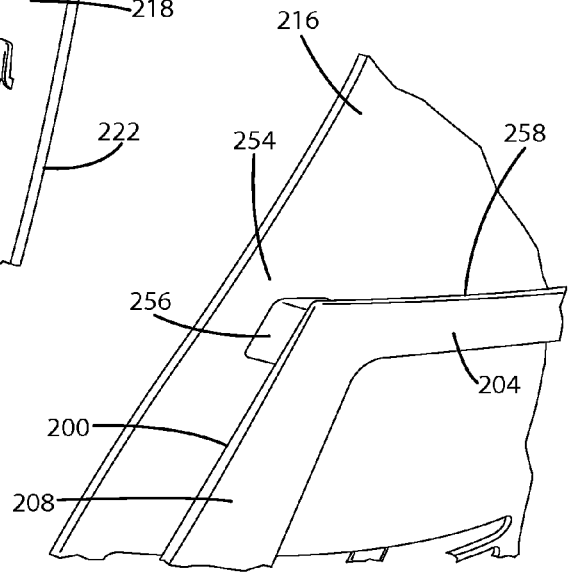
FIG. 22 is an enlarged perspective view of an area XXII, FIG. 2.
Figure 23:
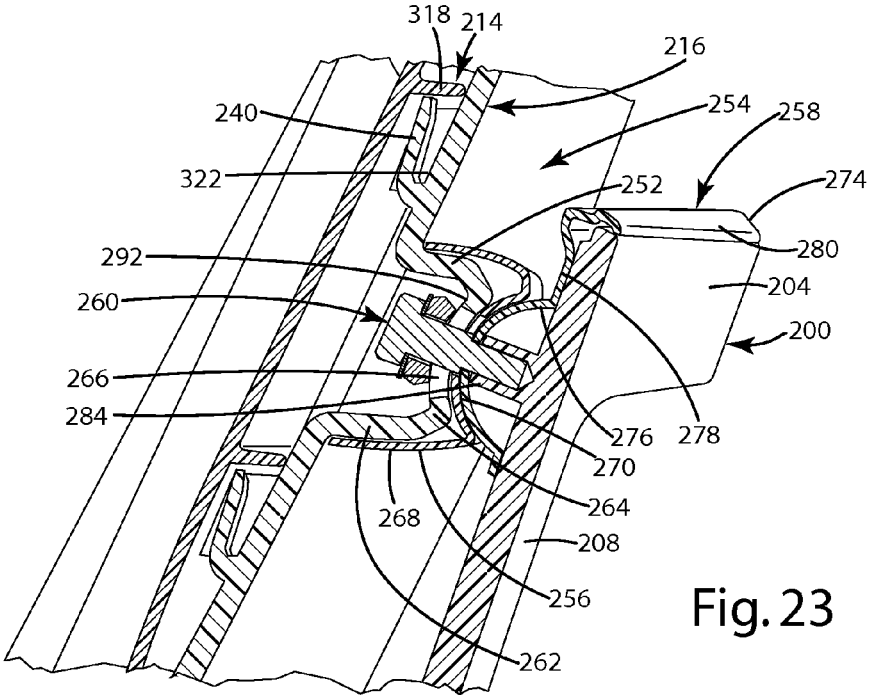
FIG. 23 is a cross-sectional view of an upper back pivot assembly taken along the line XXIII-XXIII, FIG. 18.
Figure 24A:
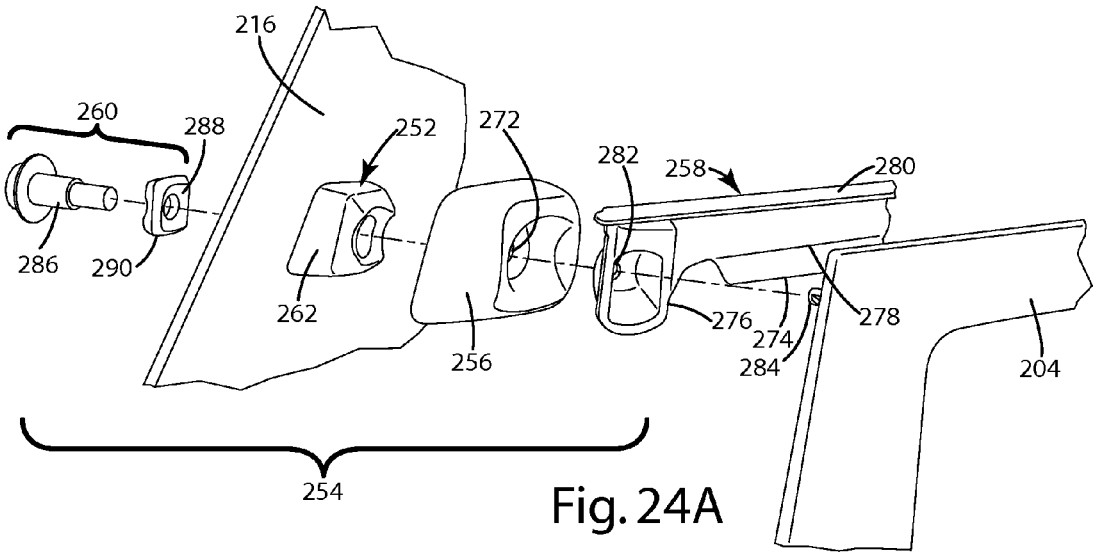
FIG. 24A is an exploded rear perspective view of the upper back pivot assembly.
Figure 24B:
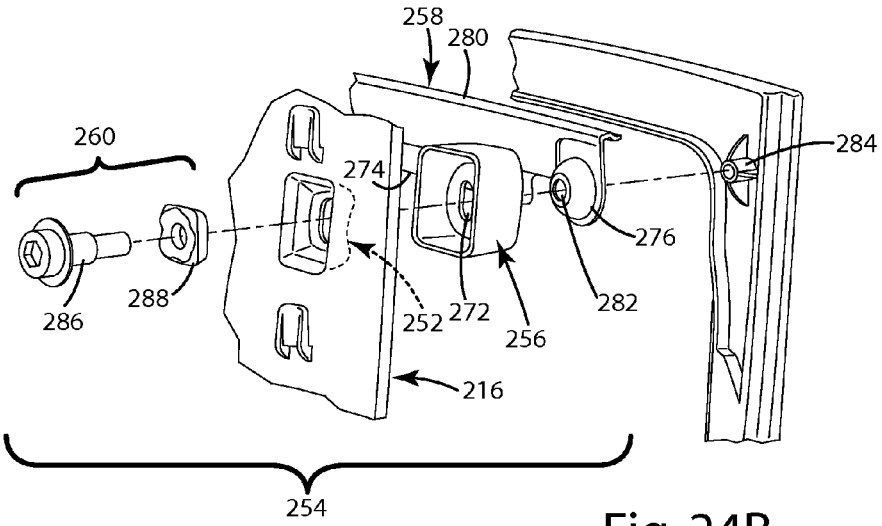
FIG. 24B is an exploded front perspective view of the upper back pivot assembly.

The back shell 216 also includes a plurality of integrally molded, forwardly and upwardly extending hooks 240 (FIG. 21) spaced about the periphery of the upper portion 218 thereof. An intermediate or lumbar portion 242 is located vertically between the upper portion 218 and the lower portion 220 of the back shell 216, and includes a plurality of laterally extending slots 244 that cooperate to form a plurality of laterally extending ribs 246 located therebetween. The slots 244 cooperate to provide additional flexure to the back shell 216 in the location thereof. Pairings of lateral ribs 246 are coupled by vertically extending ribs 248 integrally formed therewith and located at an approximate lateral midpoint thereof. The vertical ribs 248 function to tie the lateral ribs 246 together and reduce vertical spreading therebetween as the back shell 216 is flexed at the intermediate portion 242 thereof when the back assembly 18 is moved from the upright position E to the reclined position F, as described below. The plurality of laterally-spaced reinforcement ribs 250 extend longitudinally along the vertical length of the back shell 216 between the lower portion 220 and the intermediate portion 242. It is noted that the depth of each of the ribs 250 increases along each of the ribs 250 from the intermediate portion 242 toward the lower portion 220, such that the overall rigidity of the back shell 216 increases along the length of the ribs 250.

The back shell 216 (FIGS. 20A and 20B) further includes a pair of rearwardly extending, integrally molded pivot bosses 252 forming part of an upper back pivot assembly 254. The back pivot assembly 254 (FIGS. 22-24B) includes the pivot bosses 252 of the back shell 216, a pair of shroud members 256 that encompass respective pivot bosses 252, a race member 258, and a mechanical fastening assembly 260. Each pivot boss 252 includes a pair of side walls 262 and a rearwardly-facing concave seating surface 264 having a vertically elongated pivot slot 266 extending therethrough. Each shroud member 256 is shaped so as to closely house the corresponding pivot boss 252, and includes a plurality of side walls 268 corresponding to side walls 262, and a rearwardly-facing concave bearing surface 270 that includes a vertically elongated pivot slot 272 extending therethrough, and which is adapted to align with the slot 266 of a corresponding pivot boss 252. The race member 258 includes a center portion 274 extending laterally along and abutting the top frame portion 204 of the back frame assembly 200, and a pair of arcuately-shaped bearing surfaces 276 located at the ends thereof. Specifically, the center portion 274 includes a first portion 278 and a second portion 280, wherein the first portion 278 abuts a front surface of the top frame portion 204 and the second portion 280 abuts a top surface of the top frame portion 204. Each bearing surface 276 includes an aperture 282 extending therethrough and which aligns with a corresponding boss member 284 integral with the back frame assembly 200.

Figure 18:
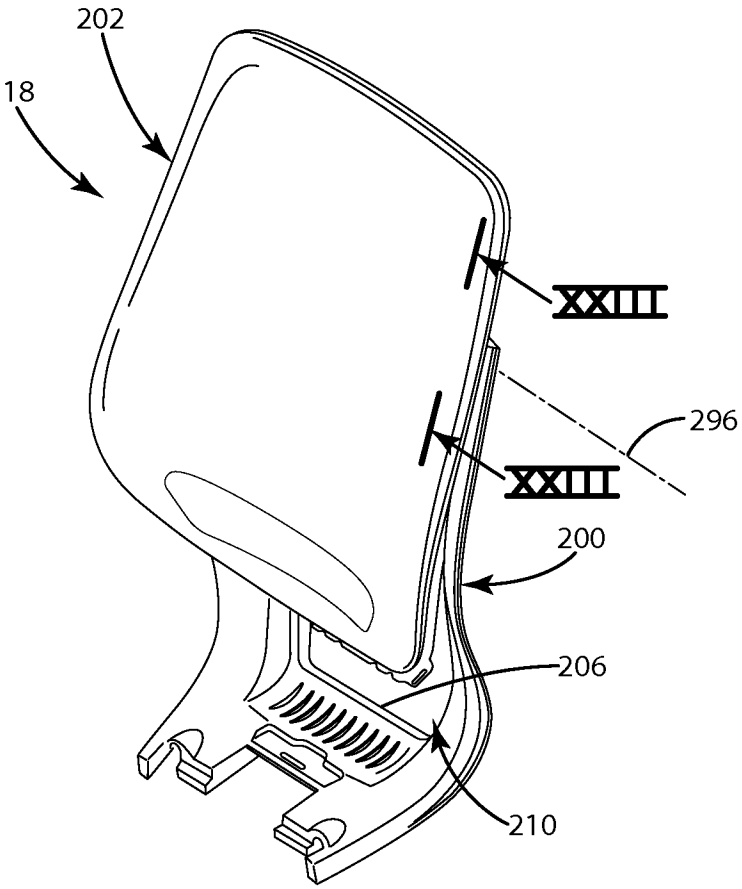
FIG. 18 is a front perspective view of a back assembly.

In assembly, the shroud members 256 are positioned about the corresponding pivot bosses 252 of the back shell 216 and operably positioned between the back shell 216 and the race member 258 such that the bearing surface 270 is sandwiched between the seating surface 264 of a corresponding pivot boss 252 and a bearing surface 276. The mechanical fastening assemblies 260 each include a bolt 286 that secures a rounded abutment surface 288 of a bearing washer 290 in sliding engagement with an inner surface 292 of the corresponding pivot boss 252, and threadably engages the corresponding boss member 284 of the back shell 216. In operation, the upper back pivot assembly 254 allows the back support assembly 202 to pivot with respect to the back frame assembly in a direction 294 (FIG. 19) about a pivot axis 296 (FIG. 18).

Figure 20A:
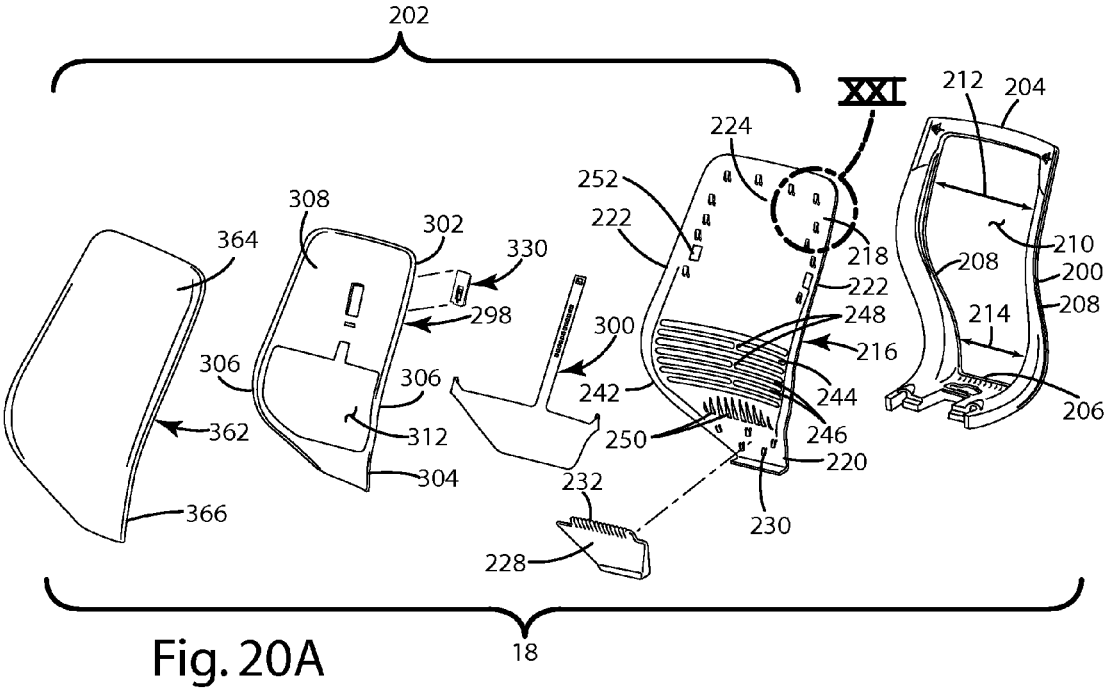
FIG. 20A is an exploded front perspective view of the back assembly.
Figure 20B:
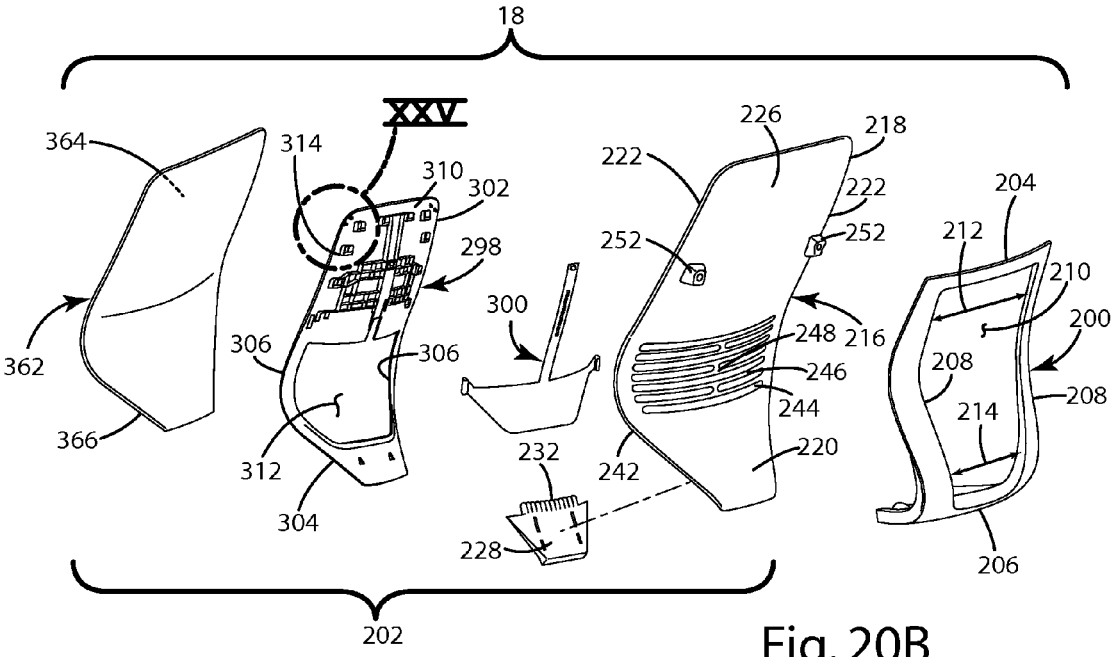
FIG. 20B is an exploded rear perspective view of the back assembly.
Figure 25:
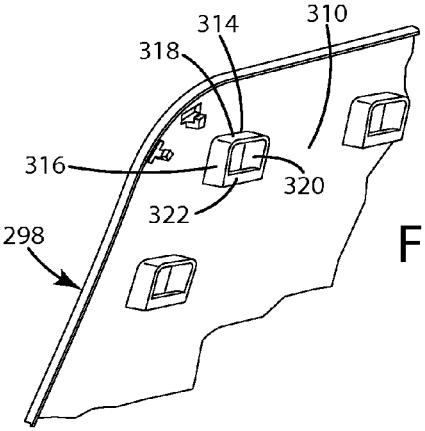
FIG. 25 is an enlarged perspective view of the area XXV, FIG. 20B.
Figure 26A:
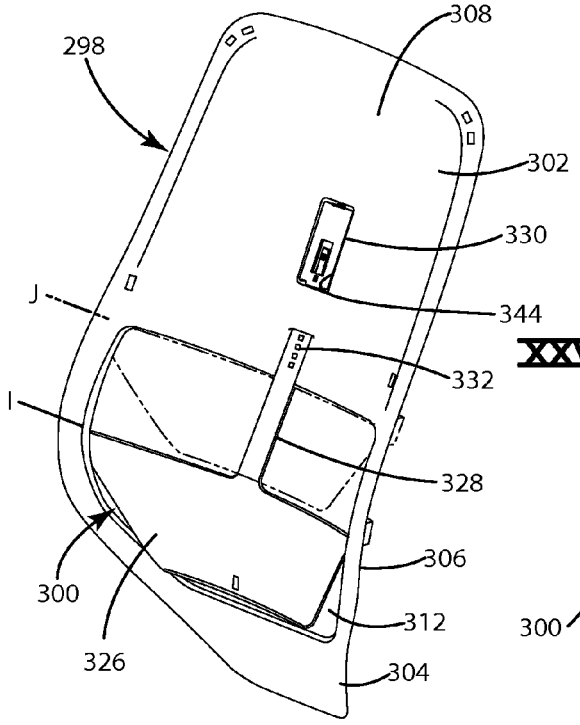
FIG. 26A is an enlarged perspective view of a comfort member and a lumbar assembly.
Figure 26B:
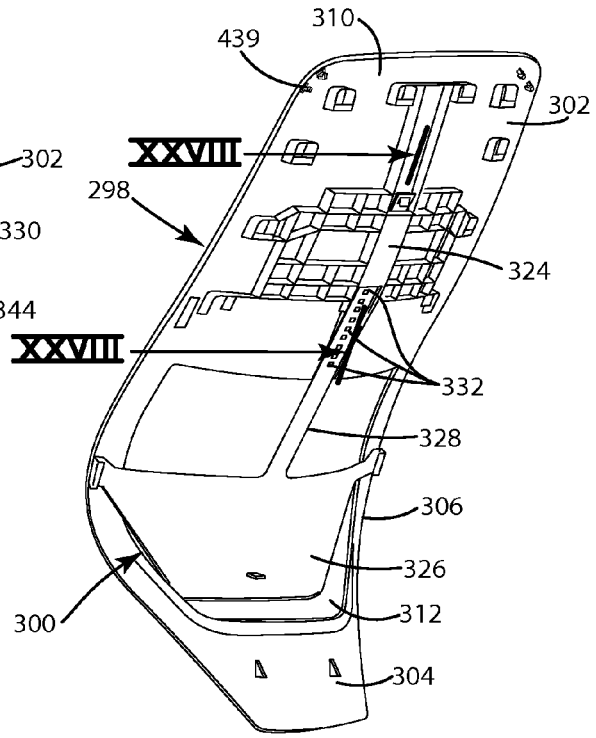
FIG. 26B is a rear perspective view of the comfort member and the lumbar assembly.

The back support assembly 202 (FIGS. 20A and 20B) further includes a flexibly resilient comfort member 298 (FIGS. 26A and 26B) attached to the back shell 216 and slidably supporting a lumbar assembly 300. The comfort member 298 includes an upper portion 302, a lower portion 304, a pair of side portions 306, a forward surface 308, and a rearward surface 310, wherein the upper portion 302, the lower portion 304 and the side portions 306 cooperate to form an aperture 312 that receives the lumbar assembly 300 therein. As best illustrated in FIGS. 20B and 25, the comfort member 298 includes a plurality of box-shaped couplers 314 spaced about the periphery of the upper portion 302 and extending rearwardly from the rearward surface 310. Each box-shaped coupler 314 includes a pair of side walls 316 and a top wall 318 that cooperate to form an interior space 320. A bar 322 extends between the side walls 316 and is spaced from the rearward surface 310. In assembly, the comfort member 298 is secured to the back shell 216 by aligning and vertically inserting the hooks 240 (FIG. 23) of the back shell 216 into the interior space 320 of each of the box-shaped couplers 314 until the hooks 240 engage a corresponding bar 322. It is noted that the forward surface 224 of the back shell 216 and the rearward surface 310 of the comfort member 298 are free from holes or apertures proximate the hooks 240 and box-shaped couplers 314, thereby providing a smooth forward surface 308 and increasing the comfort to a seated user.

Figure 27A:
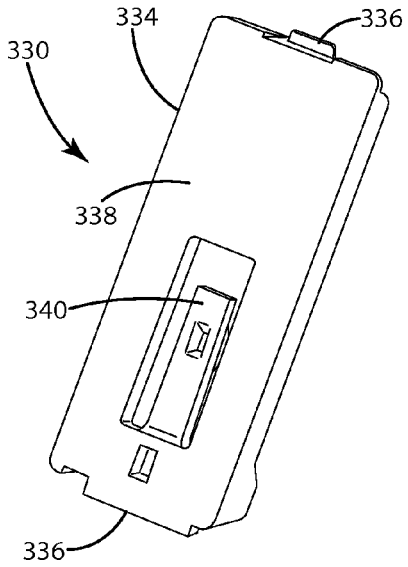
FIG. 27A is a front perspective view of a pawl member.
Figure 27B:
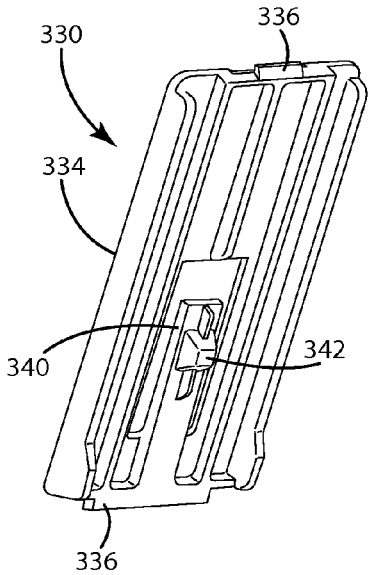
FIG. 27B is a rear perspective view of the pawl member.

The comfort member 298 (FIGS. 26A and 26B) includes an integrally molded, longitudinally extending sleeve 324 extending rearwardly from the rearward surface 310 and having a rectangularly-shaped cross-sectional configuration. The lumbar assembly 300 includes a forwardly laterally concave and forwardly vertically convex, flexibly resilient body portion 326, and an integral support portion 328 extending upwardly from the body portion 326. In the illustrated example, the body portion 326 is shaped such that the body portion vertically tapers along the height thereof so as to generally follow the contours and shape of the aperture 312 of the comfort member 298. The support portion 328 is slidably received within the sleeve 324 of the comfort member 298 such that the lumbar assembly 300 is vertically adjustable with respect to the remainder of the back support assembly 202 between a fully lowered position I and a fully raised position J. A pawl member 330 selectively engages a plurality of apertures 332 spaced along the length of support portion 328, thereby releasably securing the lumbar assembly 300 at selected vertical positions between the fully lowered position I and the fully raised position J. The pawl member 330 (FIGS. 27A and 27B) includes a housing portion 334 having engagement tabs 336 located at the ends thereof and rearwardly offset from an outer surface 338 of the housing portion 334. A flexibly resilient finger 340 is centrally disposed within the housing portion 334 and includes a rearwardly-extending pawl 342.

Figure 28:
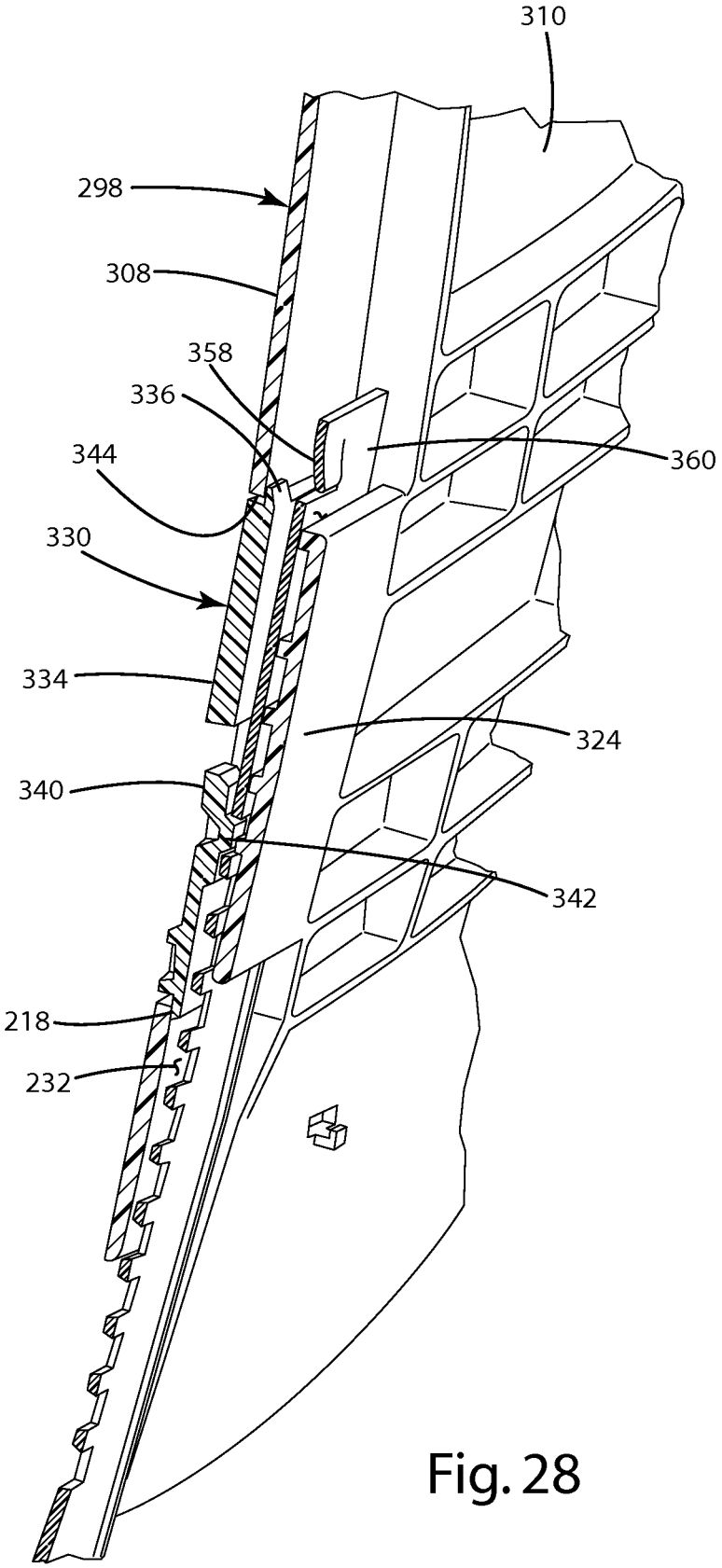
FIG. 28 is a partial cross-sectional perspective view along the line XXVIII-XXVIII, FIG. 26B.
Figure 30:
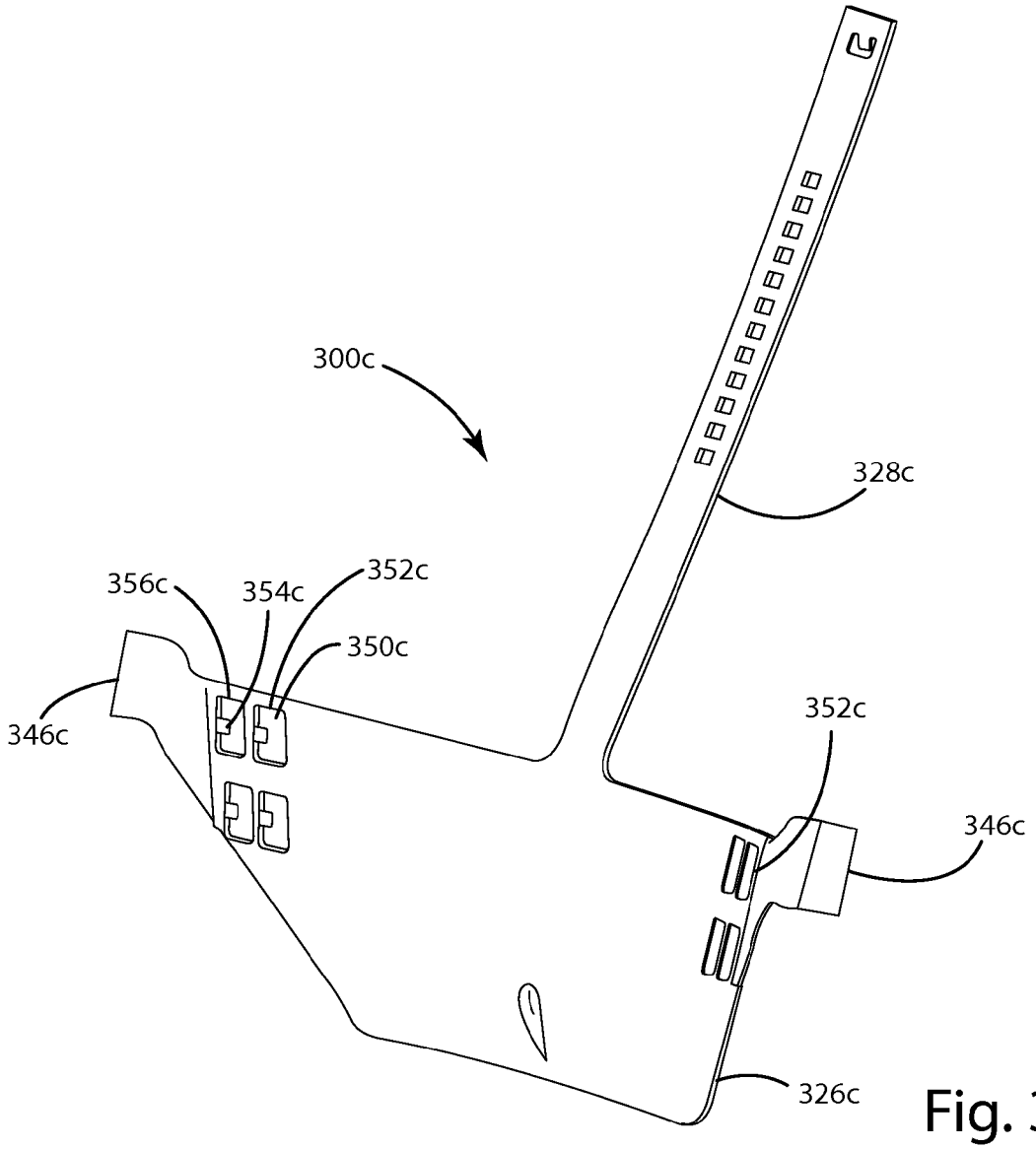
FIG. 30 is a perspective view of an alternative embodiment of the lumbar assembly.

In assembly, the pawl member 330 (FIG. 28) is positioned within an aperture 344 located within the upper portion 302 of the comfort member 298 such that the outer surface 338 of the housing portion 334 of the pawl member 330 is coplanar with the forward surface 308 of the comfort member 298, and such that the engagement tabs 336 of the housing portion 334 abut the rearward surface 310 of the comfort member 298. The support portion 328 of the lumbar assembly 300 is then positioned within the sleeve 324 of the comfort member 298 such that the sleeve 324 is slidable therein and the pawl 342 is selectively engageable with the apertures 332, thereby allowing the user to optimize the position of the lumbar assembly 300 with respect to the overall back support assembly 202. Specifically, the body portion 326 of the lumbar assembly 300 includes a pair of outwardly extending integral handle portions 346 (FIGS. 29A and 29B) each having a C-shaped cross-sectional configuration defining a channel 348 therein that wraps about and guides along the respective side edge 222 of the back shell 216. Alternatively, the lumbar assembly 300*c* (FIG. 30) is provided wherein the body portion 326*c* and the support portion 328*c* are integrally formed, and the handles 346*c* are formed separately from the body portion 326*c* and are attached thereto. In the alternative embodiment, each handle 346*c* includes a pair of blades 350*c* received within corresponding pockets 352*c* of the body portion 326*c*. Each blade 350*c* includes a pair of snap tabs 354*c* spaced along the length thereof and which snappingly engage an edge of one of a plurality of apertures 356*c* within the body portion 326*c*.

In operation, a user adjusts the relative vertical position of the lumbar assembly 300, 300*c* with respect to the back shell 216 by grasping one or both of the handle portions 346, 346*c* and sliding the handle assembly 346, 346*c* along the comfort member 298 and the back shell 298 in a vertical direction. A stop tab 358 is integrally formed within a distal end 360 and is offset therefrom so as to engage an end wall of the sleeve 324 of the comfort member 298, thereby limiting the vertical downward travel of the support portion 328 of the lumbar assembly 300 with respect to the sleeve 324 of the comfort member 298.

The back assembly 202 (FIGS. 20A and 20B) further includes a cushion member 362 having an upper portion 364 and a lower portion 366, wherein the lower portion 366 tapers along the vertical length thereof to correspond to the overall shape and taper of the back shell 216 and the comfort member 298.

Figure 31:
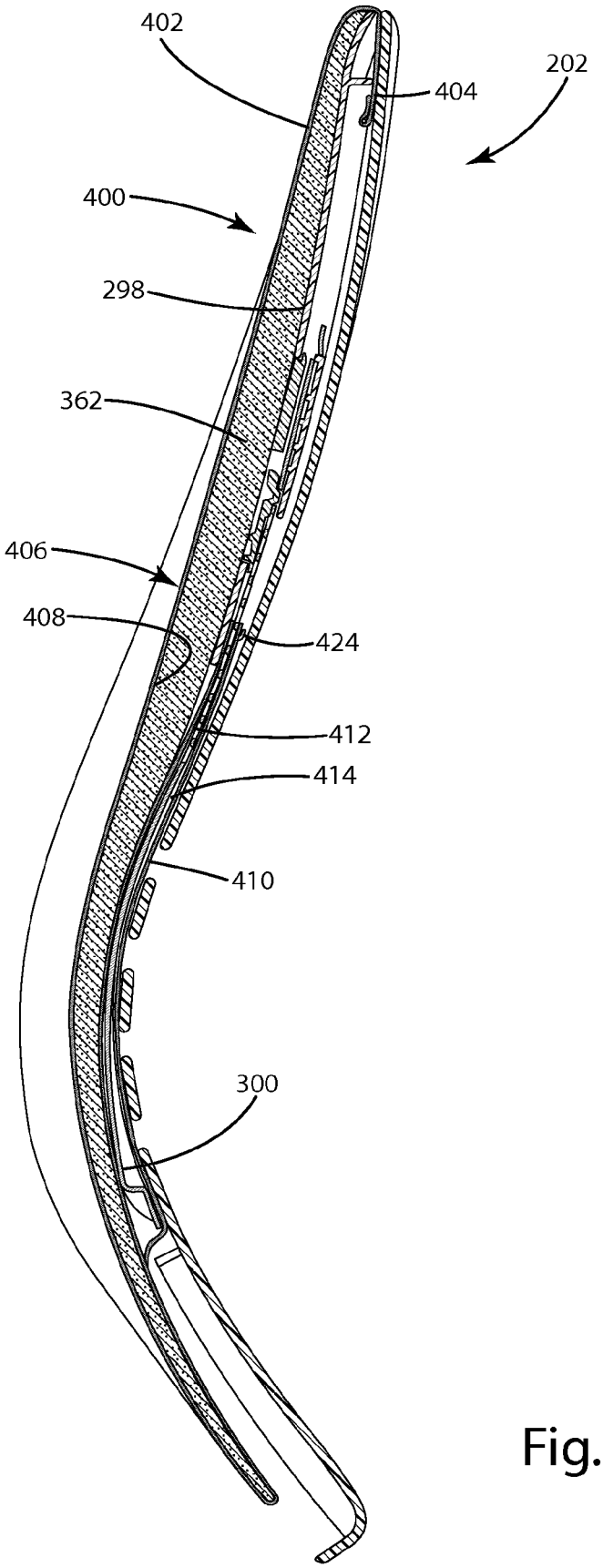
FIG. 31 is a cross-sectional view of the back assembly and an upholstery assembly.
Figure 32A:
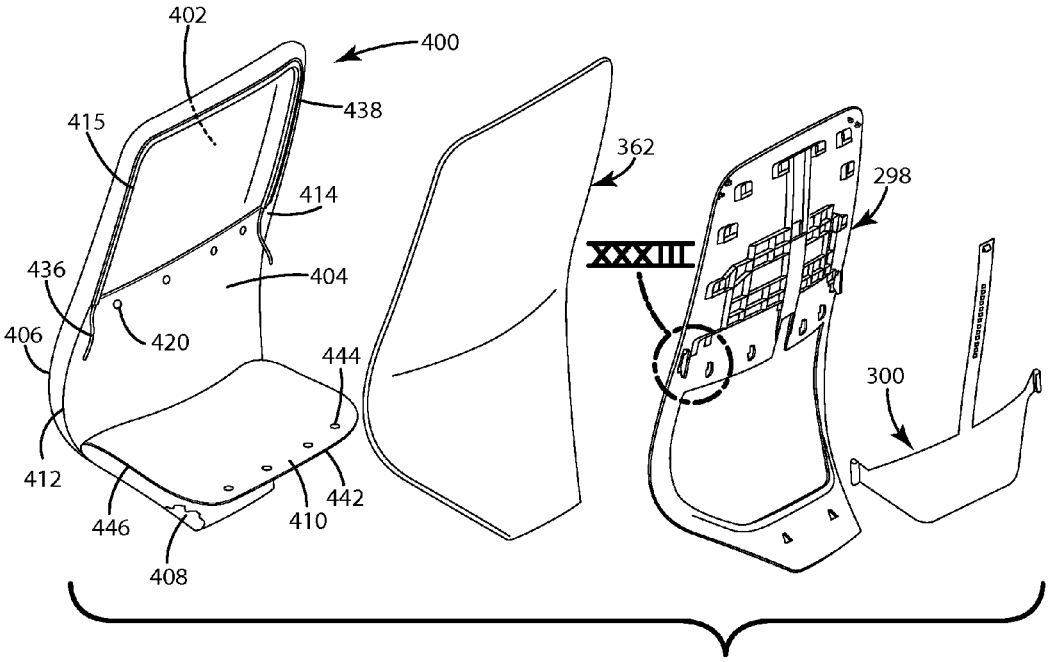
FIG. 32A-32D are stepped assembly views of the back assembly and the upholstery assembly.

The back support assembly 202 further includes an upholstery cover assembly 400 (FIG. 31) that houses the comfort member 298, the lumbar support assembly 300 and the cushion member 362 therein. In the illustrated example, the cover assembly 400 comprises a fabric material and includes a front side 402 (FIG. 32A) and a rear side 404 that are sewn together along the respective side edges thereof to form a first pocket 406 having a first interior or inner space 408 that receives the comfort member 298 and the cushion member 362 therein, and a flap portion 410 that is sewn to the rear side 404 and cooperates therewith to form a second pocket 412 having a second interior or inner space 413 (FIG. 32D) that receives the lumbar support assembly 300 therein.

Figure 32B:
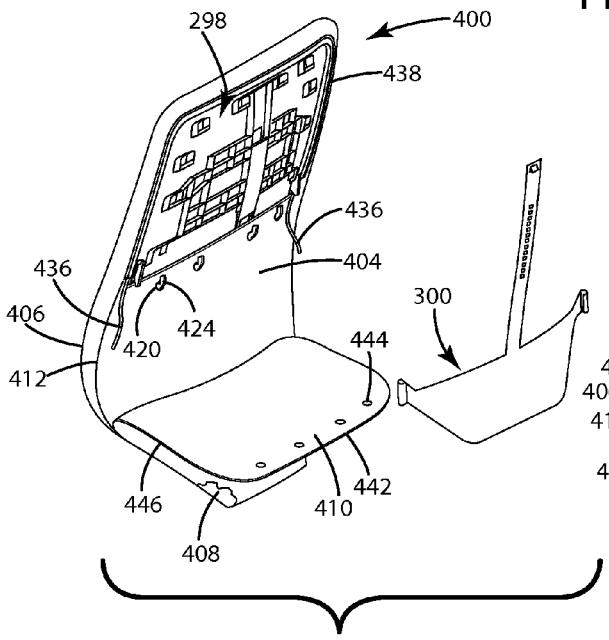
Figure 33:
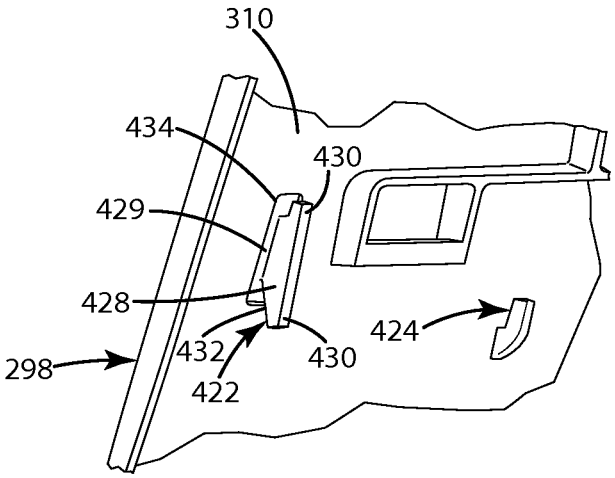
FIG. 33 is an enlarged perspective view of the area XXXIII, FIG. 32A.
Figure 34A:
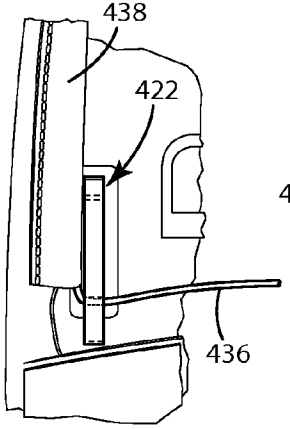
FIGS. 34A-34H are a series of back elevational views of a boat cleat and the sequential steps of a drawstring secured thereto.
Figure 34B:
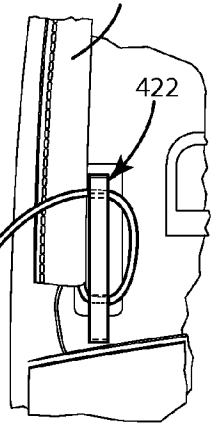
Figure 34C:
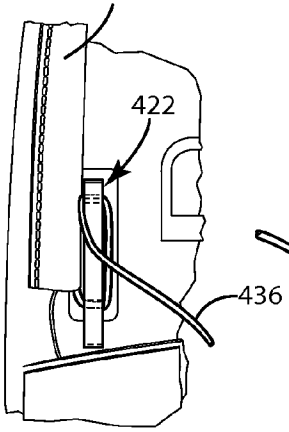
Figure 34D:
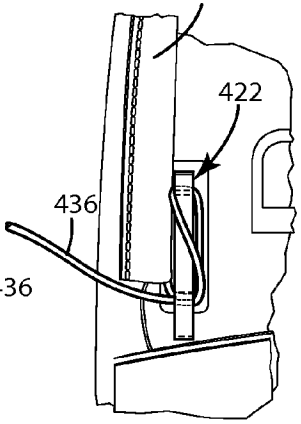
Figure 34E:
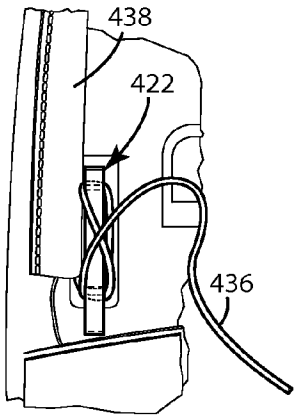
Figure 34F:
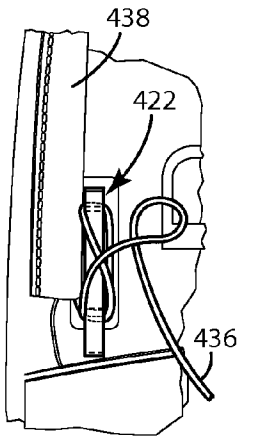
Figure 34G:
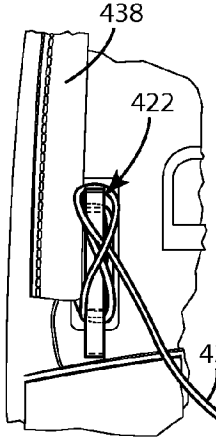
Figure 34H:
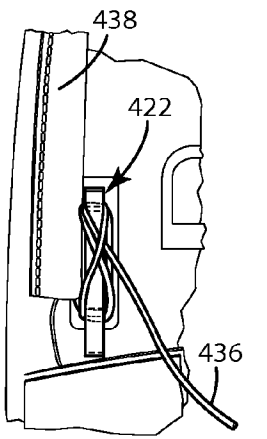

In assembly, the first pocket 406 (FIG. 32A) is formed by attaching the respective side edges of the front side 402 and the rear side 404 to one another such as by sewing or other means suitable for the material for which the cover assembly 400 is comprised, and to define the first interior space 408. An edge of the flap portion 410 is then secured to a lower end of the rear side 404. In the illustrated example, the combination of the back shell 216 and the cushion member 362 are then inserted into the interior space 408 of the first pocket 406 via an aperture 415 of the rear side 404 (FIG. 32B). The upholstery cover assembly 400 is stretched about the cushion member 362 and the comfort member 298, and is secured to the comfort member 298 by a plurality of apertures 420 that receive upwardly extending hook members 424 (FIG. 33) therethrough. Alternatively, the cover assembly 400 may be configured such that apertures 420 are positioned to also receive T-shaped attachment members 422 therethrough. In the illustrated example, the attachment members 422 and the hook members 424 are integrally formed with the comfort member 298. Each attachment member 422 is provided with a T-shaped cross-section or boat-cleat configuration having a first portion 428 extending perpendicularly rearward from within a recess 429 of the rear surface 310 of the comfort member 298, and a pair of second portions 430 located at a distal end of the first portion 428 and extending outwardly therefrom in opposite relation to one another. One of the second portions 430 cooperates with the first portion 428 to form an angled engagement surface 432. The recess 429 defines an edge 434 about the perimeter thereof.

Figure 35G:
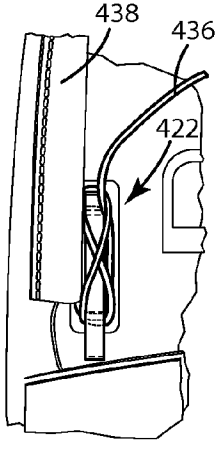
FIGS. 35G and 35H are alternative sequential steps for securing the drawstring to the boat cleat.
Figure 35H:
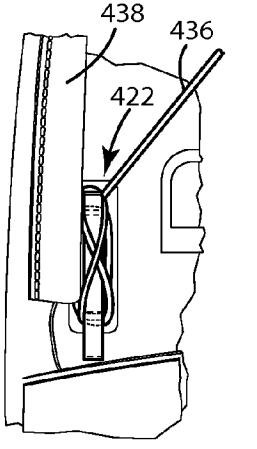
Figure 36:
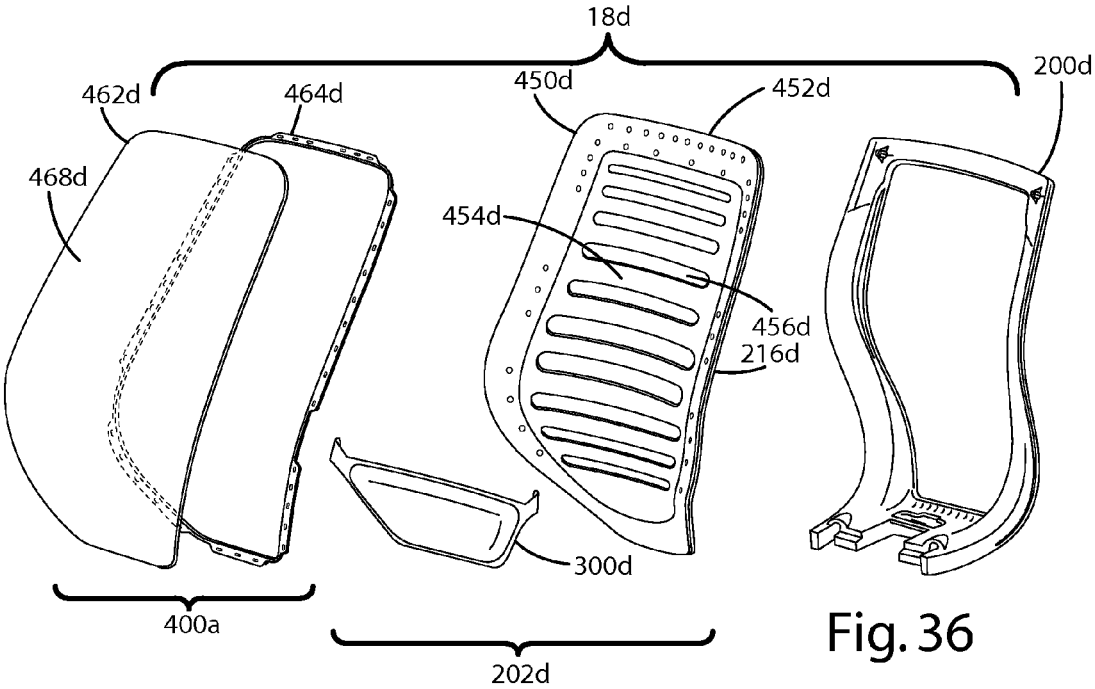
FIG. 36 is an exploded view of an alternative embodiment of the back assembly.
Figure 37:
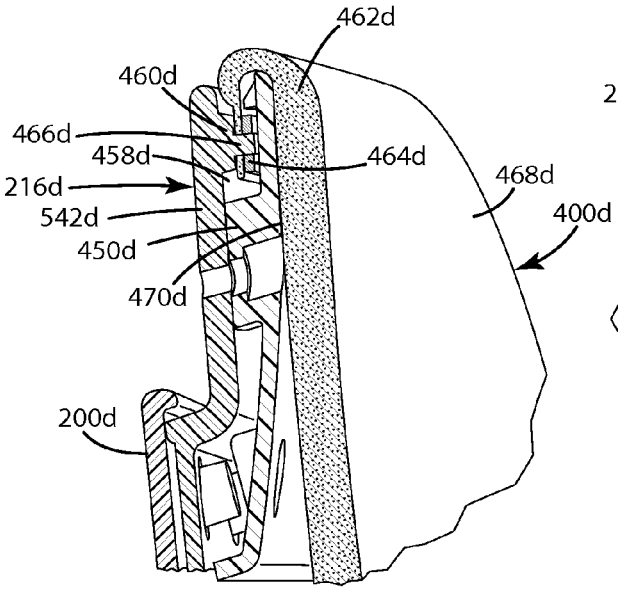
FIG. 37 is a cross-sectional side view of a top portion of the alternative embodiment of the back assembly.
Figure 38:
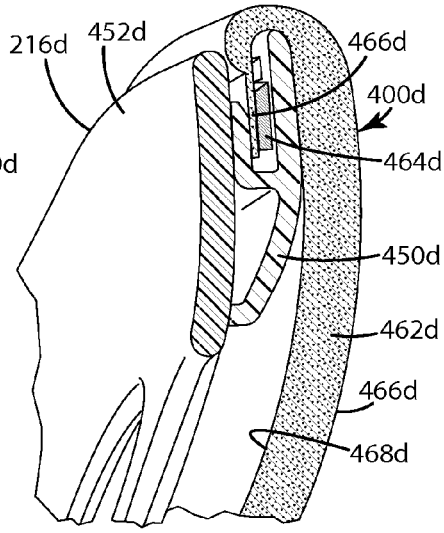
FIG. 38 is a cross-sectional side view of a side portion of the alternative embodiment of the back assembly.

The cover assembly 400 is further secured to the comfort member 298 by a drawstring 436 that extends through a drawstring tunnel 438 of the cover assembly 400, and is secured to the attachment members 422. Specifically, and as best illustrated in FIGS. 34A-34H, each free end of the drawstring 436 is secured to an associated attachment member 422 in a knot-free manner and without the use of a mechanical fastener that is separate from the comfort member 298. In assembly, the drawstring 436 and drawstring tunnel 438 guide about a plurality of guide hooks 439 (FIG. 26B) located about a periphery of and integrally formed with the comfort member 298. The drawstring 436 is wrapped about the associated attachment member 422 such that the tension in the drawstring 436 about the attachment member 422 forces the drawstring 436 against the engagement surface 432 that angles towards the recess 429, thereby forcing a portion of the drawstring 436 into the recess 429 and into engagement with at least a portion of the edge 434 of the recess 429 resulting in an increased frictional engagement between the drawstring 436 and the comfort member 298. FIGS. 35G and 35H illustrate alternative paths that the drawstring 436 may take about the attachment member 422 relative to the steps illustrated in FIGS. 34G and 34H, respectively.

Figure 32C:
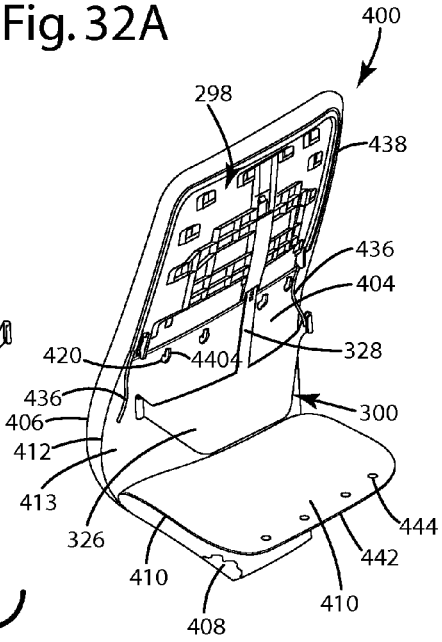
Figure 32D:
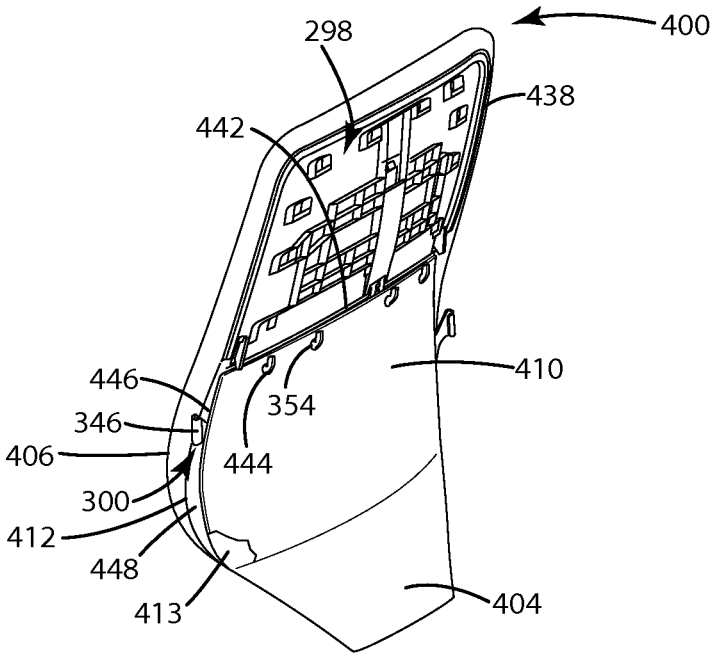

The lumbar assembly 300 (FIG. 32C) is then aligned with the assembly of the cover assembly 400, the cushion member 362 and the comfort member 298 such that the body portion 326 of the lumbar assembly 300 is located near a midsection 414 of the cover assembly 400, and the support portion 328 of the lumbar assembly 300 is coupled with the comfort member 298 as described above. The flap portion 410 (FIG. 32D) is then folded over the lumbar assembly 300, thereby creating a second pocket 412 having an interior space 413. A distally located edge 442 of the flap portion 410 is attached to the comfort member 298 by a plurality of apertures 444 within the flap portion 410 that receive the hooks 424 therethrough. The distal edge 442 may also be sewn to the rear side 404 of the cover assembly 400. In the illustrated example, the side edges 446 of the flap portion 410 are not attached to the remainder of the cover assembly 400, such that the side edges 446 cooperate with the remainder of the cover assembly 400 to form slots 448 through which the handle portions 346 of the lumbar assembly 300 extend. The second pocket 412 is configured such that the lumbar assembly 300 is vertically adjustable therein. The assembly of the cover assembly 400, the cushion member 362, the comfort member 298 and the lumbar assembly 300 are then attached to the back shell 216.

The reference numeral 18*d* (FIG. 36) generally designates an alternative embodiment of the back assembly. Since back assembly 18*d* is similar to the previously described back assembly 18, similar parts appearing in FIGS. 20A and 20B and FIGS. 36-41 are represented respectively by the same corresponding reference numeral, except for the suffix "d" in the numerals of the latter. The back assembly 18*d* includes a back frame assembly 200*d*, a back shell 216*d*, and an upholstery cover assembly 400*d*. In the illustrated example, the back shell 216*d* includes a substantially flexible outer peripheral portion 450*d* (FIGS. 37 and 38) and a substantially less flexible rear portion 452*d* to which the peripheral portion 450*d* is attached. The rear portion 452*d* includes a plurality of laterally extending, vertically spaced slots 454*d* that cooperate to define slats 456*d* therebetween. The peripheral portion 450*d* and the rear portion 452*d* cooperate to form an outwardly facing opening 458*d* extending about a periphery of the back shell 216*d*. The rear portion 452*d* includes a plurality of ribs 460*d* spaced about the opening 458*d* and are utilized to secure the cover assembly 400*d* to the back shell 216*d* as described below.

Figure 39:
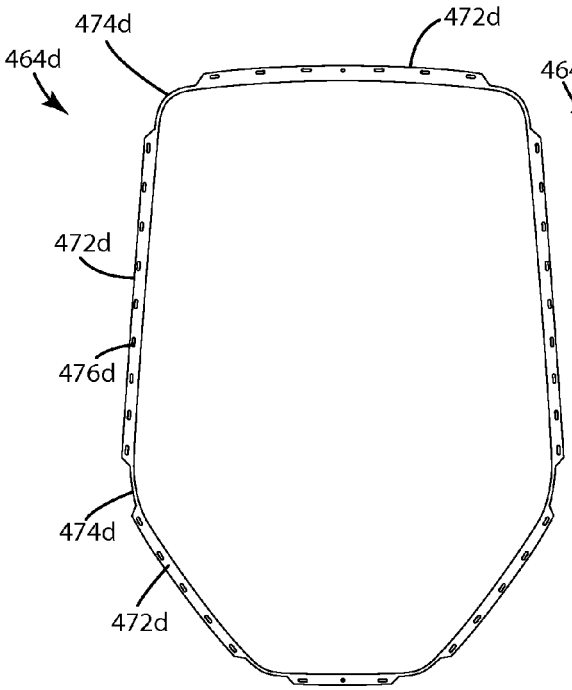
FIG. 39 is a front elevational view of a stay member.
Figure 40:
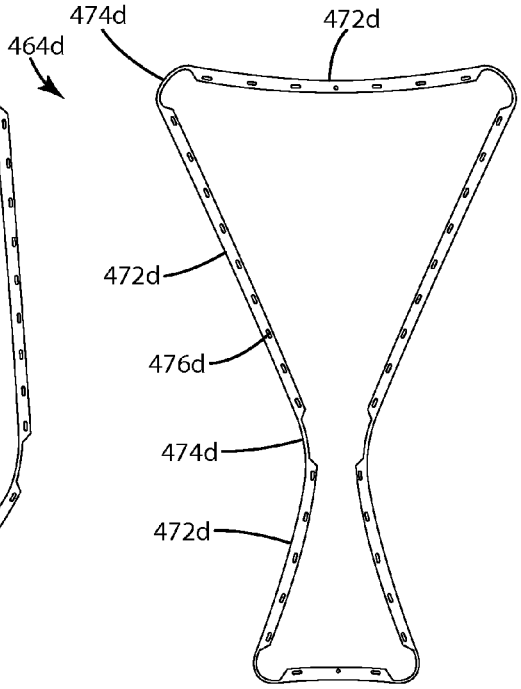
FIG. 40 is a front elevational view of the stay member in an inside-out orientation.
Figure 41:
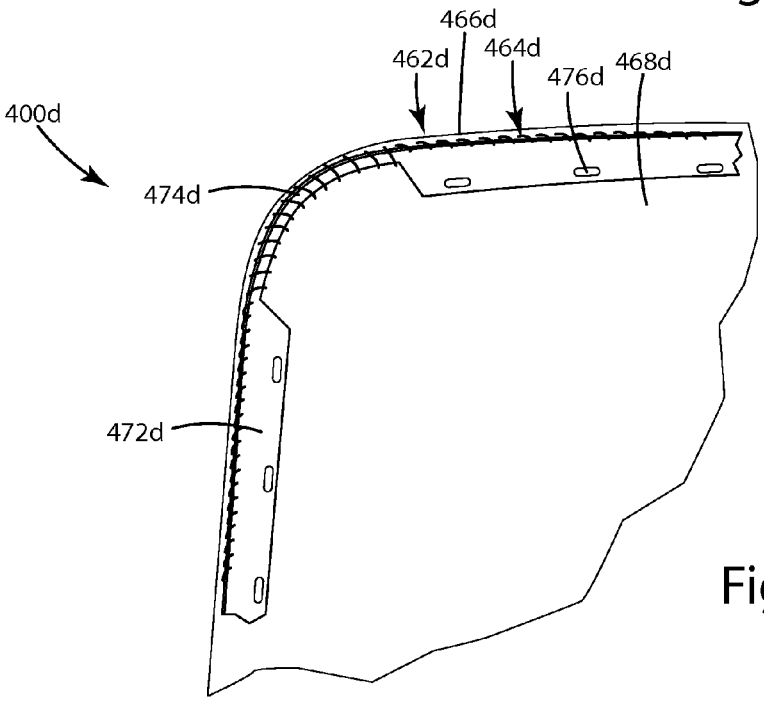
FIG. 41 is a partial front elevational view of the stay member sewn to a cover member.

The cover assembly 400*d* includes a fabric cover 462*d* and a stay-member 464*d* extending about a peripheral edge 466*d* of the fabric cover 462*d*. The fabric cover 462*d* includes a front surface 468*d* and a rear surface 470*d* and preferably comprises a material flexible in at least one of a longitudinal direction and a lateral direction. As best illustrated in FIG. 39, the stay member 464*d* is ring-shaped and includes a plurality of widened portions 472*d* each having a rectangularly-shaped cross-sectional configuration interspaced with a plurality of narrowed corner portions 474*d* each having a circularly-shaped cross-sectional configuration. Each of the widened portions 472*d* include a plurality of apertures 476*d* spaced along the length thereof and adapted to engage with the ribs 460*d* of the back shell 216*d*, as described below. The stay member 464*d* is comprised of a relatively flexible plastic such that the stay member 464*d* may be turned inside-out, as illustrated in FIG. 40.

In assembly, the stay member 464*d* is secured to the rear surface 470*d* of the cover 462*d* such that the cover 462*d* is fixed for rotation with the widened portions 472*d*, and such that the cover 462*d* is not fixed for rotation with the narrowed corner portions 474*d* along a line tangential to a longitudinal axis of the narrowed corner portions 474*d*. In the present example, the stay member 464*d* (FIG. 41) is sewn about the peripheral edge 466*d* of the cover 462*d* by a stitch pattern that extends through the widened portions 472*d* and about the narrowed corner portions 474*d*. The cover assembly 400*d* of the cover 462*d* and the stay member 464*d* are aligned with the back shell 216*d*, and the peripheral edge 466*d* of the cover 462*d* is wrapped about the back shell 216*d* such that the stay member 464*d* is turned inside-out. The stay member 464*d* is then inserted into the opening or groove 458*d*, such that the tension of the fabric cover 462*d* being stretched about the back shell 216*d* causes the stay member 464*d* to remain positively engaged within the groove 458*d*. The ribs 460*d* of the back shell 216*d* engage the corresponding apertures 476*d* of the stay member 464*d*, thereby further securing the stay member 464*d* within the groove 458*d*. It is noted that the stitch pattern attaching the cover 462*d* to the stay member 464*d* allows the narrowed corner portions 474*d* of the stay member 464*d* to rotate freely with respect to the cover 462*d*, thereby reducing the occurrence of aesthetic anomalies near the corners of the cover 462*d*, such as bunching or over-stretch of a given fabric pattern.

Figure 42:
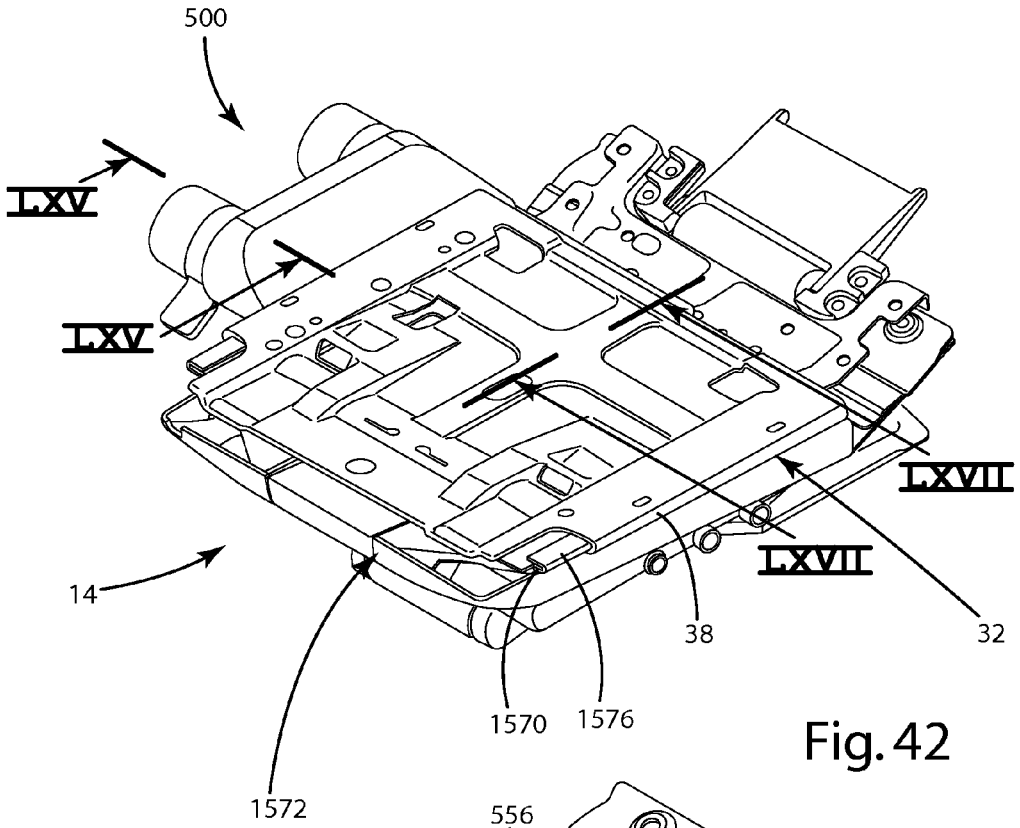
FIG. 42 is a perspective view of a control input assembly supporting a seat support plate thereon.
Figure 43:
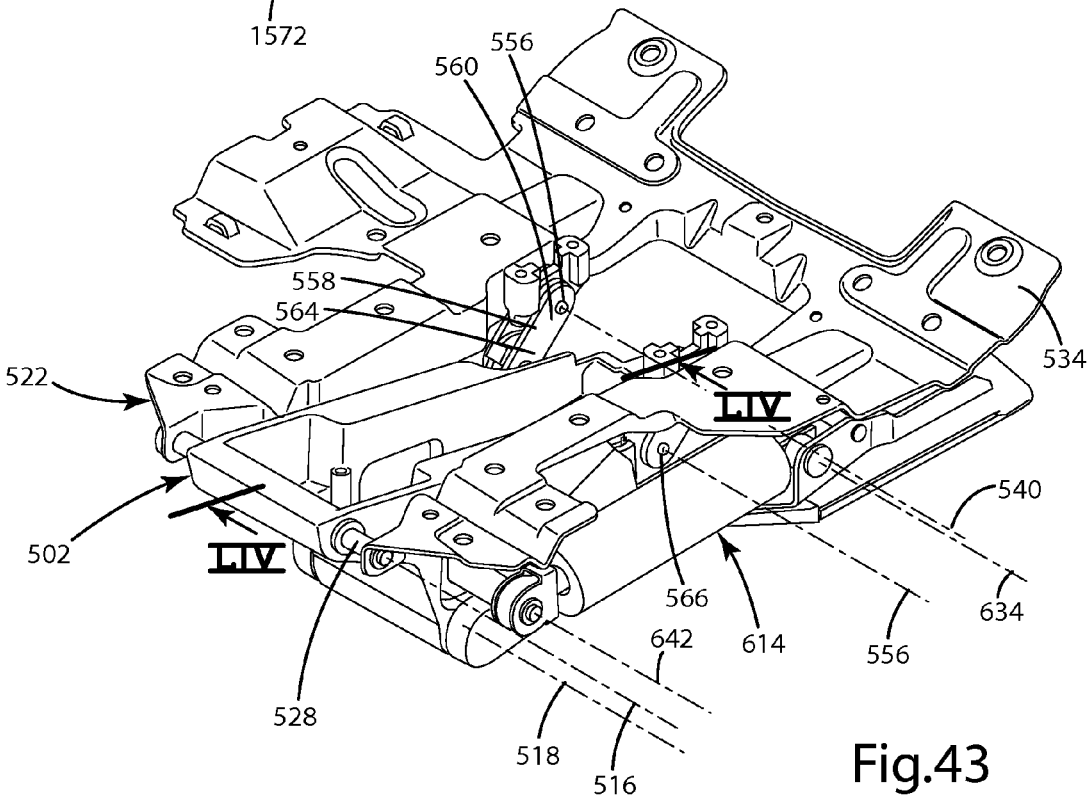
FIG. 43 is a perspective view of the control input assembly with certain elements removed to show the interior thereof.
Figure 44:
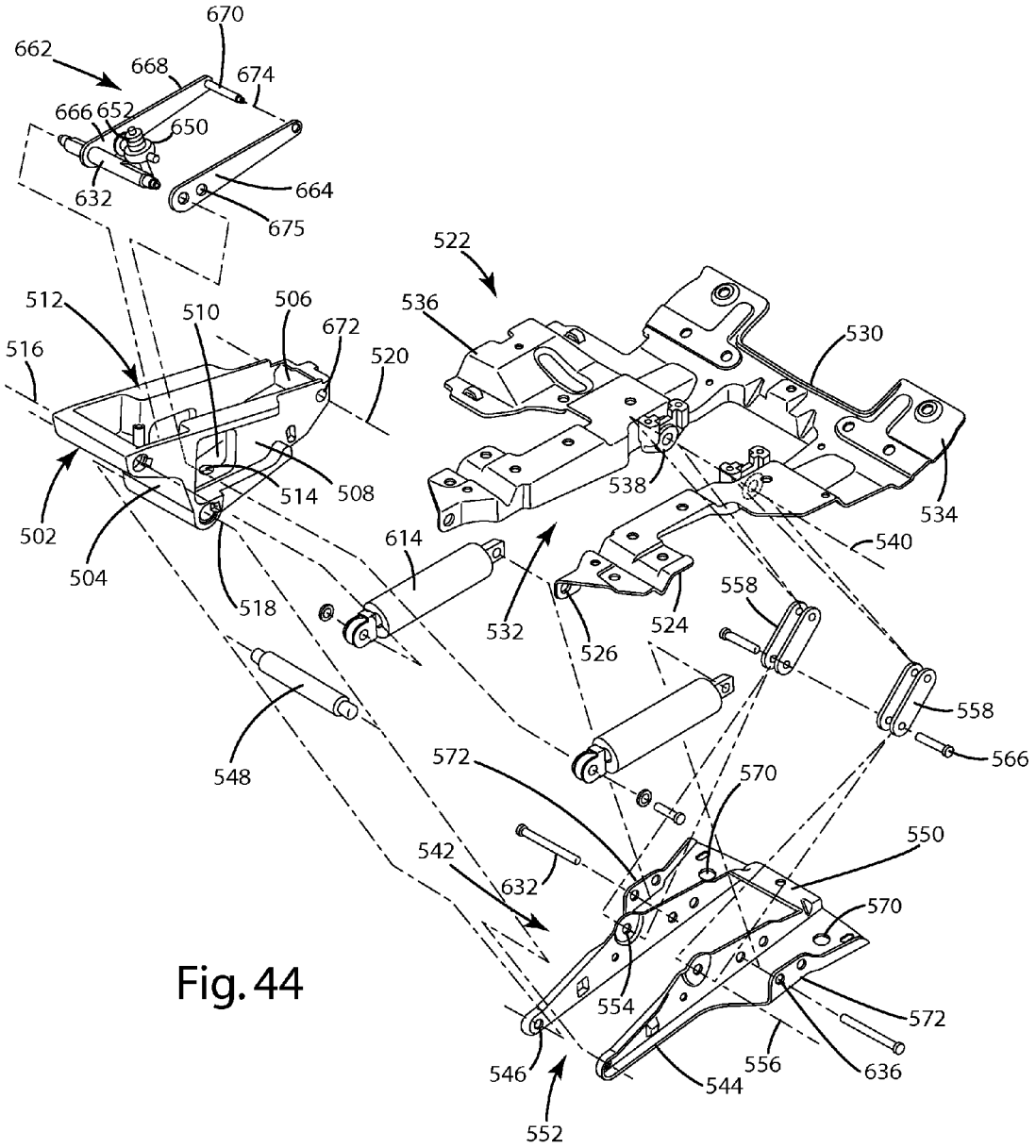
FIG. 44 is an exploded view of the control input assembly.

The seat assembly 16 and the back assembly 18 are operably coupled to and controlled by the control assembly 14 (FIG. 42) and a control input assembly 500. The control assembly 14 (FIGS. 43-45) includes a housing or base structure or ground structure 502 that includes a front wall 504, a rear wall 506, a pair of side walls 508 and a bottom wall 510 integrally formed with one another and that cooperate to form an upwardly opening interior space 512. The bottom wall 510 includes an aperture 514 centrally disposed therein, as described below. The base structure 502 further defines an upper and forward pivot point 516, a lower and forward pivot point 518, and an upper and rearward pivot point 540, wherein the control assembly 14 further includes a seat support structure 522 that supports the seat assembly 16. In the illustrated example, the seat support structure 522 has a generally U-shaped plan form configuration that includes a pair of forwardly extending arm portions 524 each including a forwardly located pivot aperture 526 pivotably secured to the base structure 502 by a pivot shaft 528 for pivoting movement about the upper and forward pivot point 516. The seat support structure 522 further includes a rear portion 530 extending laterally between the arm portions 524 and cooperating therewith to form an interior space 532 within which the base structure 502 is received. The rear portion 530 includes a pair of rearwardly extending arm mounting portions 534 to which the arm assemblies 20 are attached as described below. The seat support structure 522 further includes a control input assembly mounting portion 536 to which the control input assembly 500 is mounted. The seat support structure 522 further includes a pair of bushing assemblies 538 that cooperate to define the pivot point 540.

The control assembly 14 further includes a back support structure 542 having a generally U-shaped plan view configuration and including a pair of forwardly extending arm portions 544 each including a pivot aperture 546 and pivotably coupled to the base structure 502 by a pivot shaft 548 such that the back support structure 542 pivots about the lower and forward pivot point 518. The back support structure 542 includes a rear portion 550 that cooperates with the arm portions 544 to define an interior space 552 which receives the base structure 502 therein. The back support structure 542 further includes a pair of pivot apertures 554 located along the length thereof and cooperating to define a pivot point 556. It is noted that in certain instances, at least a portion of the back frame assembly 200 may be included as part of the back support structure 542.

The control assembly 14 further includes a plurality of control links 558 each having a first end 560 pivotably coupled to the seat support structure 522 by a pair of pivot pins 562 for pivoting about the pivot point 540, and a second end 564 pivotably coupled to corresponding pivot apertures 554 of the back support structure 542 by a pair of pivot pins 566 for pivoting about the pivot point 556. In operation, the control links 558 control the motion, and specifically the recline rate of the seat support structure 522 with respect to the back support structure 542 as the chair assembly is moved to the recline position, as described below.

Figure 46A:
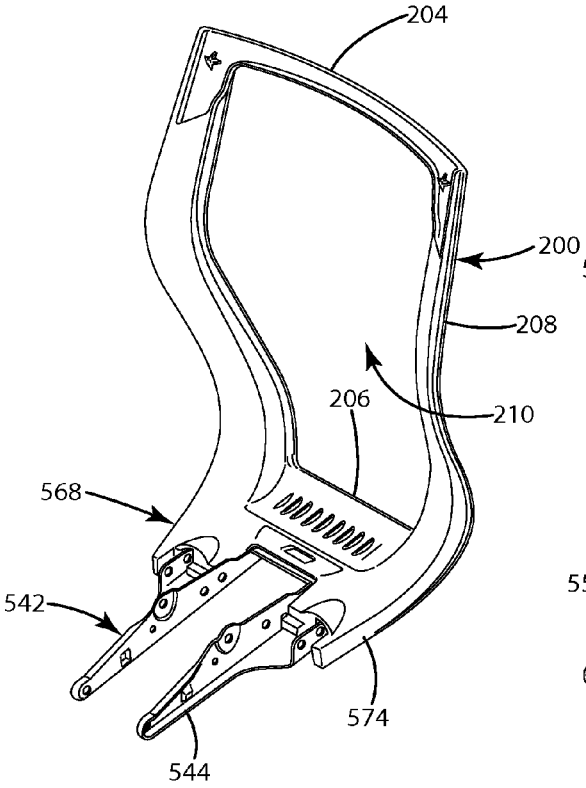
FIG. 46A is a front perspective view of a back support structure.
Figure 46B:
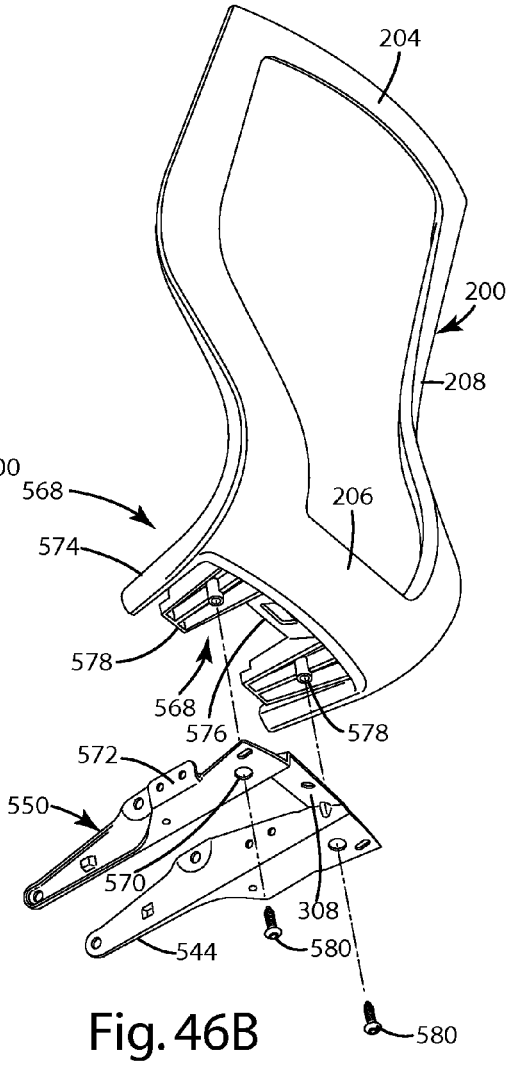
FIG. 46B is an exploded perspective view of the back support structure.

As best illustrated in FIGS. 46A and 46B, the bottom frame portion 206 of the back frame assembly 200 is configured to connect to the back support structure 542 via a quick connect arrangement 568. Each arm portion 544 of the back support structure 542 includes a mounting aperture 570 located at a proximate end 572 thereof. In the illustrated example, the quick connect arrangement 568 comprises a configuration of the bottom frame portion 206 of the back frame assembly 200 that includes a pair of forwardly-extending coupler portions 574 that cooperate to define a channel 576 therebetween that receives the rear portion 550 and the proximate ends 572 of the arm portions 544 therein. Each coupler portion 574 includes a downwardly extending boss 578 that aligns with and is received within a corresponding aperture 570. Mechanical fasteners, such as screws 580 are then threaded into the bosses 578, thereby allowing a quick connection of the back frame assembly 200 to the control assembly 14.

Figure 47:
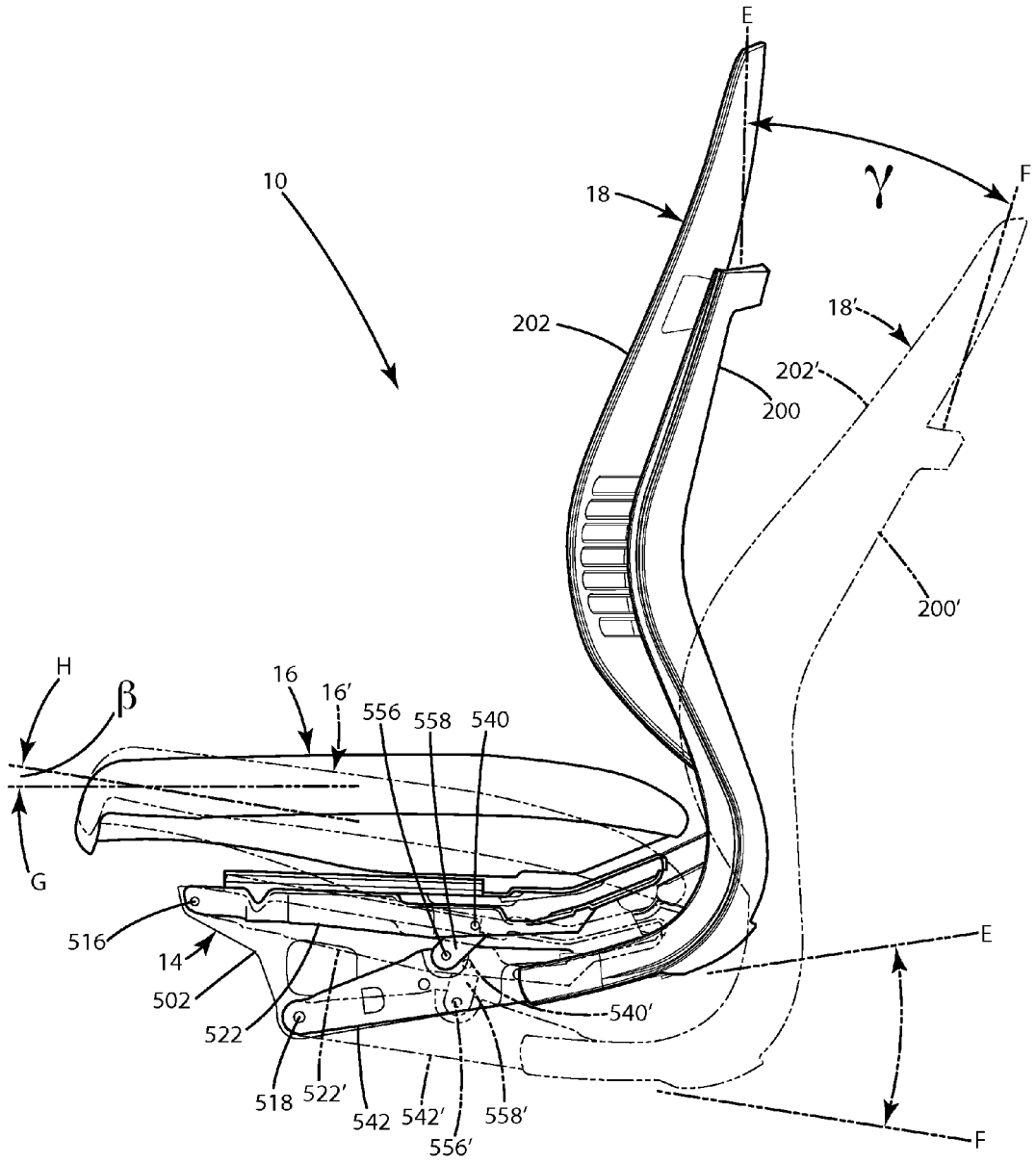
FIG. 47 is a side elevational view of the chair assembly illustrating multiple pivot points thereof.

As best illustrated in FIG. 47, the base structure 502, the seat support structure 522, the back support structure 542 and the control links 558 cooperate to form a four-bar linkage assembly that supports the seat assembly 16, the back assembly 18, and the arm assemblies 20 (FIG. 1). For ease of reference, the associated pivot assemblies associated with the four-bar linkage assembly of the control assembly 14 are referred to as follows: the upper and forward pivot point 516 between the base structure 502 and the base support structure 522 as the first pivot point 516; the lower and forward pivot point 518 between the base structure 502 and the back support structure 542 as the second pivot point 518; the pivot point 540 between the first end 560 of the control link 558 and the seat support structure 522 as the third pivot point 540; and, the pivot point 556 between the second end 564 of the control link 558 and the back support structure 542 as the fourth pivot point 556. Further, FIG. 47 illustrates the component of the chair assembly 10 shown in a reclined position in dashed lines, wherein the reference numerals of the chair in the reclined position are designated with a "'".

In operation, the four-bar linkage assembly of the control assembly 14 cooperates to recline the seat assembly 16 from the upright position G to the reclined position H as the back assembly 18 is moved from the upright position E to the reclined position F, wherein the upper and lower representations of the positions E and F in FIG. 47 illustrates that the upper and lower portions of the back assembly 18 recline as a single piece. Specifically, the control link 558 is configured and coupled to the seat support structure 522 and the back support structure 542 to cause the seat support structure 522 to rotate about the first pivot point 516 as the back support structure 542 is pivoted about the second pivot point 518. Preferably, the seat support structure 522 is rotated about the first pivot point 516 at between about ⅓ and about ⅔ the rate of rotation of the back support structure 542 about the second pivot point 518, more preferably the seat support structure 522 rotates about the first pivot point 516 at about half the rate of rotation of the back support structure 542 about the second pivot point 518, and most preferable the seat assembly 16 reclines to an angle $\beta$ of about 9° from the fully upright position G to the fully reclined position H, while the back assembly 18 reclines to an angle $\gamma$ of about 18° from the fully upright position E to the fully reclined position F.

Figure 48:
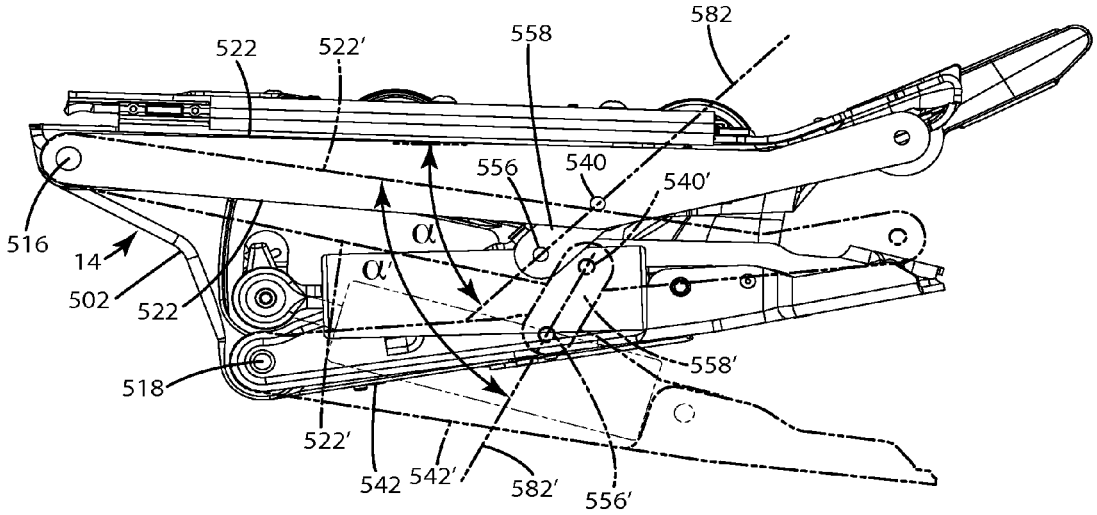
FIG. 48 is a side perspective view of the control assembly showing multiple pivot points associated therewith.

As best illustrated in FIG. 47, the first pivot point 516 is located above and forward of the second pivot point 518 when the chair assembly 10 is at the fully upright position, and when the chair assembly 10 is at the fully reclined position as the base structure 502 remains fixed with respect to the supporting floor surface 13 as the chair assembly 10 is reclined. The third pivot point 540 remains behind and below the relative vertical height of the first pivot point 516 throughout the reclining movement of the chair assembly 10. It is further noted that the distance between the first pivot point 516 and the second pivot point 518 is greater than the distance between the third pivot point 540 and the fourth pivot point 556 throughout the reclining movement of the chair assembly 10. As best illustrated in FIG. 48, a longitudinally extending center line axis 582 of the control link 558 forms an acute angle $\alpha$ with the seat support structure 522 when the chair assembly 10 is in the fully upright position and an acute angle $\alpha'$ when the chair assembly 10 is in the fully reclined position. It is noted that the center line axis 582 of the control link 558 does not rotate past an orthogonal alignment with the seat support structure 522 as the chair assembly 10 is moved between the fully upright and fully reclined positions thereof.

Figure 49:
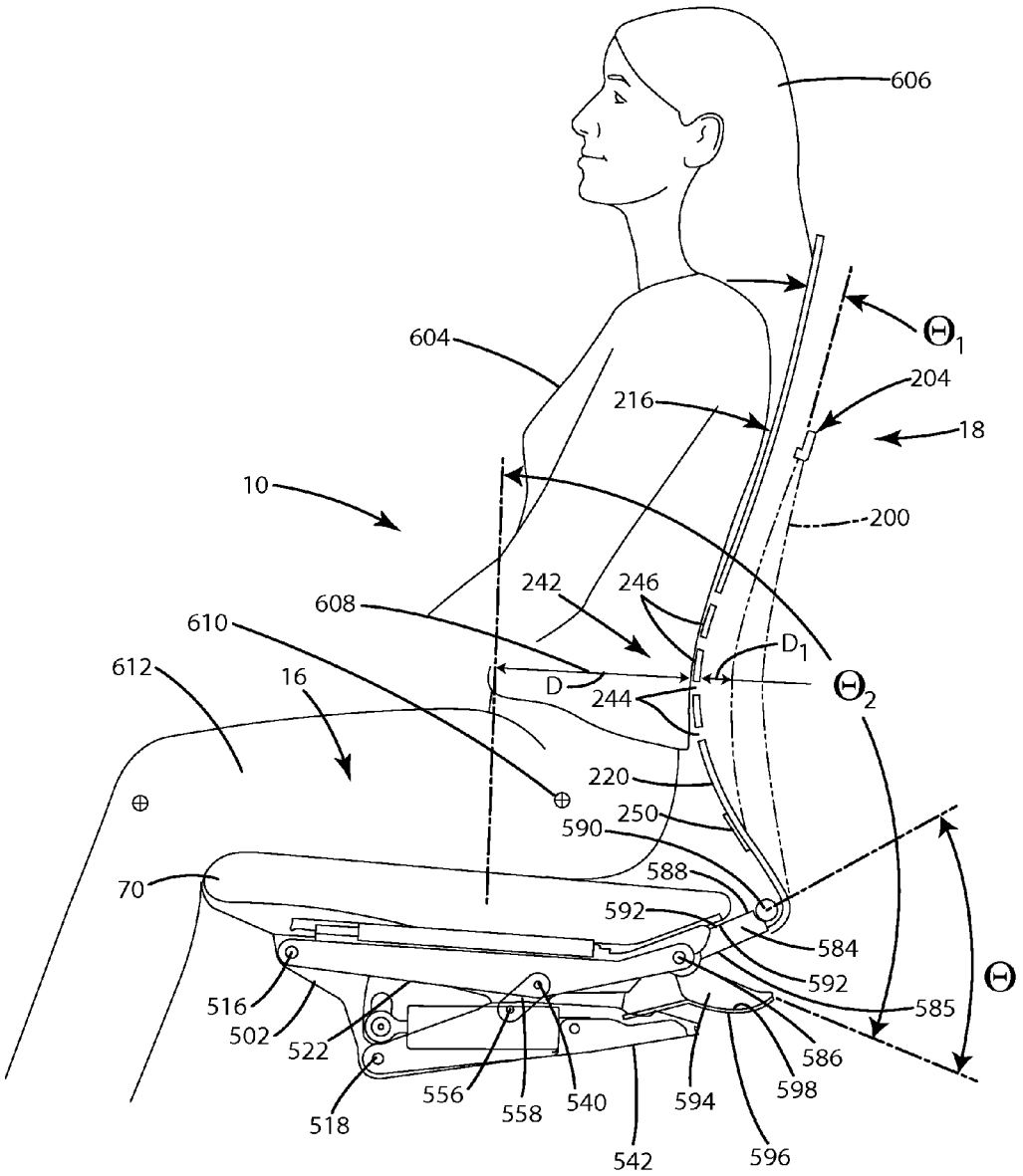
FIG. 49 is a cross-sectional view of the chair showing the back in an upright position with the lumbar adjustment set at a neutral setting.

With further reference to FIG. 49, a back control link 584 includes a forward end 585 that is pivotably coupled or connected to the seat support structure 522 at a fifth pivot point 586. A rearward end 588 of the back control link 584 is connected to the lower portion 220 of the back shell 216 at a sixth pivot point 590. The sixth pivot point 590 is optional, and the back control link 584 and the back shell 216 may be rigidly fixed to one another. Also, the pivot point 590 may include a stop feature that limits rotation of the back control link 584 relative to the back shell 216 in a first and/or second rotational direction. For example, with reference to FIG. 49, the pivot point 590 may include a stop feature 592 that permits clockwise rotation of the lower portion 220 of the back shell 216 relative to the control link 584. This permits the lumbar to become flatter if a rearward/horizontal force tending to reduce dimension $D_1$ is applied to the lumbar portion of the back shell 216. However, the stop feature 592 may be configured to prevent rotation of the lower portion 220 of the back shell 216 in a counter clockwise direction (FIG. 49) relative to the control link 584. This causes the link control 584 and the lower portion 220 of the back shell 216 to rotate at the same angular rate as a user reclines in the chair by pushing against an upper portion of back assembly 18.

A cam link 594 is also pivotably coupled or connected to the seat support structure 522 for rotation about the pivot point or axis 586. The cam link 594 has a curved lower cam surface 596 that slidably engages an upwardly facing cam surface 598 formed in the back support structure 542. A pair of torsion springs 600 (see also FIG. 29A) rotatably bias the back control link 584 and the cam link 594 in a manner that tends to increase the angle Ø (FIG. 49). The torsion springs 600 generate a force tending to rotate the control link 584 in a counter-clockwise direction, and simultaneously rotate the cam link 594 in a clockwise direction. Thus, the torsion springs 600 tend to increase the angle Ø between the back control link 584 and the cam link 594. The stop feature 592 on the seat support structure 522 limits counter clockwise rotation of the back control link 584 to the position shown in FIG. 49. This force may also bias the control link 584 in a counter clockwise direction into the stop feature 592.

As discussed above, the back shell 216 is flexible, particularly in comparison to the rigid back frame structure 200. As also discussed above, the back frame structure 200 is rigidly connected to the back support structure 542, and therefore pivots with the back support structure 542. The forces generated by the torsion springs 600 push upwardly against the lower portion 220 of the back shell 216. As also discussed above, the slots 244 in the back shell structure 216 create additional flexibility at the lumbar support portion or region 242 of the back shell 216. The force generated by the torsion springs 600 also tend to cause the lumbar portion 242 of the back shell 2126 to bend forwardly such that the lumbar portion 242 has a higher curvature than the regions adjacent the torsional springs 600.

Figure 50:
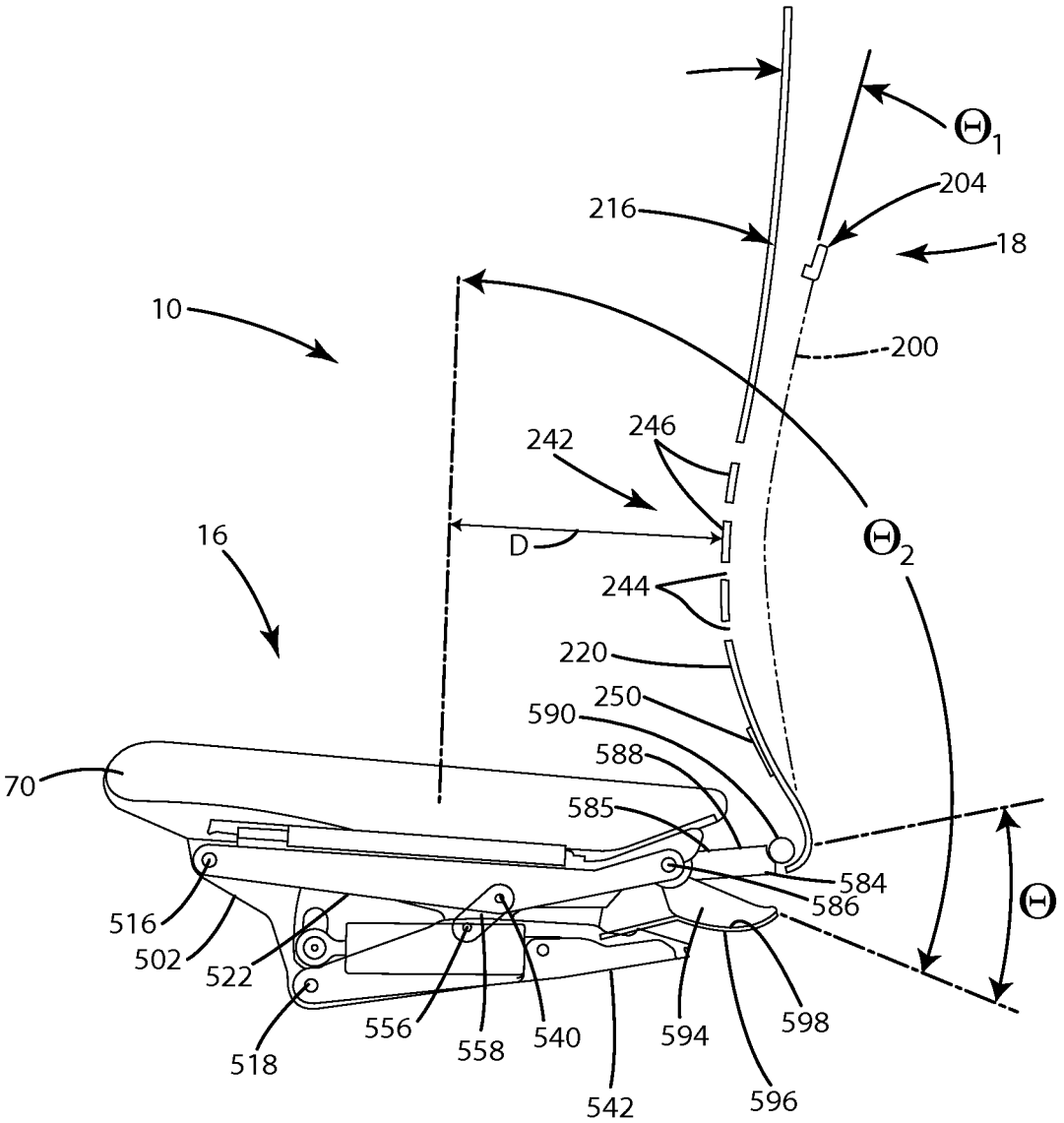
FIG. 50 is a cross-sectional view of the chair showing the back in an upright position with the lumbar portion adjusted to a flat configuration.

As discussed above, the position of the lumbar assembly 300 is vertically adjustable. Vertical adjustment of the lumbar assembly 300 also adjusts the way in which the back shell 216 flexes/curves during recline of the chair back 18. For example, when, the lumbar assembly 300 is adjusted to an intermediate or neutral position, the curvature of the lumbar portion 242 (FIG. 49) of the back shell 216 is also intermediate or neutral. If the vertical position of the lumbar assembly 300 is adjusted, the angle Ø (FIG. 50) is reduced, and the curvature of the lumbar portion 242 is reduced. As shown in FIG. 50, this also causes angle $Ø_1$ to become greater, and the overall shape of the back shell 216 to become relatively flat.

Figure 51:
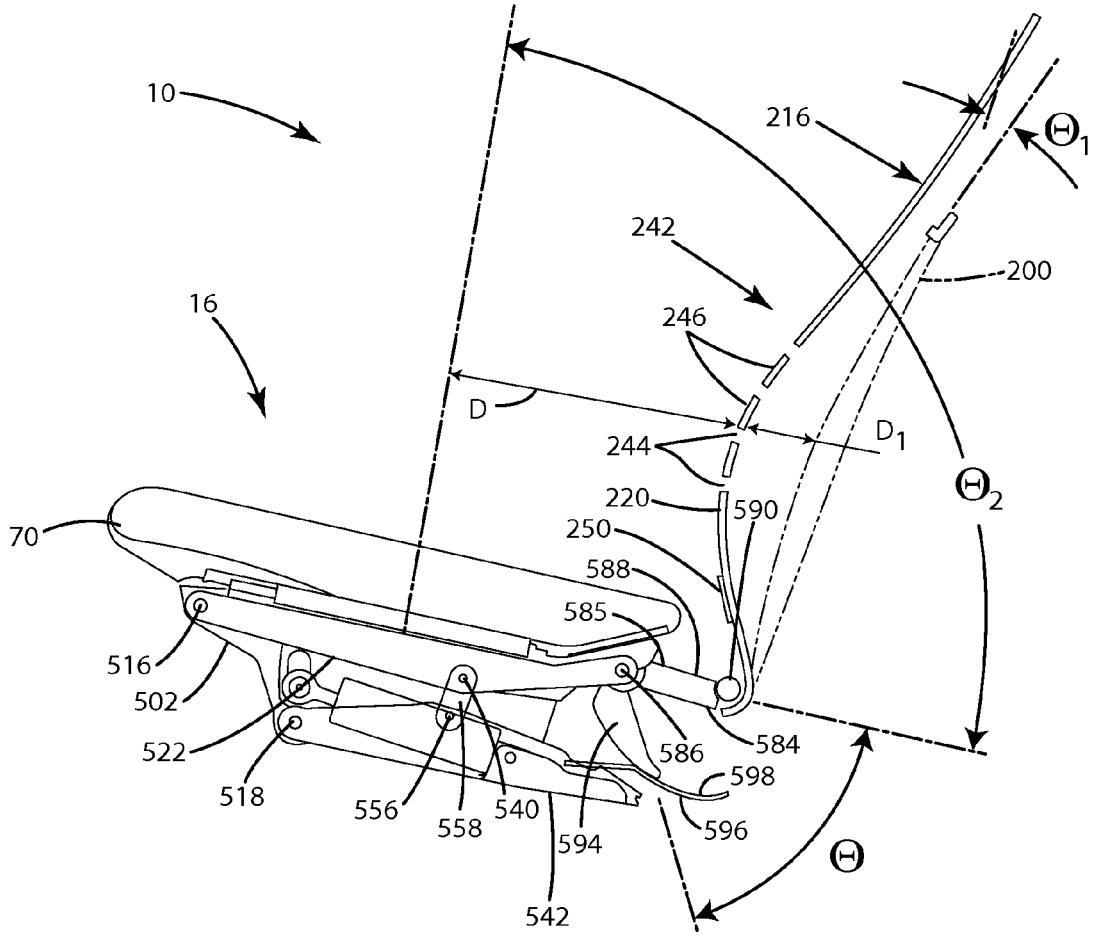
FIG. 51 is a cross-sectional view of the chair showing the back reclined with the lumbar adjusted to a neutral position.

With further reference to FIG. 51, if the height of the lumbar assembly 300 is set at an intermediate level (i.e., the same as FIG. 49), and a user leans back, the four-bar linkage defined by links and the structures 502, 522, 542, 558 and pivot points 516, 518, 540, 556 will shift (as described above) from the configuration of FIG. 49 to the configuration of FIG. 51. This, in turn, causes an increase in the distance between the pivot point 586 and the cam surface 598. This causes an increase in the angle Ø from about 49.5° (FIG. 49) to about 59.9° (FIG. 51). As the spring rotates towards an open position, some of the energy stored in the spring is transferred into the back shell 216, thereby causing the degree of curvature of the lumbar portion 220 of the back shell 216 to become greater. In this way, the back control link 584, the cam link 594, and the torsion springs 600 provide for greater curvature of the lumbar portion 242 to reduce curvature of a user's back as the user leans back in the chair.

Also, as the chair tilts from the position of FIG. 49 to the position of FIG. 51, the distance D between the lumbar region or portion 242 and the seat 16 increases from 174 mm to 234 mm. A dimension $D_1$ between the lumbar portion 242 of back shell 216 and the back frame structure 200 also increases as the back 18 tilts from the position of FIG. 49 to the position of FIG. 51. Thus, although the distance D increases somewhat, the increase in the dimension $D_1$ reduces the increase in dimension D because the lumbar portion 242 of the back shell 216 is shifted forward relative to the back frame 200 during recline.

Referring again to FIG. 49, a spine 604 of a seated user 606 tends to curve forwardly in the lumbar region 608 by a first amount when a user 606 is seated in an upright position. As a user 606 leans back from the position of FIG. 49 to the position of FIG. 51, the curvature of the lumbar region 608 tends to increase, and the user's spine 604 will also rotate somewhat about hip joint 610 relative to a user's femur 612. The increase in the dimension D and the increase in curvature of the lumbar portion 242 of the back shell 216 simultaneously ensure that the user's hip joint 610 and the femur 612 do not slide on the seat 16, and also accommodate curvature of the lumbar region 608 of a user's spine 604.

Figure 52:
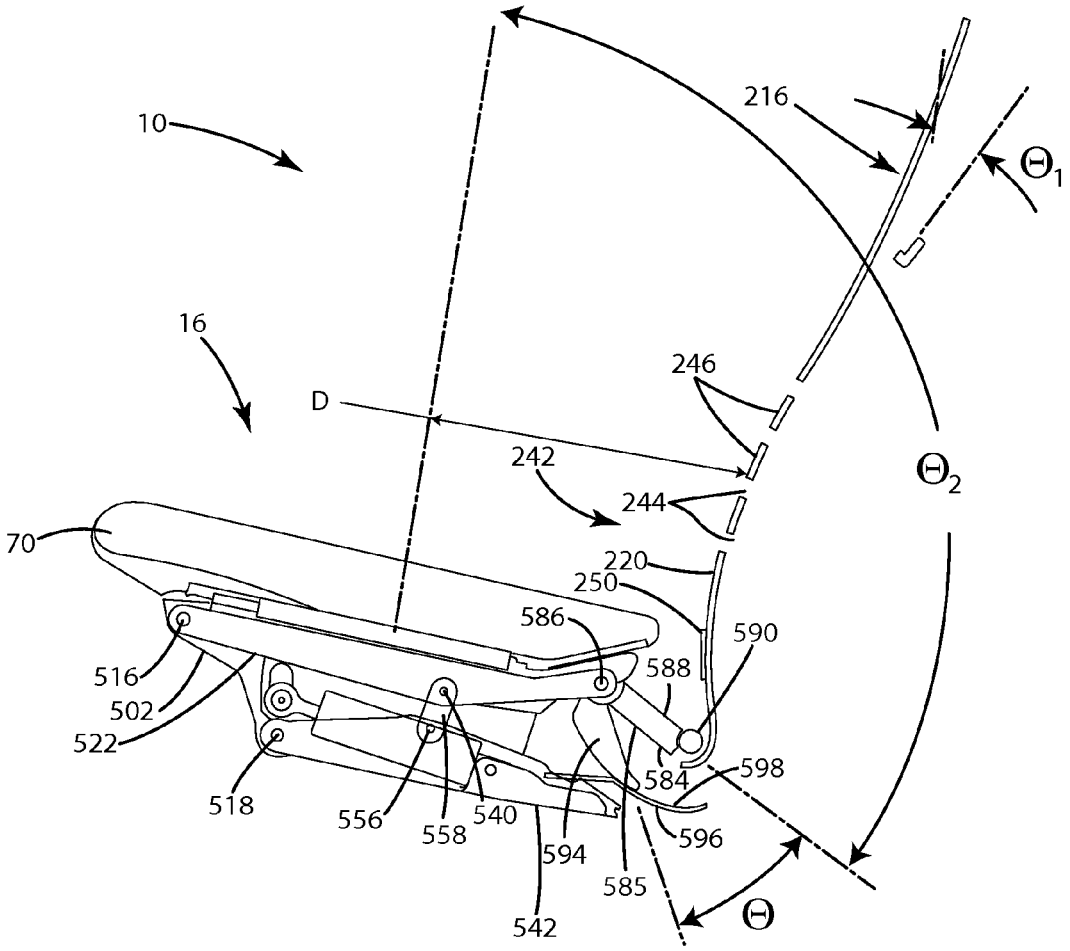
FIG. 52 is a cross-sectional view of the chair in a reclined position with the lumbar adjusted to a flat configuration.

As discussed above, FIG. 50 shows the back 18 of the chair in an upright position with the lumbar portion 242 of the back shell 216 adjusted to a flat position. If the chair back 18 is tilted from the position of FIG. 50 to the position of FIG. 52, the back control link 584 and the cam link 594 both rotate in a clockwise direction. However, the cam link 594 rotates at a somewhat higher rate, and the angle Ø therefore changes from 31.4° to 35.9°. The distance D changes from 202 mm to 265 mm, and the angle $Ø_1$ changes from 24.2° to 24.1°.

Figure 52A:
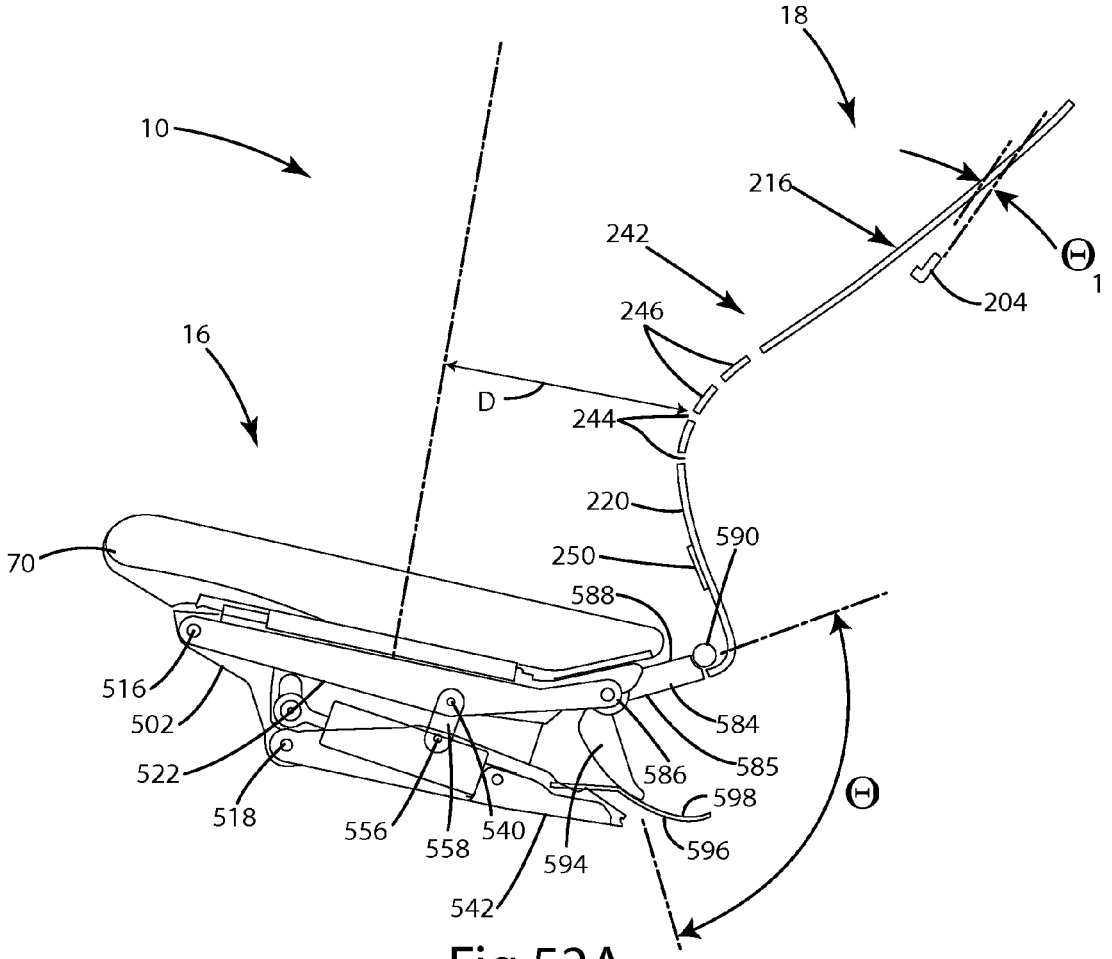
FIG. 52A is a cross-sectional view of the chair showing the back reclined with the lumbar portion of the shell set at a maximum curvature.

With further reference to FIG. 52A, if the chair back 18 is reclined, and the lumbar adjustment is set high, the angle Ø is 93.6°, and the distance D is 202 mm.

Thus, the back shell 216 curves as the chair back 18 is tilted rearwardly. However, the increase in curvature in the lumbar portion 242 from the upright to the reclined position is significantly greater if the curvature is initially adjusted to a higher level. This accounts for the fact that the curvature of a user's back does not increase as much when a user reclines if the user's back is initially in a relatively flat condition when seated upright. Restated, if a user's back is relatively straight when in an upright position, the user's back will remain relatively flat even when reclined, even though the degree of curvature will increase somewhat from the upright position to the reclined position. Conversely, if a user's back is curved significantly when in the upright position, the curvature of the lumbar region will increase by a greater degree as the user reclines relative to the increase in curvature if a user's back is initially relatively flat.

Figure 45:
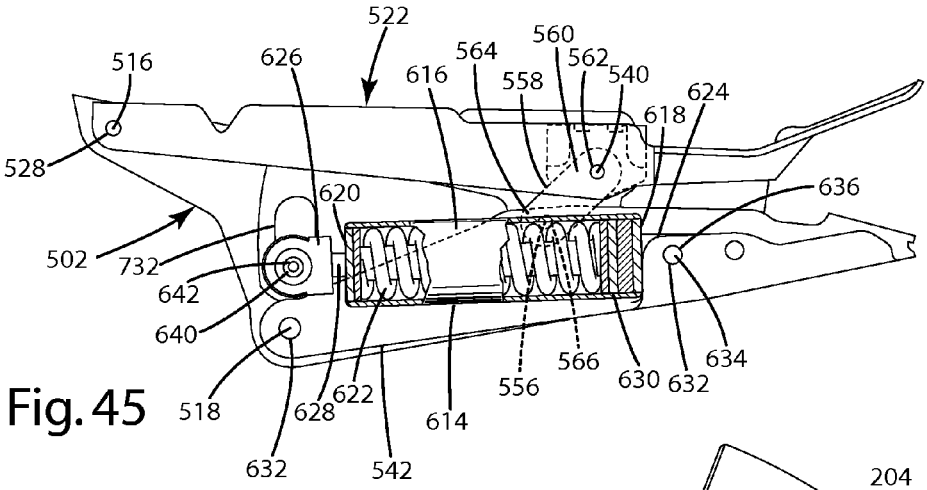
FIG. 45 is a side elevational view of the control input assembly.
Figure 53:
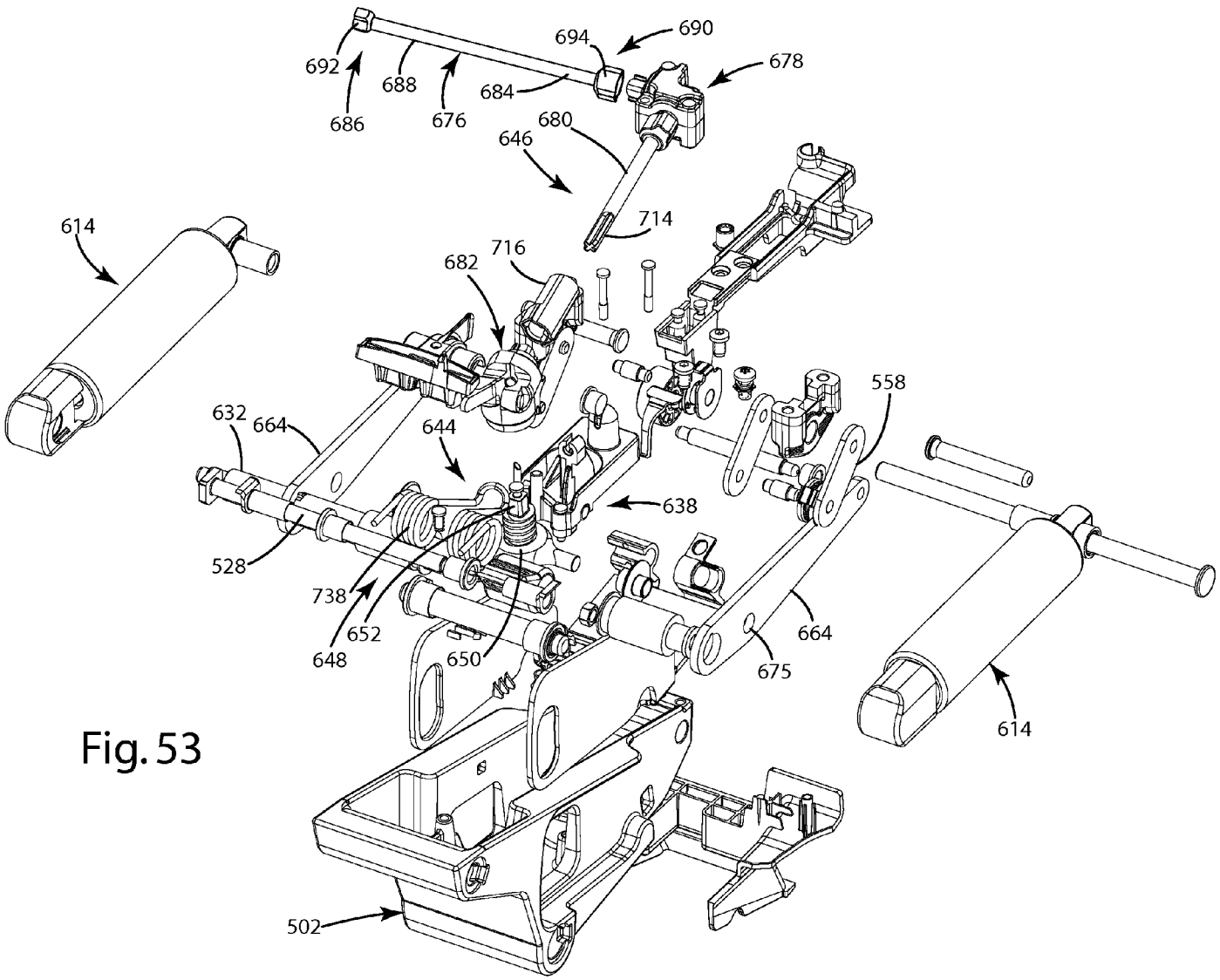
FIG. 53 is an exploded view of a moment arm shift assembly.
Figure 54:
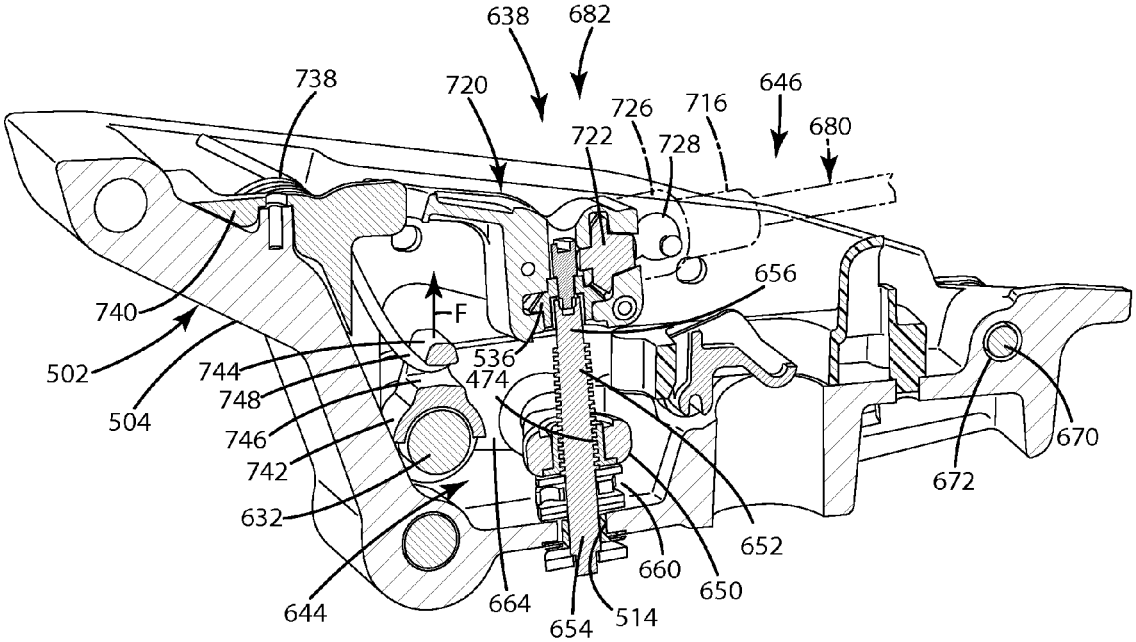
FIG. 54 is a cross-sectional perspective of the moment arm shift assembly taken along the line LIV-LIV, FIG. 43.
Figure 55:
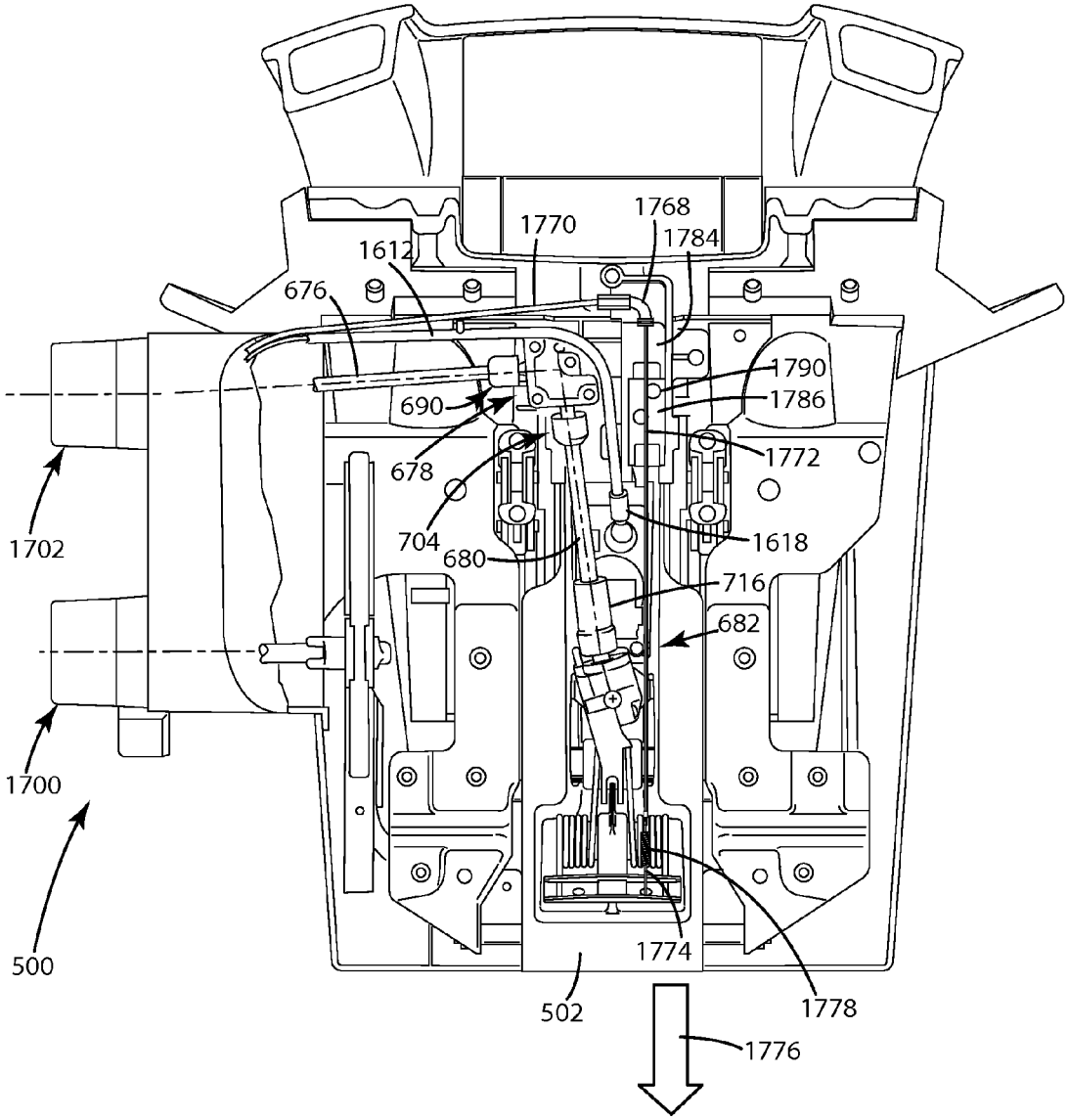
FIG. 55 is a top plan view of a plurality of control linkages.
Figure 56:
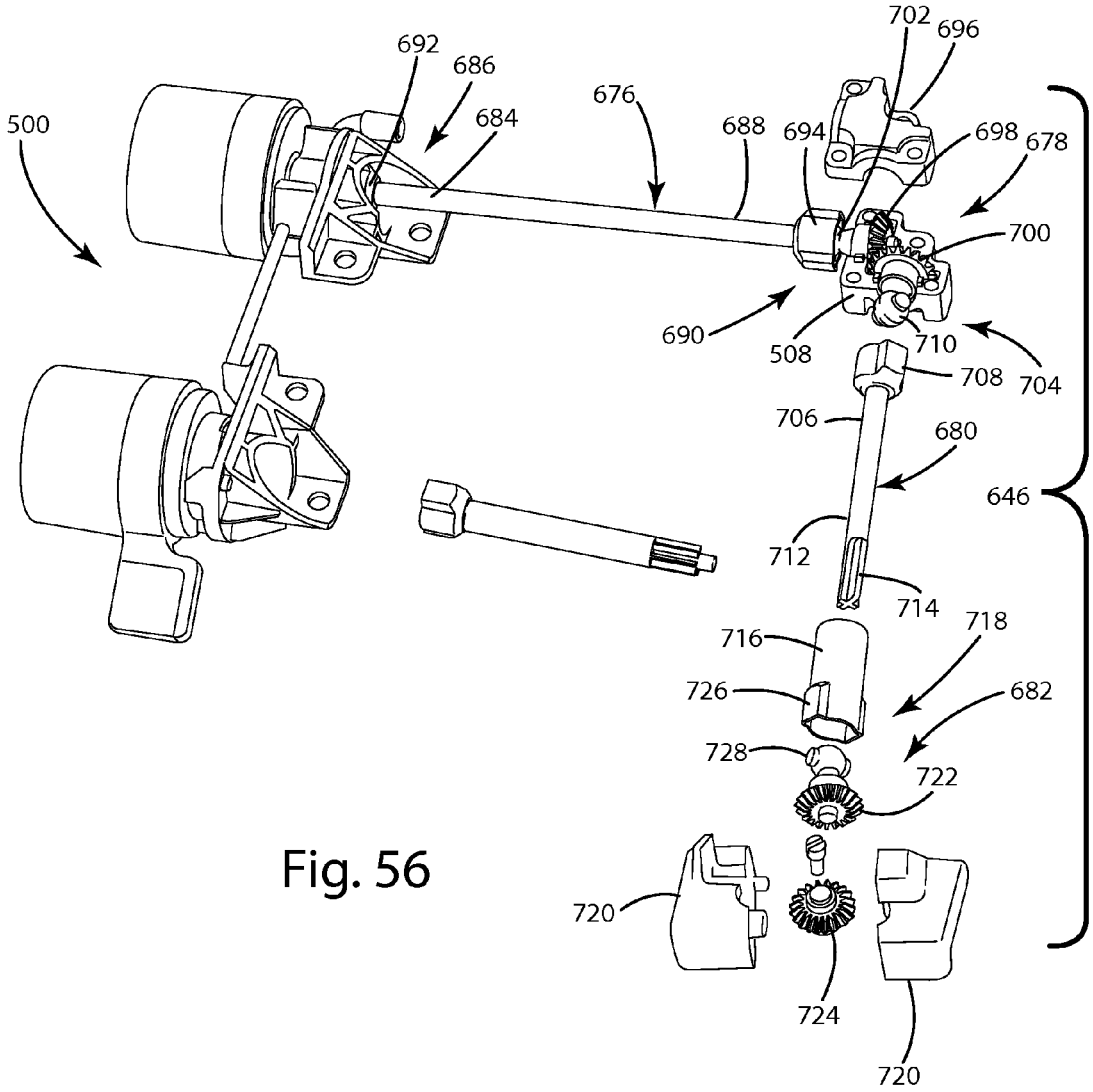
FIG. 56 is an exploded view of a control link assembly.
Figure 57A:
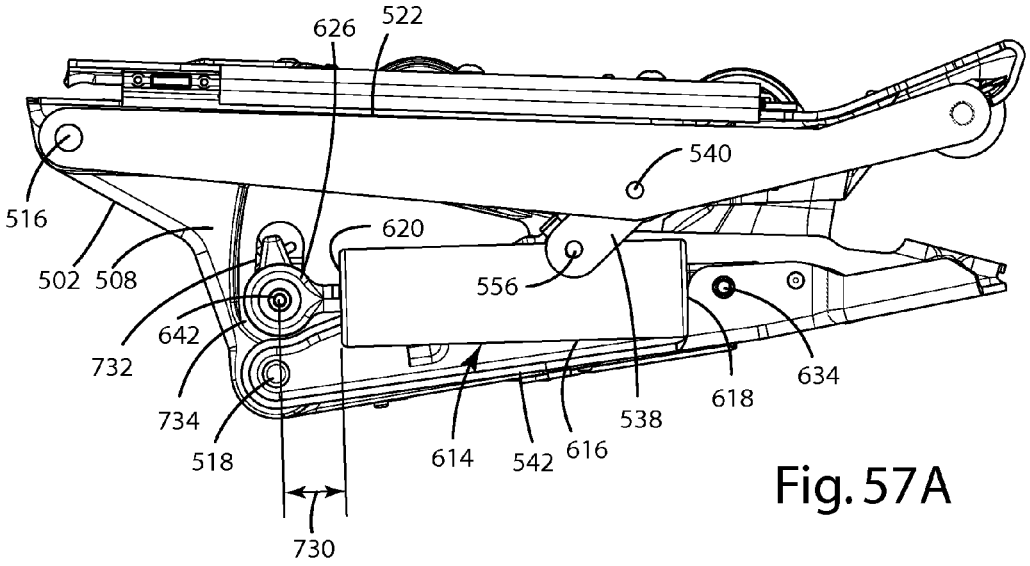
FIG. 57A is a side perspective view of the control assembly with the moment arm shift in a low tension position and the chair assembly in an upright position.
Figure 57B:
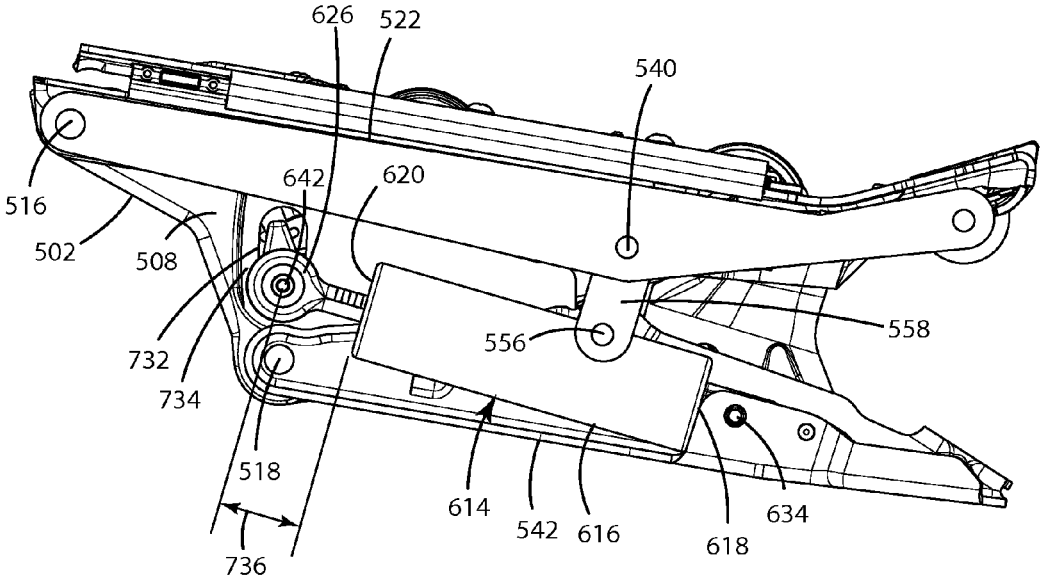
FIG. 57B is a side perspective view of the control assembly with the moment arm shift in a low tension position and the chair assembly in a reclined position.
Figure 58A:
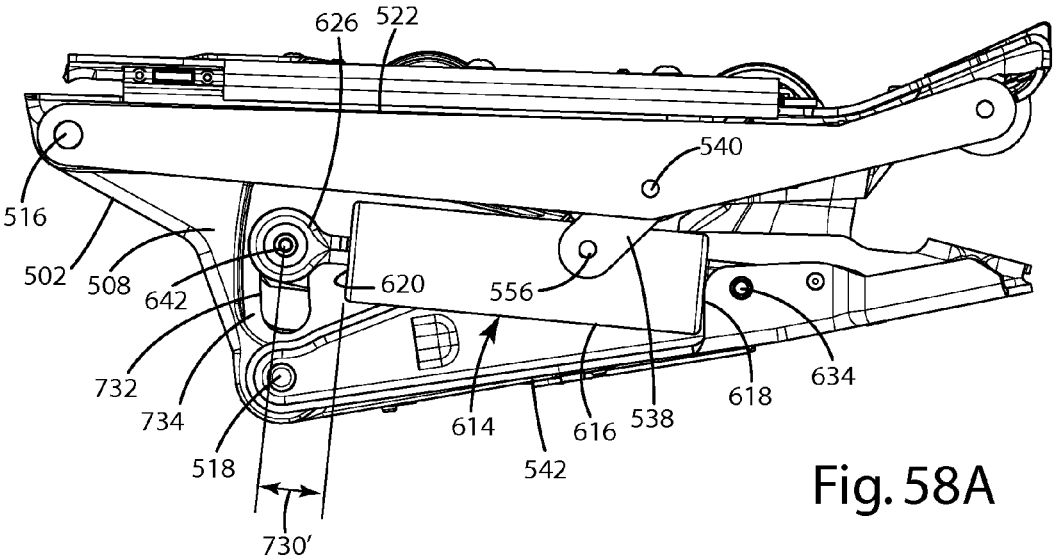
FIG. 58A is a side perspective view of the control assembly with the moment arm shift in a high tension position and the chair assembly in an upright position.
Figure 58B:
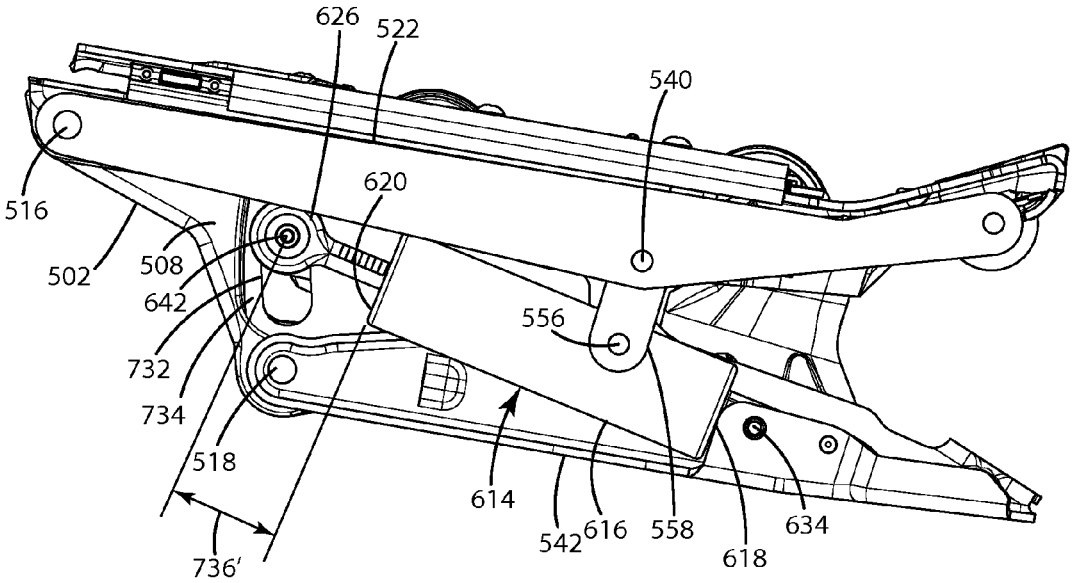
FIG. 58B is a side perspective view of the control assembly with the moment arm shift in a high tension position and the chair assembly in a reclined position.

A pair of spring assemblies 614 (FIGS. 43 and 44) bias the back assembly 18 (FIG. 4) from the reclined position F towards the upright position E. As best illustrated in FIG. 45, each spring assembly 614 includes a cylindrically-shaped housing 616 having a first end 618 and a second end 620. Each spring assembly 614 further includes a compression coil spring 622, a first coupler 624 and a second coupler 626. In the illustrated example, the first coupler 624 is secured to the first end 618 of the housing 616, while the second coupler 626 is secured to a rod member 628 that extends through the coil spring 622. A washer 630 is secured to a distal end of the rod member 628 and abuts an end of the coil spring 622, while the opposite end of the coil spring 622 abuts the second end 620 of the housing 616. The first coupler 624 is pivotably secured to the back support structure 542 by a pivot pin 632 for pivoting movement about a pivot point 634, wherein the pivot pin 632 is received within pivot apertures 636 of the back support structure 542, while the second coupler 626 is pivotably coupled to a moment arm shift assembly 638 (FIGS. 53-55) by a shaft 640 for pivoting about a pivot point 642. The moment arm shift assembly 638 is adapted to move the biasing or spring assembly 614 from a low tension setting (FIG. 57A) to a high tension setting (FIG. 58A) wherein the force exerted by the biasing assembly 614 on the back assembly 18 is increased relative to the low-tension setting.

As illustrated in FIGS. 53-56, the moment arm shift assembly 638 includes an adjustment assembly 644, a moment arm shift linkage assembly 646 operably coupling the control input assembly 500 to the adjustment assembly 644 and allowing the operator to move the biasing assembly 614 between the low and high tension settings, and an adjustment assist assembly 648 that is adapted to reduce the amount of input force required to be exerted by the user on the control input assembly 500 to move the moment arm shift assembly 638 from the low tension setting to the high tension setting, as described below.

The adjustment assembly 644 comprises a pivot pin 650 that includes a threaded aperture that threadably receives a threaded adjustment shaft 652 therein. The adjustment shaft 652 includes a first end 654 and a second end 656, wherein the first end 654 extends through the aperture 514 of the base structure 502 and is guided for pivotal rotation about a longitudinal axis by a bearing assembly 660. The pivot pin 650 is supported from the base structure 502 by a linkage assembly 662 (FIG. 44) that includes a pair of linkage arms 664 each having a first end 666 pivotably coupled to the second coupler 626 by the pivot pin 632 and a second end 668 pivotably coupled to the base structure 502 by a pivot pin 670 pivotably received within a pivot aperture 672 of the base structure 502 for pivoting about a pivot point 674, and an aperture 675 that receives a respective end of the pivot pin 650. The pivot pin 650 is pivotably coupled with the linkage arms 664 along the length thereof.

The moment arm shift linkage assembly 638 includes a first drive shaft 676 extending between the control input assembly 500 and a first beveled gear assembly 678, and a second drive shaft 680 extending between and operably coupling the first beveled gear assembly 678 with a second beveled gear assembly 682, wherein the second beveled gear assembly 682 is connected to the adjustment shaft 652. The first drive shaft 676 includes a first end 684 operably coupled to the control input assembly 500 by a first universal joint assembly 686, while the second end 688 of the first drive shaft 676 is operably coupled to the first beveled gear assembly 678 by a second universal joint assembly 690. In the illustrated example, the first end 684 of the first drive shaft 676 includes a female coupler portion 692 of the first universal joint assembly 686, while the second end 688 of the first drive shaft 676 includes a female coupler portion 694 of the second universal joint assembly 690. The first beveled gear assembly 678 includes a housing assembly 696 that houses a first beveled gear 698 and a second beveled gear 700 therein. As illustrated, the first beveled gear 698 includes an integral male coupler portion 702 of the second universal joint assembly 690. The first end 706 of the second drive shaft 680 is coupled to the first beveled gear assembly 678 by a third universal joint assembly 704. The first end 706 of the second drive shaft 680 includes a female coupler portion 708 of the third universal joint assembly 704. The second beveled gear 700 includes an integral male coupler portion 710 of the third universal joint assembly 704. A second end 712 of the second drive shaft 680 includes a plurality of longitudinally extending splines 714 that mate with corresponding longitudinally extending splines (not shown) of a coupler member 716. The coupler member 716 couples the second end 712 of the second drive shaft 680 with the second beveled gear assembly 682 via a fourth universal joint assembly 718. The fourth universal joint assembly 718 includes a housing assembly 720 that houses a first beveled gear 722 coupled to the coupler member 716 via the fourth universal joint assembly 718, and a second beveled gear 724 fixed to the second end 656 of the adjustment shaft 652. The coupler member 716 includes a female coupler portion 726 that receives a male coupler portion 728 integral with the first beveled gear 722.

In assembly, the adjustment assembly 644 (FIGS. 53 and 54) of the moment arm shift assembly 638 is operably supported by the base structure 502, while the control input assembly 500 (FIG. 42) is operably supported by the control input assembly mounting portion 536 (FIG. 44) of the seat support structure 522. As a result, the relative angles and distances between the control input assembly 500 and the adjustment assembly 644 of the moment arm shift assembly 638 change as the seat support structure 522 is moved between the fully upright position G and the fully reclined H. The third and fourth universal joint assemblies 704, 718, and the arrangement of the spline 714 and the coupler 716 cooperate to compensate for these relative changes in angle and distance.

The moment arm shift assembly 638 (FIGS. 53 and 54) functions to adjust the biasing assemblies 614 between the low-tension and high-tension settings (FIGS. 57A-58B). Specifically, the biasing assemblies 614 are shown in a low-tension setting with the chair assembly 10 in an upright position in FIG. 57A, and the low-tension setting with the chair assembly 10 in a reclined position in FIG. 57B, while FIG. 58A illustrates the biasing assemblies 614 in the high-tension setting with the chair in an upright position, and FIG. 58B the biasing assemblies in the high-tension setting with the chair assembly 10 in the reclined position. The distance 730, as measured between the pivot point 642 and the second end 620 of the housing 616 of the spring assembly 614, serves as a reference to the amount of compression exerted on the spring assembly 614 when the moment arm shift assembly 638 is positioned in the low-tension setting and the chair assembly 10 is in the upright position. The distance 730 (FIG. 58A) comparatively illustrates the increased amount of compressive force exerted on the spring assembly 614 when the moment arm shift assembly 638 is in the high-tension setting and the chair assembly 10 is in the upright position. The user adjusts the amount of force exerted by the biasing assemblies 614 on the back support structure 542 by moving the moment arm shift assembly 638 from the low-tension setting to the high-tension setting. Specifically, the operator, through an input to the control input assembly 500, drives the adjustment shaft 652 of the adjustment assembly 644 in rotation via the moment arm shift linkage assembly 646, thereby causing the pivot shaft 650 to travel along the length of the adjustment shaft 654, thus changing the compressive force exerted on the spring assemblies 614 as the pivot shaft 650 is adjusted with respect to the base structure 502. The pivot shaft 650 travels within a slot 732 located within a side plate member 734 attached to an associated side wall 508 of the base structure 502. It is noted that when the moment arm shift assembly 638 is in the high-tension setting and the chair assembly 10 is in the upright position the distance 730 is greater than the distance 730 when the moment arm shift assembly 638 is in the low-tension setting and the chair assembly 10 is in the upright position, thereby indicating that the compressive force as exerted on the spring assemblies 614, is greater when the moment arm shift is in the high-tension setting as compared to a low-tension setting. Similarly, the distance 736 (FIG. 58B) is greater than the distance 736 (FIG. 57B), resulting in an increase in the biasing force exerted by the biasing assemblies 614 and forcing the back assembly 18 from the reclined position towards the upright position. It is noted that the change in the biasing force exerted by the biasing assemblies 614 corresponds to a change in the biasing torque exerted about the second pivot point 518, and that in certain configurations, a change in the biasing torque is possible without a change in the length of the biasing assemblies 614 or a change in the biasing force.

Figure 59:
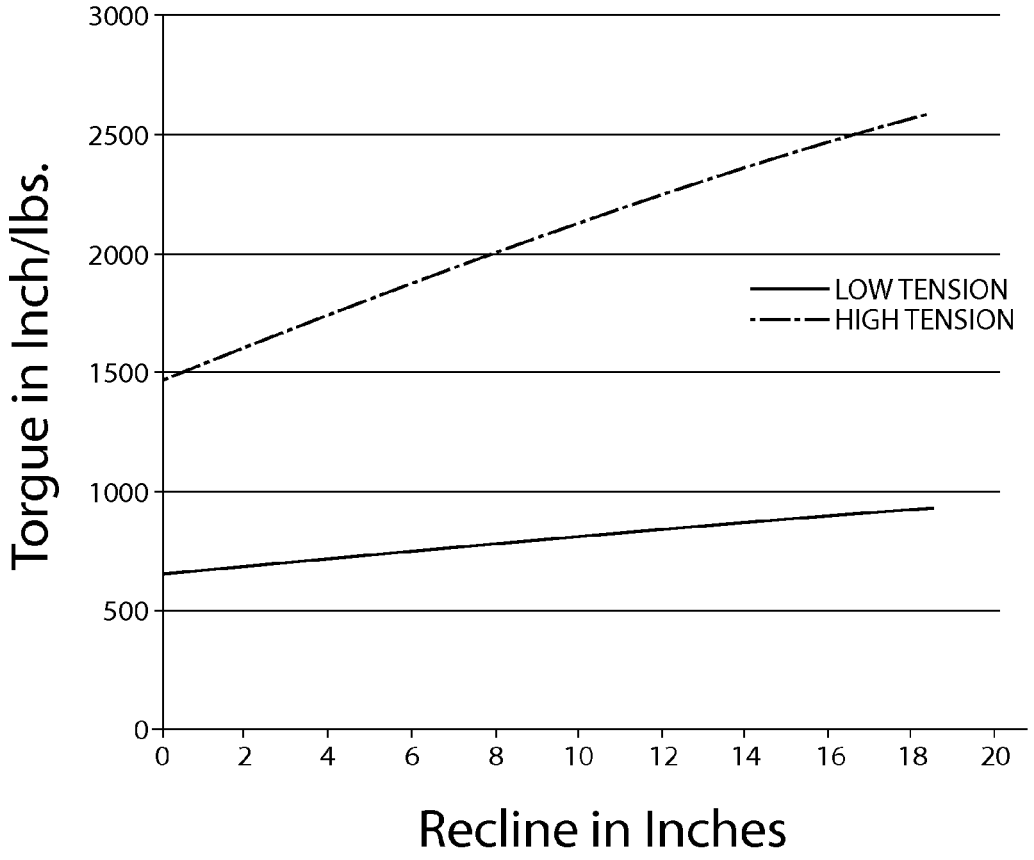
FIG. 59 is a chart of torque vs. amount of recline for low and high tension settings.

FIG. 59 is a graph of the amount of torque exerted about the second pivot point 518 forcing the back support structure 542 from the reclined position towards the upright position as the back support structure 542 is moved between the reclined and upright positions. In the illustrated example, the biasing assemblies 614 exert a torque about the second pivot point 518 of about 652 inch-pounds when the back support structure 542 is in the upright position and the moment arm shift assembly 638 is in the low tension setting, and of about 933 inch-pounds when the back support structure 542 is in the reclined position and the moment arm shift assembly 638 is in the low tension setting, resulting in a change of approximately 43%. Likewise, the biasing assemblies 614 exert a torque about the second pivot point 518 of about 1.47E+03 inch-pounds when the back support structure 542 is in the upright position and the moment arm shift assembly 638 is in the high tension setting, and of about 2.58E+03 inch-pounds when the back support structure 542 is in the reclined position and the moment arm shift assembly 638 is in the high tension setting, resulting in a change of approximately 75%. This significant change in the amount of torque exerted by the biasing assemblies 614 between the low tension setting and the high tension setting of the moment arm shift assembly 638 as the back support structure 542 is moved between the upright and reclined positions allows the overall chair assembly 10 to provide proper forward back support to users of varying height and weight.

The adjustment assist assembly 648 (FIGS. 53 and 54) assists an operator in moving the moment arm shift assembly 638 from the high-tension setting to the low-tension setting. The adjustment assist assembly 648 includes a coil spring 738 secured to the front wall 504 of the base structure 502 by a mounting structure 740, and a catch member 742 that extends about the shaft 632 fixed with the linkage arms 664, and that includes a catch portion 744 defining an aperture 746 that catches a free end 748 of the coil spring 738. The coil spring 738 exerts a force F on the catch member 742 and the shaft 632 in an upward vertical direction, and on the shaft 632 that is attached to the linkage arms 664, thereby reducing the amount of input force the user must exert on the control input assembly 500 to move the moment arm shift assembly 638 from the low-tension setting to the high-tension setting.

Figure 60:
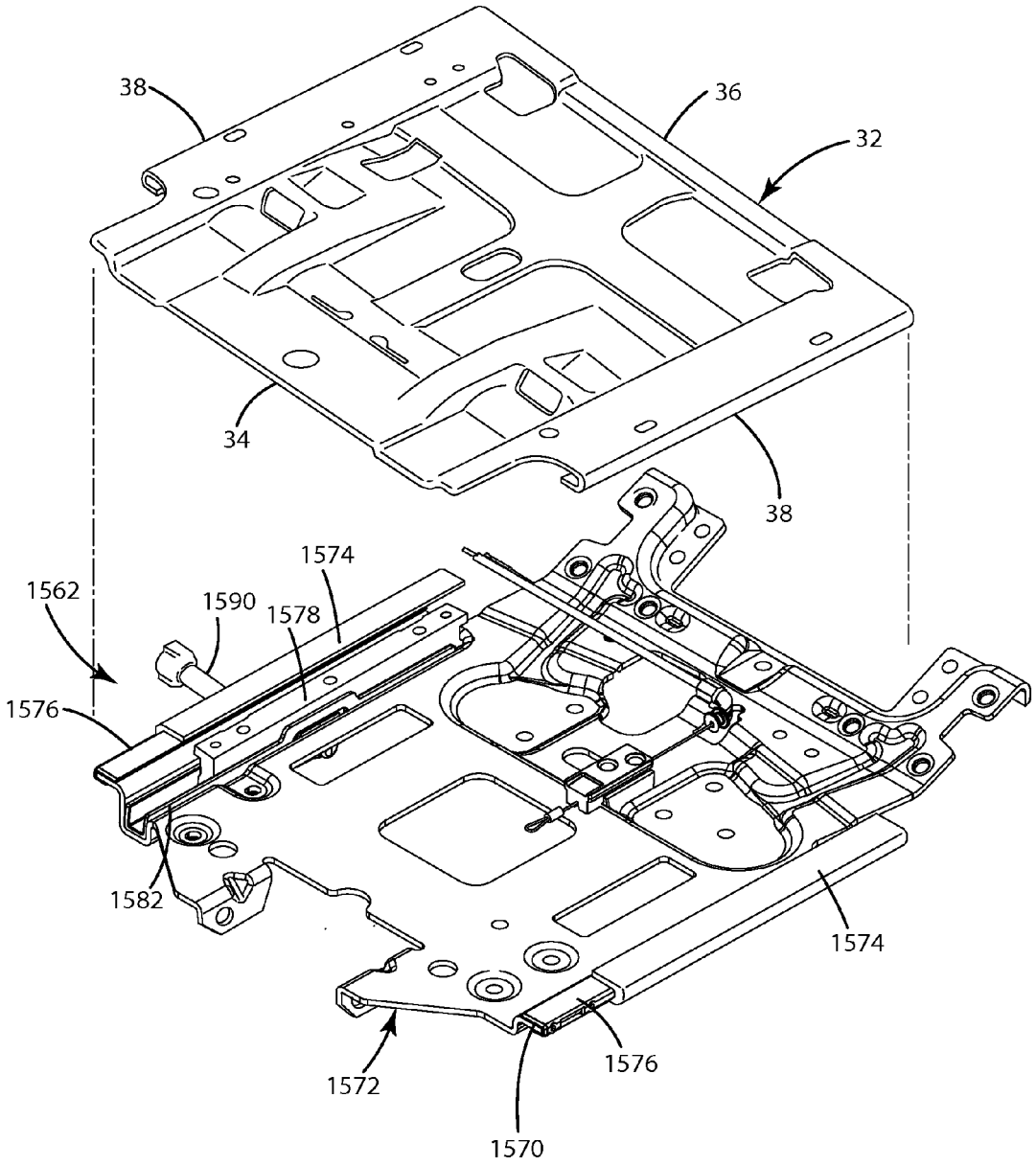
FIG. 60 is a perspective view of a direct drive assembly with the seat support plate exploded therefrom.
Figure 61:
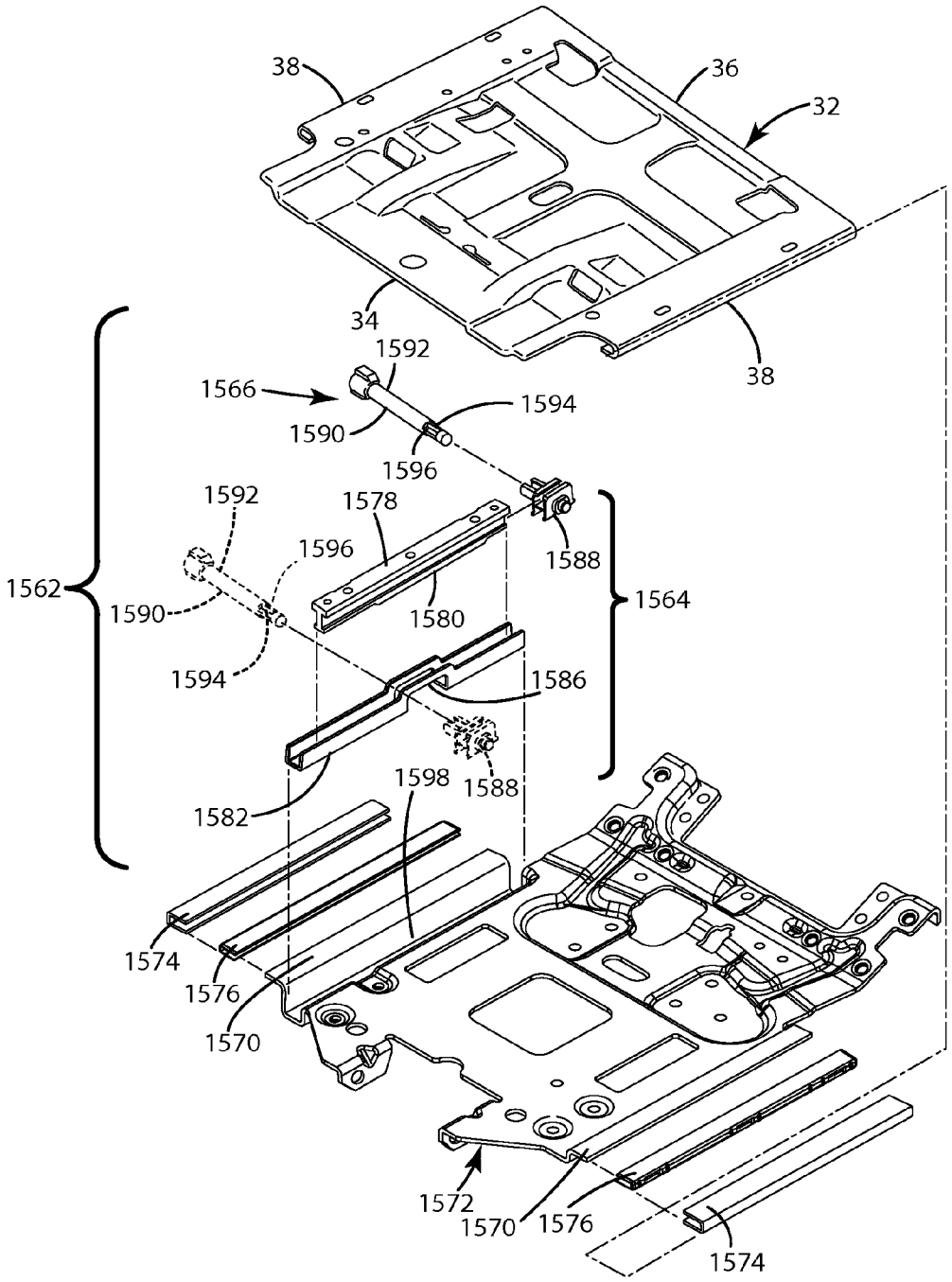
FIG. 61 is an exploded perspective view of the direct drive assembly.

As noted above, the seat assembly 16 (FIG. 3) is longitudinally shiftable with respect to the control assembly 14 between a retracted position C and an extended position D. As best illustrated in FIGS. 60 and 61, a direct drive assembly 1562 includes a drive assembly 1564 and a linkage assembly 1566 that couples the control input assembly 500 with the drive assembly 1564, thereby allowing a user to adjust the linear position of the seat assembly 16 with respect to the control assembly 14. In the illustrated example, the seat support plate 32 (FIG. 42) includes the C-shaped guiderails 38 which wrap about and slidably engage corresponding guide flanges 1570 of a control plate 1572 of the control assembly 14. A pair of C-shaped, longitudinally extending connection rails 1574 are positioned within the corresponding guiderails 38 and are coupled with the seat support plate 32. A pair of C-shaped bushing members 1576 extend longitudinally within the connection rails 1574 and are positioned between the connection rails 1574 and the guide flanges 1570. The drive assembly 1564 includes a rack member 1578 having a plurality of downwardly extending teeth 1580. The drive assembly 1564 further includes a rack guide 1582 having a C-shaped cross-sectional configuration defining a channel 1584 that slidably receives the rack member 1578 therein. The rack guide 1582 includes a relief 1586 located along the length thereof that matingly receives a bearing member 1588 therein, wherein the bearing member 1588 as illustrated in dashed line shows the assembly alignment between the bearing member 1588 and the relief 1586 of the rack guide 1582, and further wherein the bearing member as illustrated in solid line shows the assembly alignment between the bearing member 1588 and the rack member 1578. Alternatively, the bearing member 1588 may be formed as an integral portion of the rack guide 1582. The drive assembly 1564 further includes a drive shaft 1590 having a first end 1592 universally coupled with the control input assembly 500 and the second end 1594 having a plurality of radially-spaced teeth 1596. In assembly, the seat support plate 32 is slidably coupled with the control plate 1572 as described above, with the rack member 1578 being secured to an underside of the seat support plate 32 and the rack guide 1582 being secured within an upwardly opening channel 1598 of the control plate 1572. In operation, an input force exerted by the user to the control input assembly 500 is transferred to the drive assembly 1564 via the linkage assembly 1566, thereby driving the teeth 1596 of the drive shaft 1590 against the teeth 1580 of the rack member 1578 and causing the rack member 1578 and the seat support plate 32 to slide with respect to the rack guide 1582 and the control plate 1572.

Figure 62:
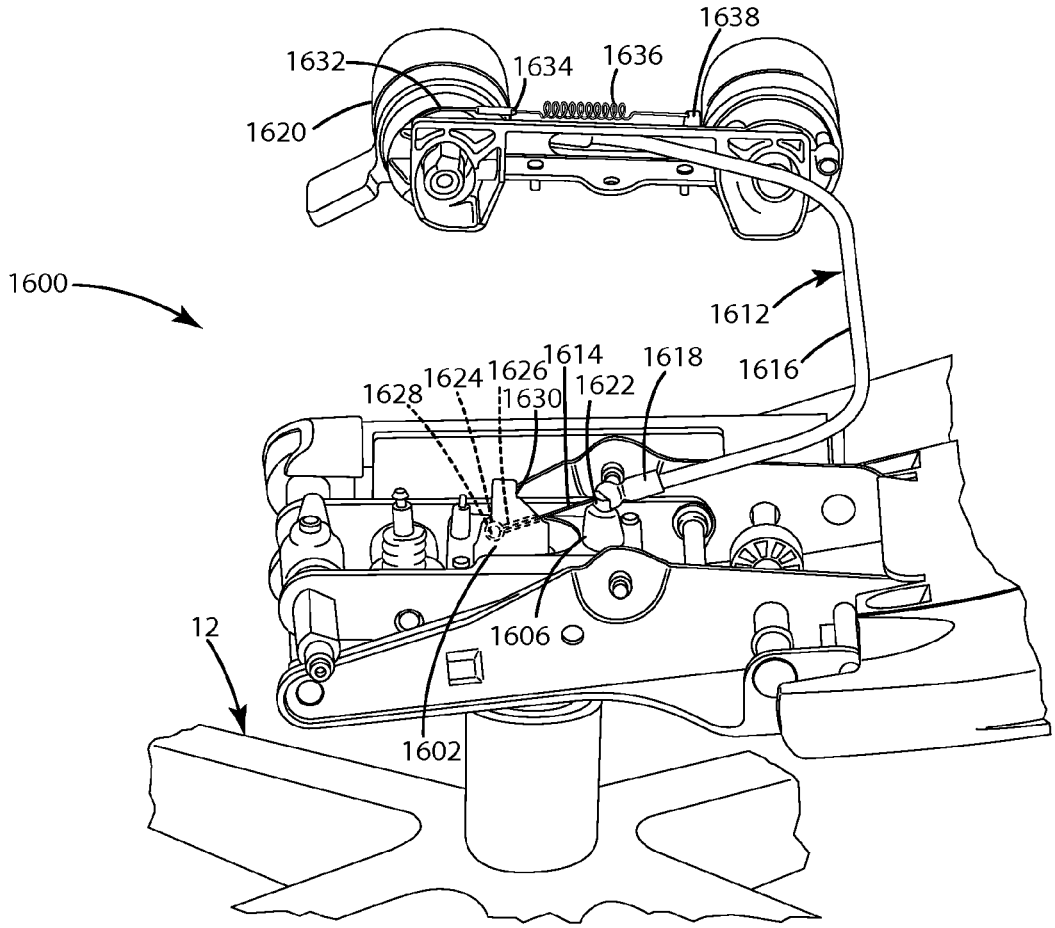
FIG. 62 is a perspective view of a vertical height control assembly.
Figure 63:
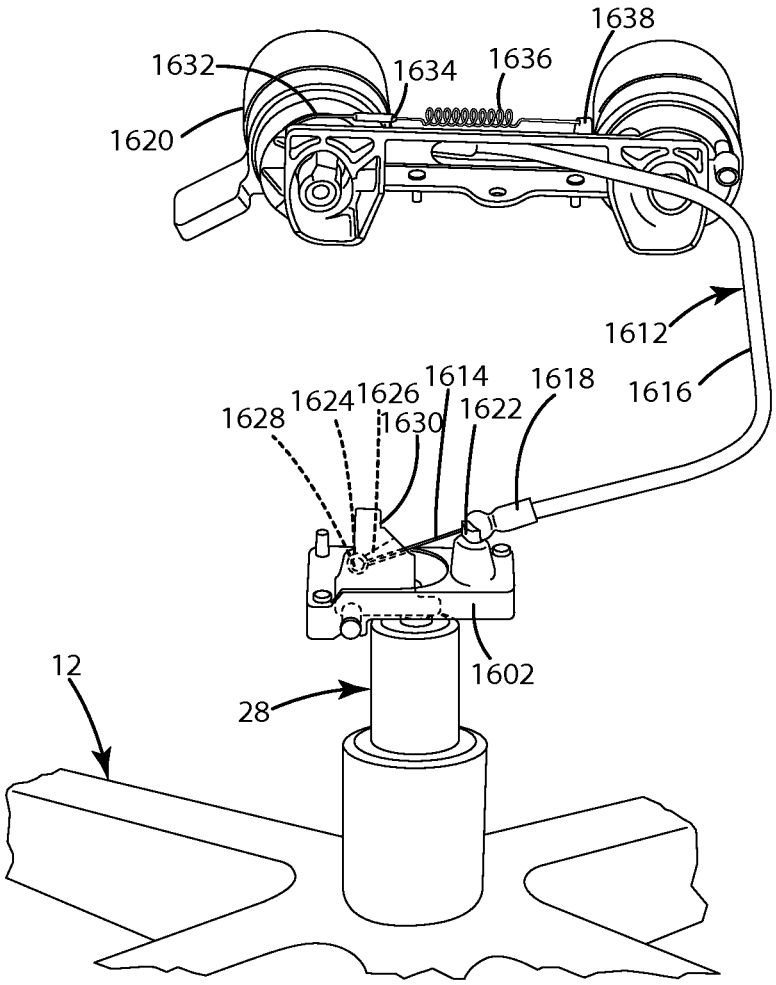
FIG. 63 is a perspective view of the vertical height control assembly.
Figure 64:
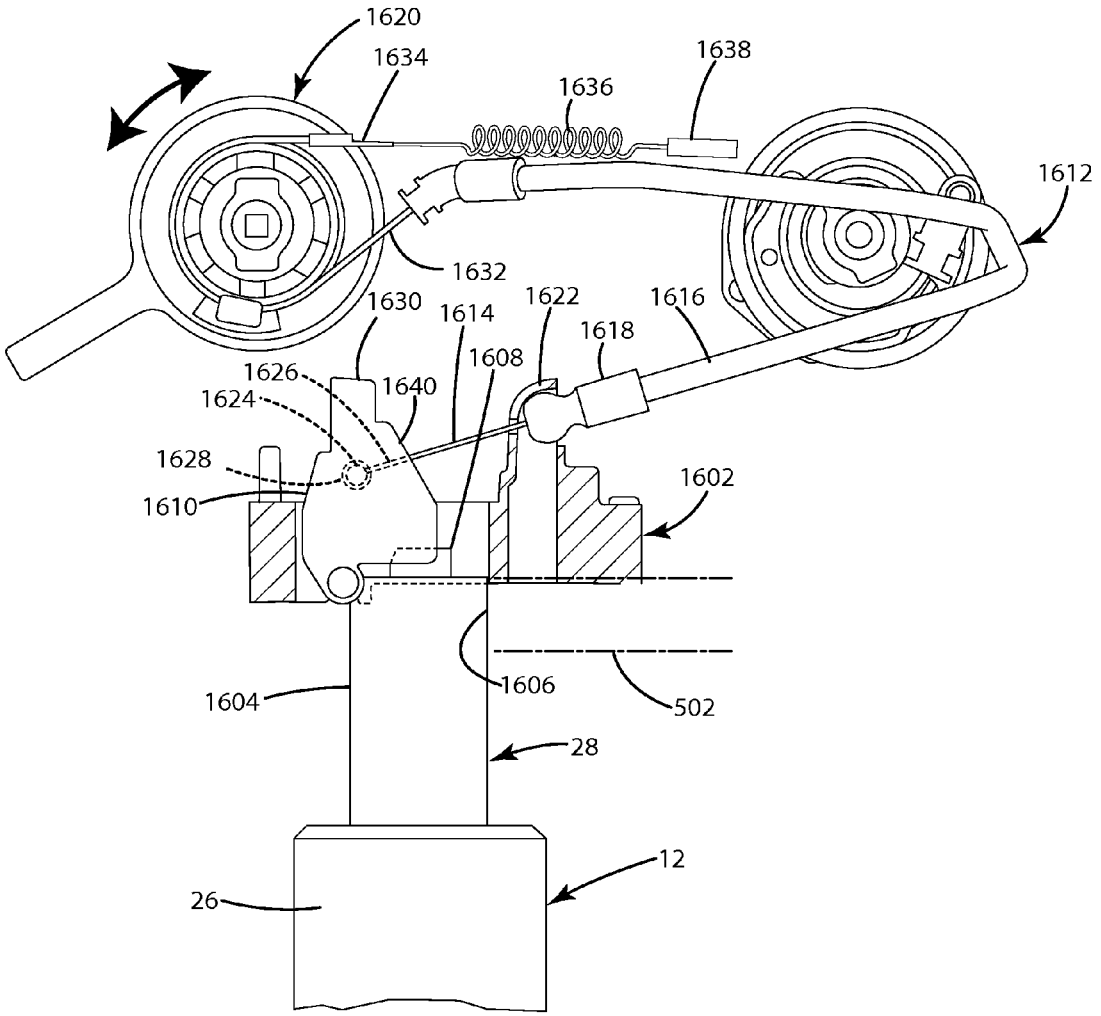
FIG. 64 is a side elevational view of the vertical height control assembly.
Figure 65:
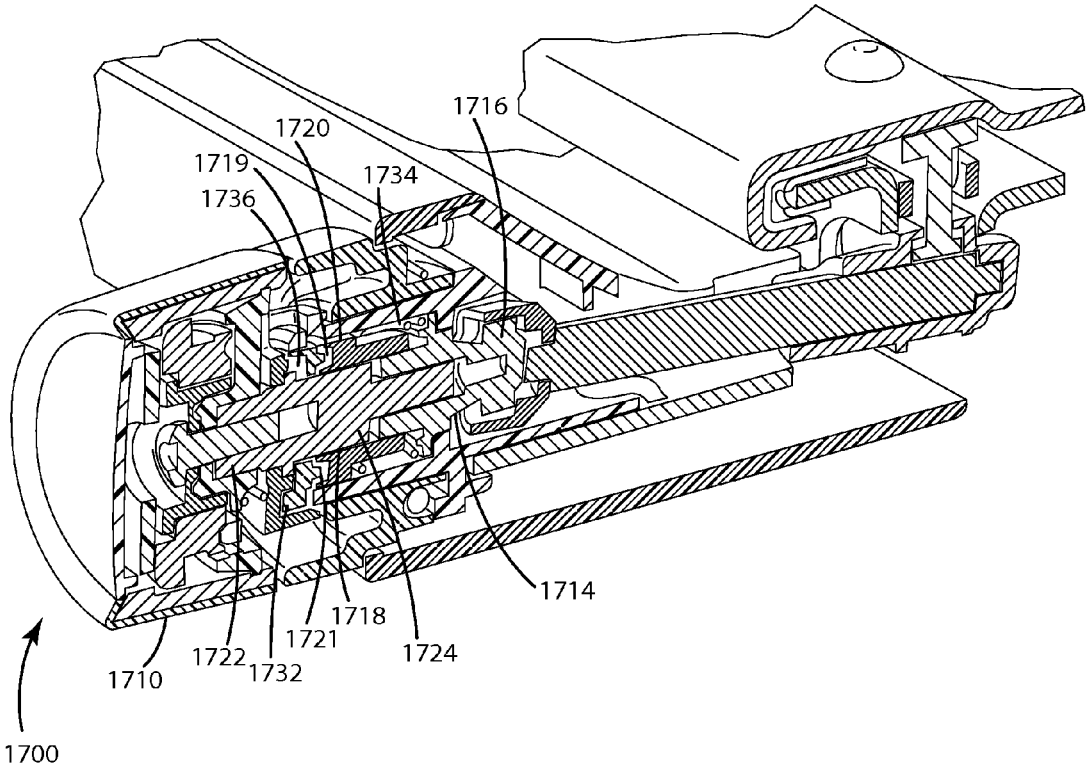
FIG. 65 is a cross-sectional perspective view of a first input control assembly taken along the line LXV-LXV, FIG. 42.

With further reference to FIGS. 62-64, the chair assembly 10 includes a height adjustment assembly 1600 that permits vertical adjustment of seat 16 and back 18 relative to the base assembly 12. Height adjustment assembly 1600 includes the pneumatic cylinder 28 that is vertically disposed in central column 26 of base assembly 12 in a known manner.

A bracket structure 1602 is secured to the housing or base structure 502, and an upper end portion 1604 of the pneumatic cylinder 28 is received in an opening 1606 (FIG. 64) of the base structure 502 in a known manner. The pneumatic cylinder 28 includes an adjustment valve 1608 that can be shifted down to release the pneumatic cylinder 28 to provide for height adjustment. A bell crank 1610 has an upwardly extending arm 1630 and a horizontally extending arm 1640 that is configured to engage the release valve 1608 of the pneumatic cylinder 28. The bell crank 1610 is rotatably mounted to the bracket 1602. A cable assembly 1612 operably interconnects the bell crank 1610 with an adjustment wheel/lever 1620. The cable assembly 1612 includes an inner cable 1614 and an outer cable or sheath 1616. The outer sheath 1616 includes a spherical ball fitting 1618 that is rotatably received in a spherical socket 1622 formed in the bracket 1602. A second ball fitting 1624 is connected to an end 1626 of the inner cable 1614. A second ball fitting 1624 is rotatably received in a second spherical socket 1628 of the upwardly extending arm 1630 of the bell crank 1610 to permit rotational movement of the cable end during height adjustment.

A second or outer end portion 1632 of the inner cable 1614 wraps around the wheel 1620, and an end fitting 1634 is connected to the inner cable 1614. A tension spring 1636 is connected to the end fitting 1634 and to the seat structure at point 1638. The spring 1636 generates tension on the inner cable 1614 in the same direction that the cable 1614 is shifted to rotate the bell crank 1610 when the valve 1608 is being released. Although the spring 1636 does not generate enough force to actuate the valve 1608, the spring 1636 does generate enough force to bias the arm 1640 of the bell crank 1610 into contact with the valve 1608. In this way, lost motion or looseness that could otherwise exist due to tolerances in the components is eliminated. During operation, a user manually rotates the adjustment wheel 1620, thereby generating tension on the inner cable 1614. This causes the bell crank 1610 to rotate, causing the arm 1640 of the bell crank 1610 to press against and actuate the valve 1608 of the pneumatic cylinder 28. An internal spring (not shown) of the pneumatic cylinder 28 biases the valve 1608 upwardly, causing the valve 1608 to shift to a non-actuated position upon release of the adjustment wheel 1620.

Figures 66A, 66B:
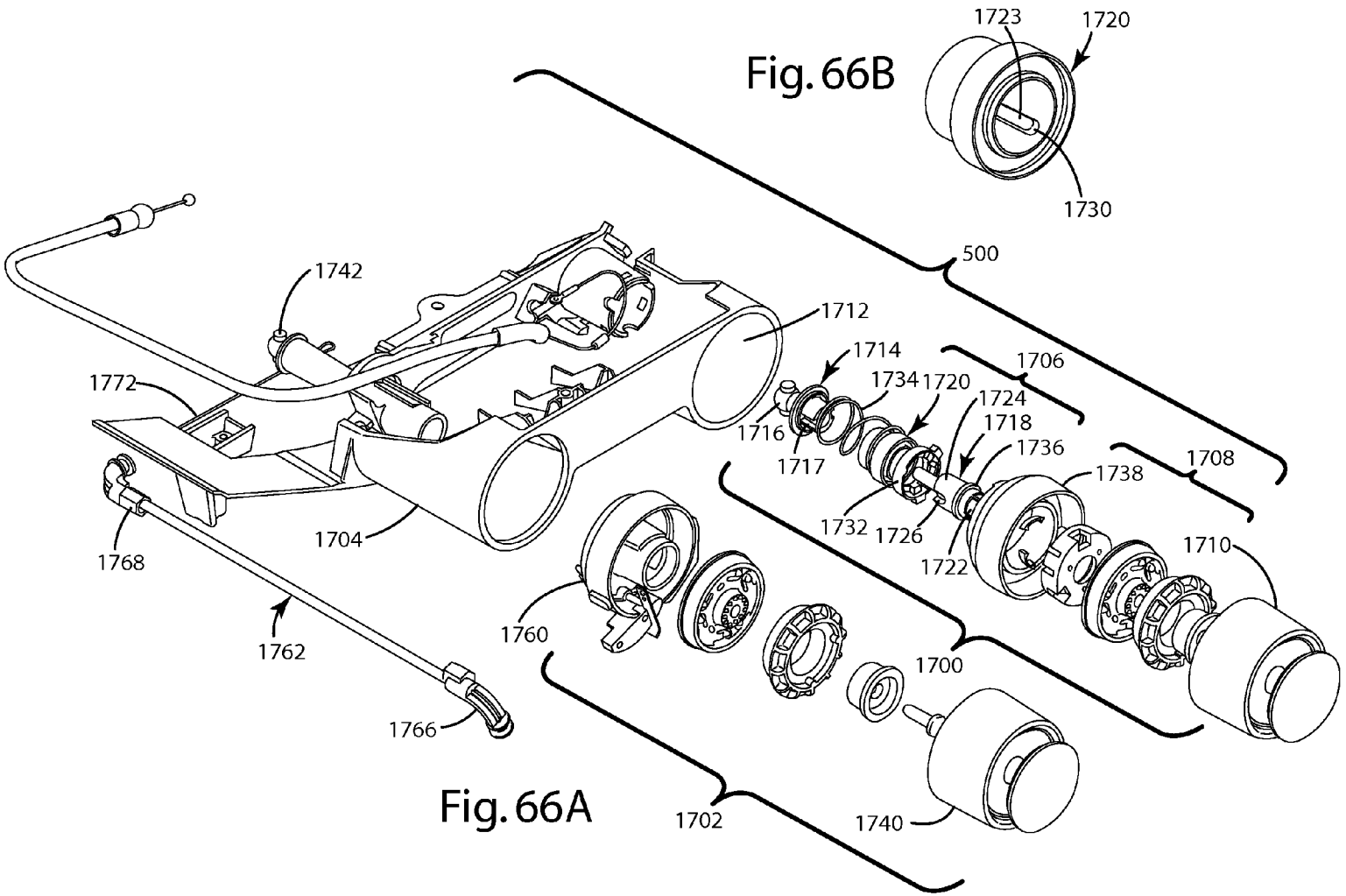
FIG. 66A is an exploded perspective view of a control input assembly.
FIG. 66B is an enlarged perspective view of a clutch member of a first control input assembly.
Figure 66C:
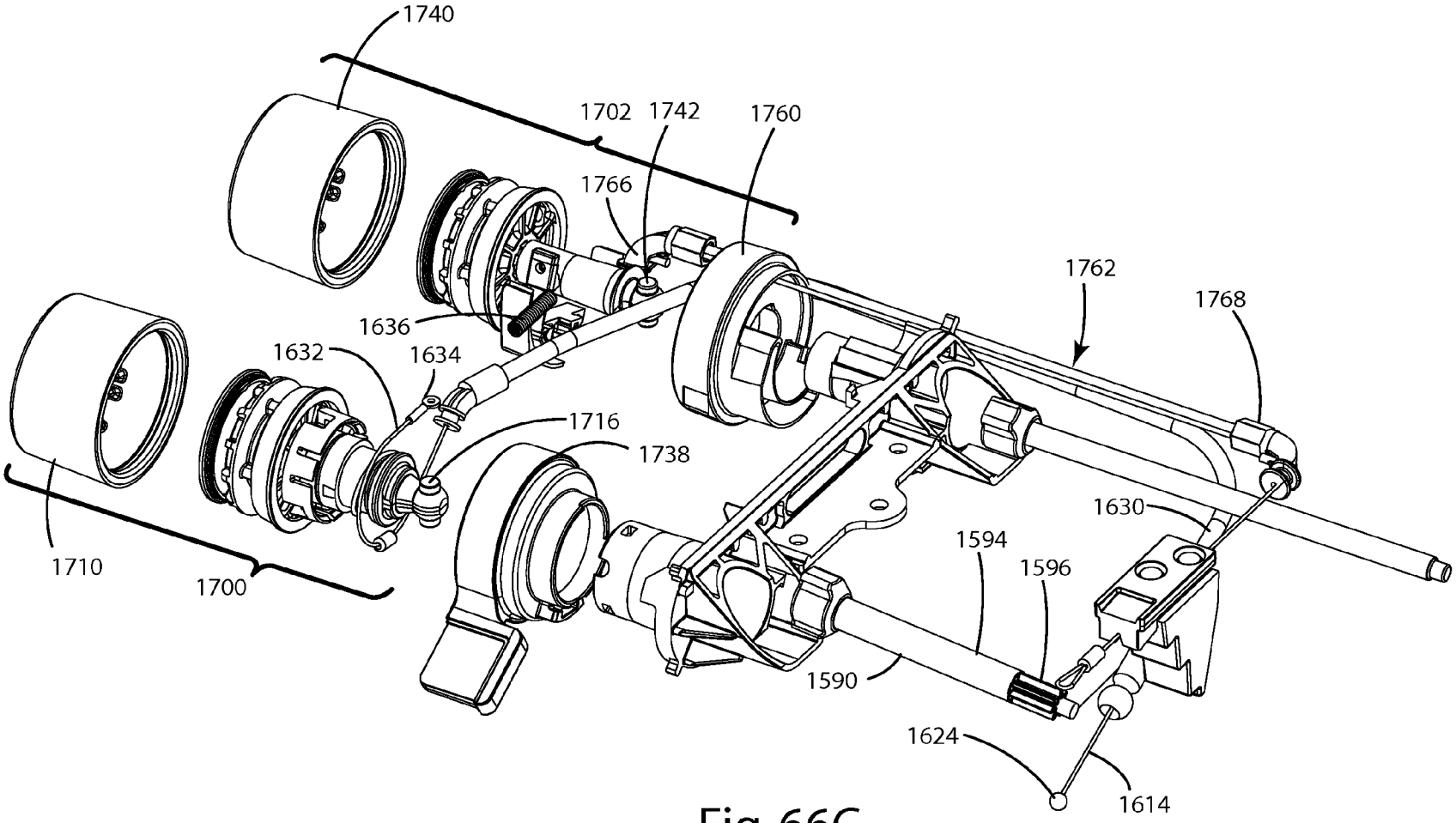
FIG. 66C is an exploded perspective view of the control input assembly.

The control input assembly 500 (FIGS. 42 and 65-67) comprises a first control input assembly 1700 and a second control input assembly 1702 each adapted to communicate inputs from the user to the chair components and features coupled thereto, and housed within a housing assembly 1704. The control input assembly 500 includes an anti-back drive assembly 1706, an overload clutch assembly 1708, and a knob 1710. The anti-back drive mechanism or assembly 1706 that prevents the direct drive assembly 1562 (FIGS. 60 and 61) and the seat assembly 16 from being driven between the retracted and extended positions C, D without input from the control assembly 1700. The anti-back drive assembly 1706 is received within an interior 1712 of the housing assembly 1704 and includes an adaptor 1714 that includes a male portion 1716 of a universal adaptor coupled to the second end 1594 of the drive shaft 1590 (FIG. 61) at one end thereof, and including a spline connector 1717 at the opposite end. A cam member 1718 is coupled with the adaptor 1714 via a clutch member 1720. Specifically, the cam member 1718 includes a spline end 1722 coupled for rotation with the knob 1710, and a cam end 1724 having an outer cam surface 1726. The clutch member 1720 (FIG. 66B) includes an inwardly disposed pair of splines 1723 that slidably engage the spline connector 1717 having a cam surface 1730 that cammingly engages the outer cam surface 1726 of the cam member 1718, as described below. The clutch member 1720 has a conically-shaped clutch surface 1719 that is engagingly received by a locking ring 1732 that is locked for rotation with respect to the housing assembly 1704 and includes a conically-shaped clutch surface 1721 corresponding to the clutch surface 1719 of the clutch member 1720, and cooperating therewith to form a cone clutch. A coil spring 1734 biases the clutch member 1720 towards engaging the locking ring 1732.

Without input, the biasing spring 1734 forces the conical surface of the clutch member 1720 into engagement with the conical surface of the locking ring 1732, thereby preventing the "back drive" or adjustment of the seat assembly 16 between the retracted and extended positions C, D, simply by applying a rearward or forward force to the seat assembly 16 without input from the first control input assembly 1700. In operation, an operator moves the seat assembly 16 between the retracted and extended positions C, D by actuating the direct drive assembly 1562 via the first control input assembly 1700. Specifically, the rotational force exerted on the knob 1710 by the user is transmitted from the knob 1710 to the cam member 1718. As the cam member 1718 rotates, the outer cam surface 1726 of the cam member 1718 acts on the cam surface 1730 of the clutch member 1720, thereby overcoming the biasing force of the spring 1734 and forcing the clutch member 1720 from an engaged position, wherein the clutch member 1720 disengages the locking ring 1732. The rotational force is then transmitted from the cam member 1718 to the clutch member 1720, and then to the adaptor 1714 which is coupled to the direct drive assembly 1562 via the linkage assembly 1566.

It is noted that a slight amount of tolerance within the first control input assembly 1700 allows a slight movement (or "slop") of the cam member 1718 in the linear direction and rotational direction as the clutch member 1720 is moved between the engaged and disengaged positions. A rotational ring-shaped damper element 1736 comprising a thermoplastic elastomer (TPE), is located within the interior 1712 of the housing 1704, and is attached to the clutch member 1720. In the illustrated example, the damping element 1736 is compressed against and frictionally engages the inner wall of the housing assembly 1704.

The first control input assembly 1700 also includes a second knob 1738 adapted to allow a user to adjust the vertical position of the chair assembly between the lowered position A and the raised position B, as described below.

The second control input assembly 1702 is adapted to adjust the tension exerted on the back assembly 18 during recline, and to control the amount of recline of the back assembly 18. A first knob 1740 is operably coupled to the moment arm shift assembly 638 by the moment arm shift linkage assembly 646. Specifically, the second control input assembly 1702 includes a male universal coupling portion 1742 that couples with the female universal coupler portion 692 (FIGS. 53 and 55) of the shaft 676 of the moment arm shift linkage assembly 646.

Figure 67:
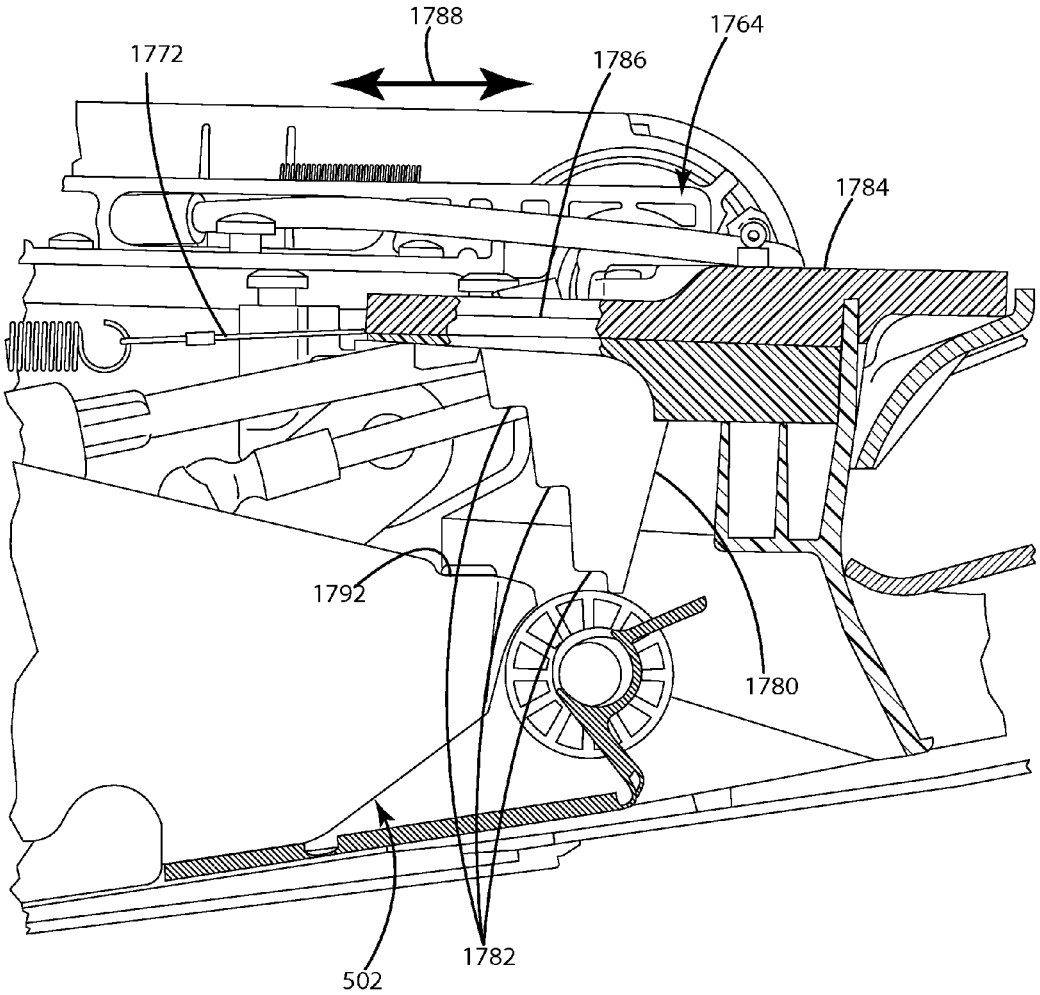
FIG. 67 is a cross-sectional side elevational view of a variable back control assembly taken along the line LXVII-LXVII, FIG. 42.

A second knob 1760 is adapted to adjust the amount of recline of the back assembly 18 via a cable assembly 1762 operably coupling the second knob 1760 to a variable back stop assembly 1764 (FIG. 67). The cable assembly 1762 includes a first cable routing structure 1766, a second cable routing structure 1768 and a cable tube 1770 extending therebetween and slidably receiving an actuator cable 1772 therein. The cable 1772 includes a distal end 1774 that is fixed with respect to the base structure 502, and is biased in a direction 1776 by a coil spring 1778. The variable back stop assembly 1764 includes a stop member 1780 having a plurality of vertically graduated steps 1782, a support bracket 1784 fixedly supported with respect to the seat assembly 16, and a slide member 1786 slidably coupled to the support bracket 1784 to slide in a fore-to-aft direction 1788, and fixedly coupled to the stop member 1780 via a pair of screws 1790. The cable 1772 is clamped between the stop member 1780 and the slide member 1786 such that longitudinal movement of the cable 1772 causes the stop member 1780 to move in the fore-and-aft direction 1788. In operation, a user adjusts the amount of back recline possible by adjusting the location of the stop member 1780 via an input to the second knob 1760. The amount of back recline available is limited by which select step 1782 of the stop member 1780 contacts a rear edge 1792 of the base structure 502 as the back assembly 18 moves from the upright position toward the reclined position.

Figure 68:
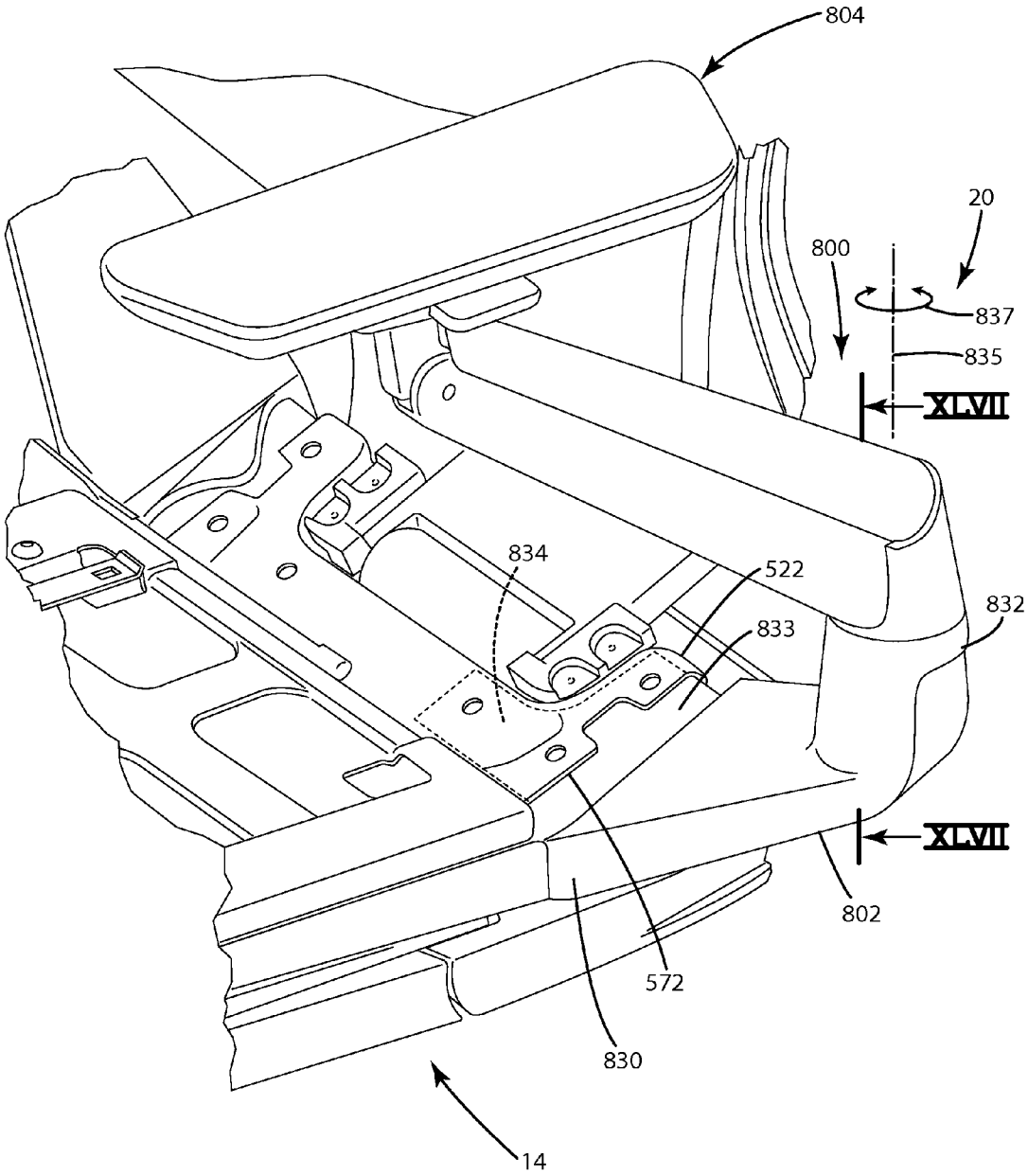
FIG. 68 is a perspective view of an arm assembly.
Figure 69:
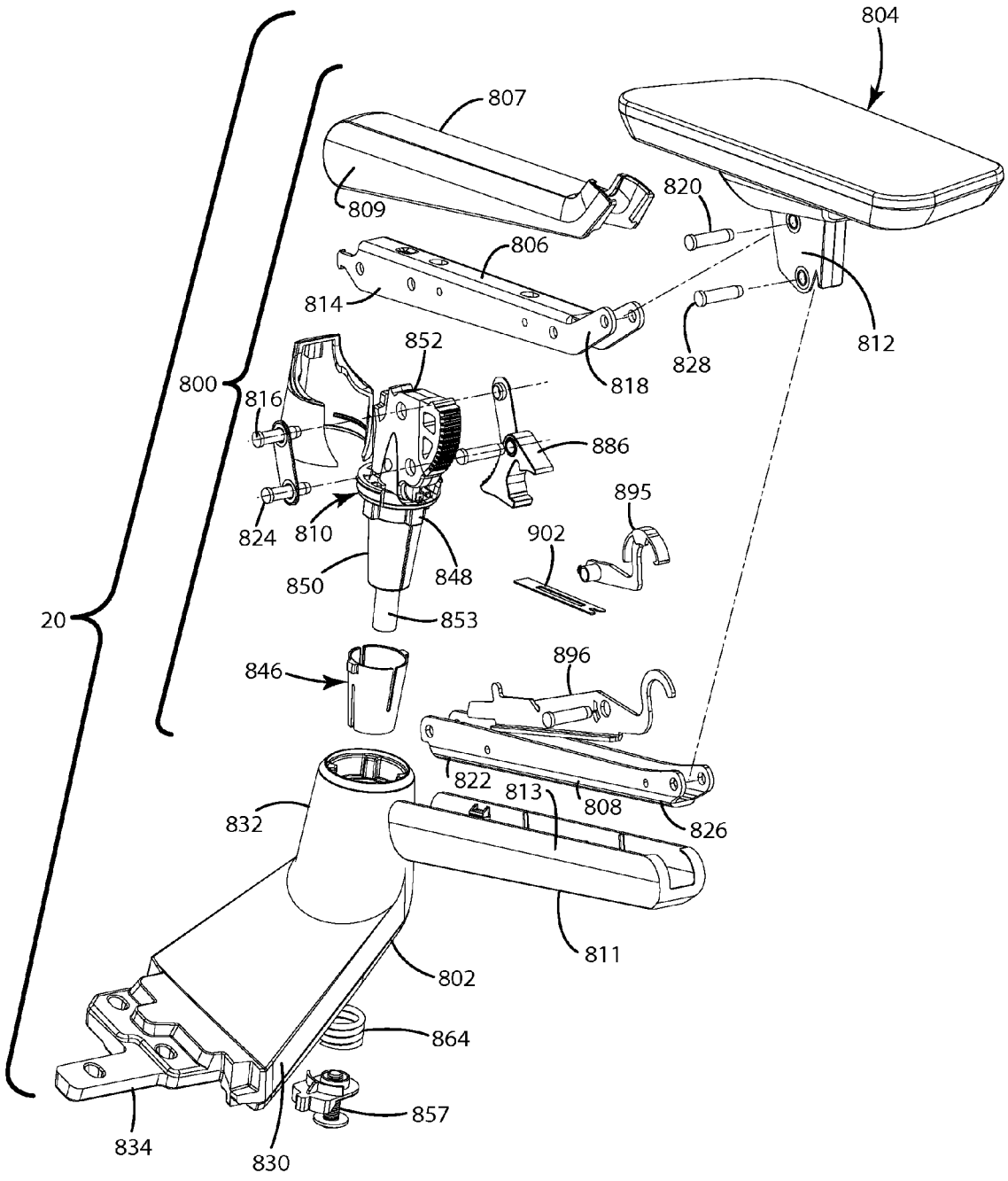
FIG. 69 is an exploded perspective view of the arm assembly.
Figure 70:
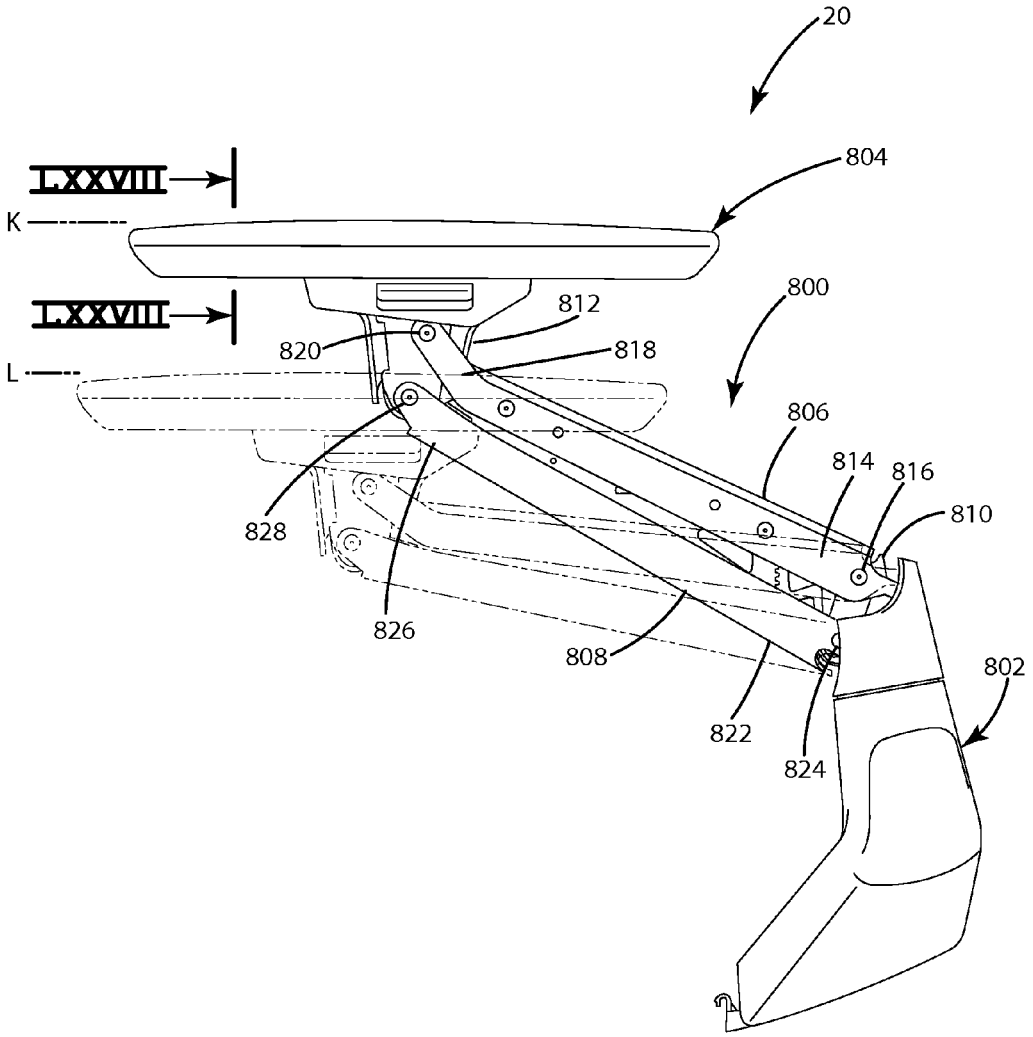
FIG. 70 is a side elevational view of the arm assembly in an elevated position and a lowered position in dashed line.

Each arm assembly 20 (FIGS. 68-70) includes an arm support assembly 800 pivotably supported from an arm base structure 802, and adjustably supporting an armrest assembly 804. The arm support assembly 800 includes a first arm member 806, a second arm 808, an arm support structure 810, and an armrest assembly support member 812 that cooperate to form a four-bar linkage assembly. In the illustrated example, the first arm member 806 has a U-shaped cross-sectional configuration and includes a first end 814 pivotably coupled to the arm support structure 810 for pivoting about a pivot point 816, and a second end 818 pivotably coupled to the armrest assembly support member 812 for pivoting movement about a pivot point 820. The second arm member 808 has a U-shaped cross-sectional configuration and includes a first end 822 pivotably coupled to the arm support structure 810 for pivoting about a pivot point 824, and a second end 826 pivotably coupled to the armrest assembly support member 812 for pivoting about a pivot point 828. As illustrated, the four-bar linkage assembly of the arm support assembly 800 allows the armrest assembly 804 to be adjusted between a fully raised position K and a fully lowered position L, wherein the distance between the fully raised position K and fully lowered position L is preferably at least about 4 inches. Each arm further includes a first arm cover member 807 having a U-shaped cross-sectional configuration and a first edge portion 809, and a second cover arm member 811 having a U-shaped cross-sectional configuration and a second edge 813, wherein the first arm member 806 is housed within the first arm cover member 807 and the second arm member 808 is housed within the second arm cover member 811, such that the second edge portion 813 and the first edge portion 809 overlap one another.

Each arm base structure 802 includes a first end 830 connected to the control assembly 14, and a second end 832 pivotably supporting the arm support structure 810 for rotation of the arm assembly 20 about a vertical axis 835 in a direction 837. The first end 830 of the arm base structure 802 includes a body portion 833 and a narrowed bayonet portion 834 extending outwardly therefrom. In assembly, the body portion 833 and bayonet portion 834 of the first end 830 of the arm base structure 802 are received between the control plate 572 and the seat support structure 282, and are fastened thereto by a plurality of mechanical fasteners (not shown) that extend through the body portion 833 and bayonet portion 834 of the arm-base structure 802, the control plate 572 and the seat support structure 282. The second end 832 of the arm base structure 802 pivotably receives the arm support structure 810 therein.

Figure 71:
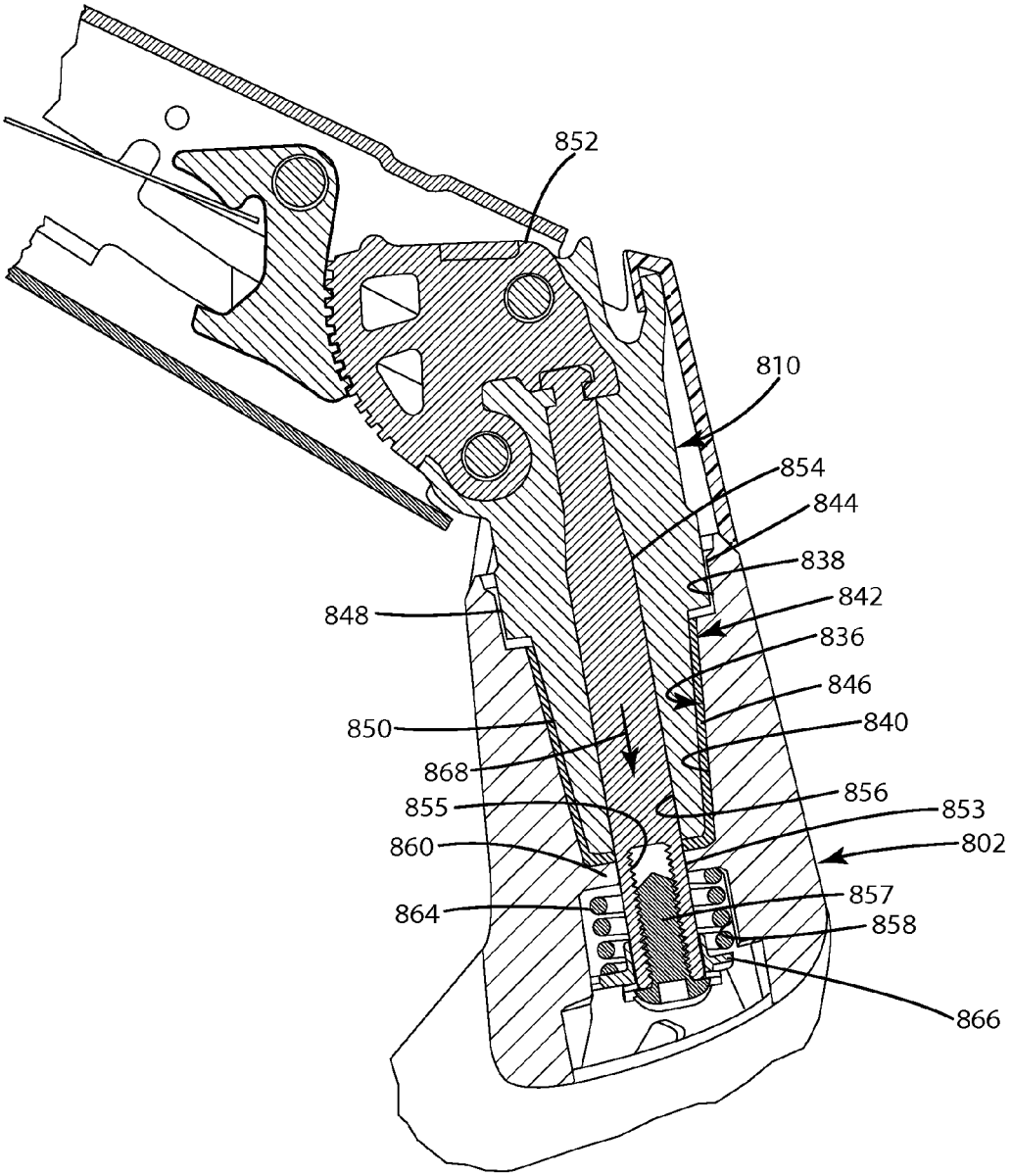
FIG. 71 is a partial cross-sectional view of the arm assembly.
Figure 72:
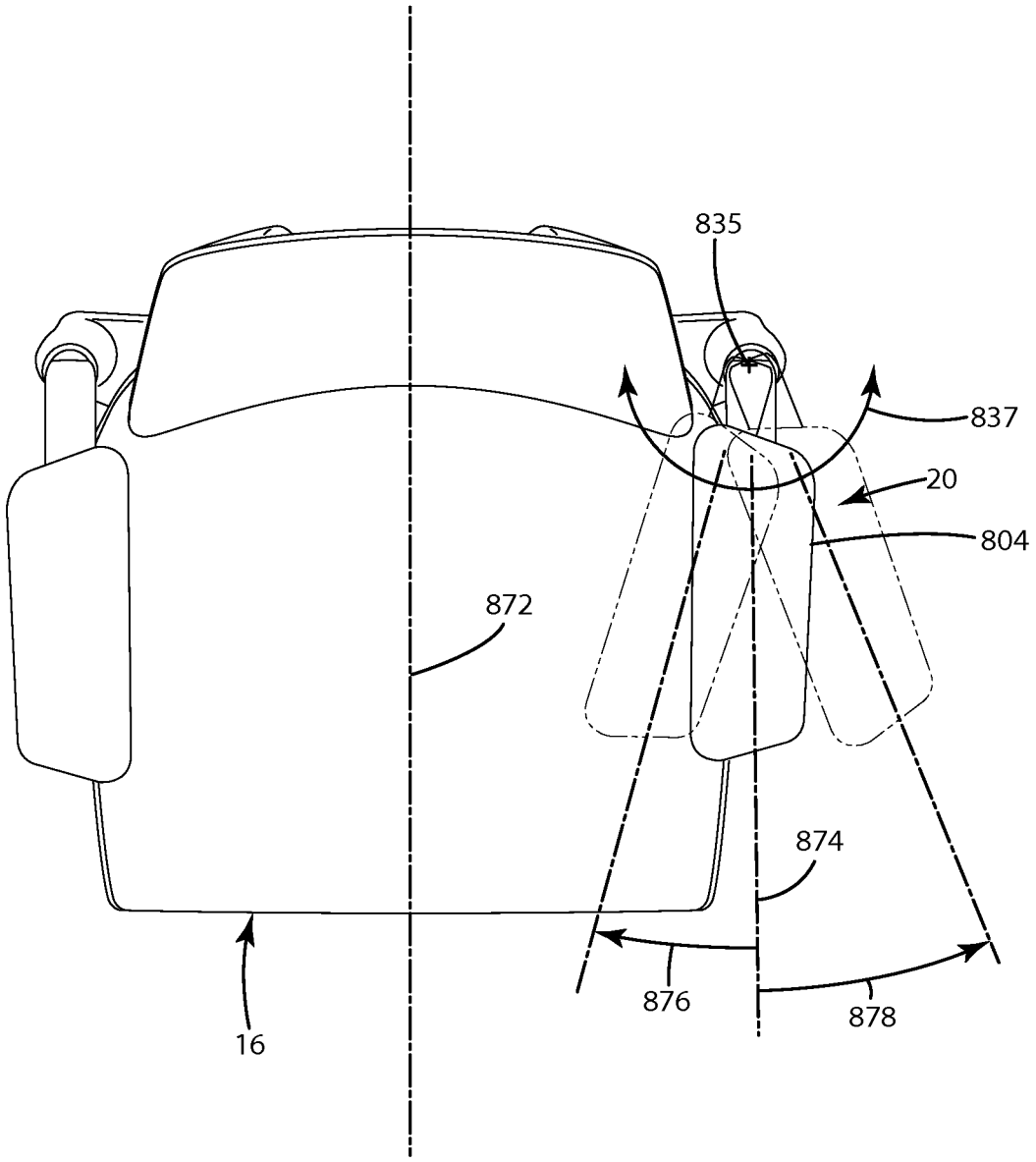
FIG. 72 is a top plan view of the chair assembly showing the arm assembly in an in-line position and angled positions in dashed line.

As best illustrated in FIG. 71, the arm base structure 802 includes an upwardly opening bearing recess 836 having a cylindrically-shaped upper portion 838 and a conically-shaped lower portion 840. A bushing member 842 is positioned within the bearing recess 836 and is similarly configured as the lower portion 840 of the bearing recess 836, including a conically-shaped portion 846. The arm support structure 810 includes a lower end having a cylindrically-shaped upper portion 848 and a conically-shaped lower portion 850 received within the lower portion 846 of the bushing member 842. An upper end 852 of the arm support structure 810 is configured to operably engage within a vertical locking arrangement, as described below. A pin member 854 is positioned within a centrally located and axially extending bore 856 of the arm support structure 810. In the illustrated example, the pin member 854 is formed from steel, while the upper end 852 of the arm support structure 810 comprises a powdered metal that is formed about a proximal end of the pin member 854, and wherein the combination of the upper end 852 and the pivot pin 854 is encased within an outer aluminum coating. A distal end 853 of the pin member 854 includes an axially extending threaded bore 855 that threadably receives an adjustment screw 857 therein. The arm base structure 802 includes a cylindrically-shaped second recess separated from the bearing recess 836 by a wall 860. A coil spring 864 is positioned about the distal end 853 of the pin member 854 within the second recess 858, and is trapped between the wall 860 of the arm base structure 802 and a washer member 866, such that the coil spring 864 exerts a downward force 868 in the direction of arrow on the pin member 854, thereby drawing the lower end of the arm support structure 810 into close frictional engagement with the bushing member 842, and the bushing member 842 into close frictional engagement with the bearing recess 836 of the arm base structure 802. The adjustment screw 857 may be adjusted so as to adjust the amount of frictional interference between the arm support structure 810, the bushing member 842 and the arm base structure 802 and increasing the force required to be exerted by the user to move the arm assembly 20 about the pivot access 835 in pivot direction 837. The pivot connection between the arm support structure 810 and the arm base structure 802 allows the overall arm assembly 800 to be pivoted inwardly in a direction 876 (FIG. 72) from a line 874 extending through pivot access 835 and extending parallel with a center line axis 872 of the seat assembly 16, and outwardly from the line 874 in a direction 878. Preferably, the arm assembly 20 pivots at least 17° in the direction 876 from the line 874, and at least 22° in the direction 878 from the line 874.

Figure 73:
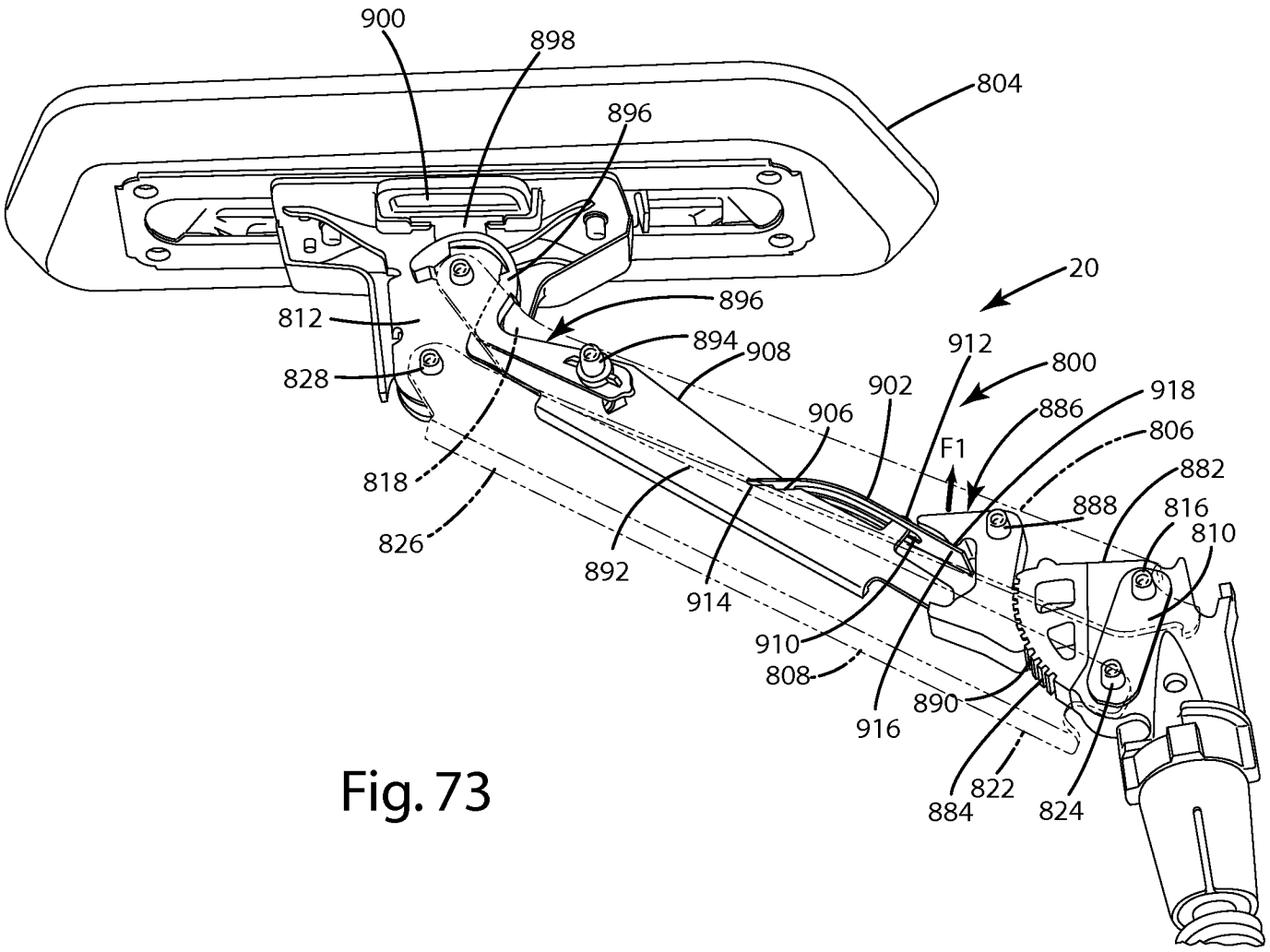
FIG. 73 is a perspective view of an arm assembly including a vertical height adjustment lock.
Figure 74:
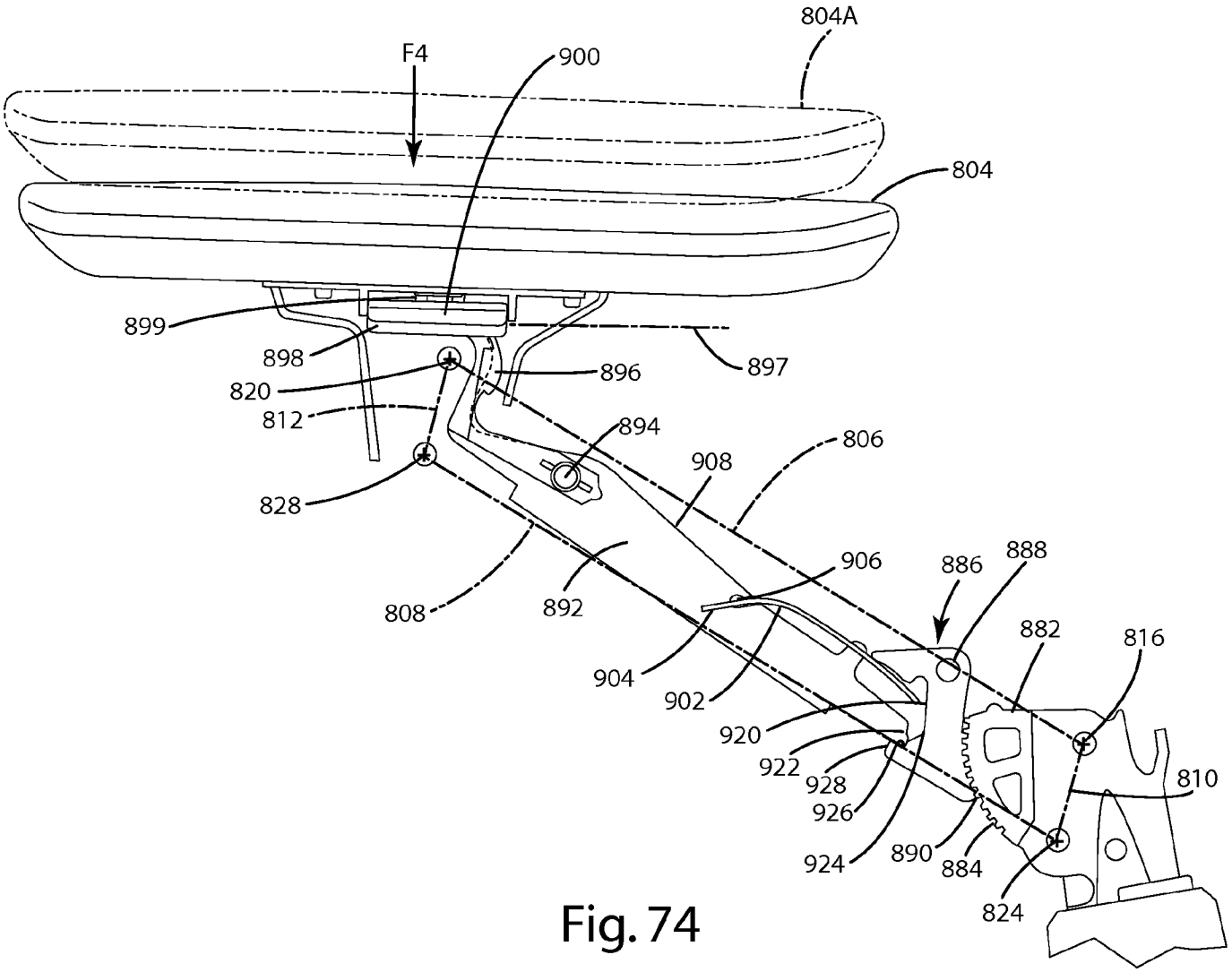
FIG. 74 is a side elevational view of an arm assembly including a vertical height adjustment lock.
Figure 75:
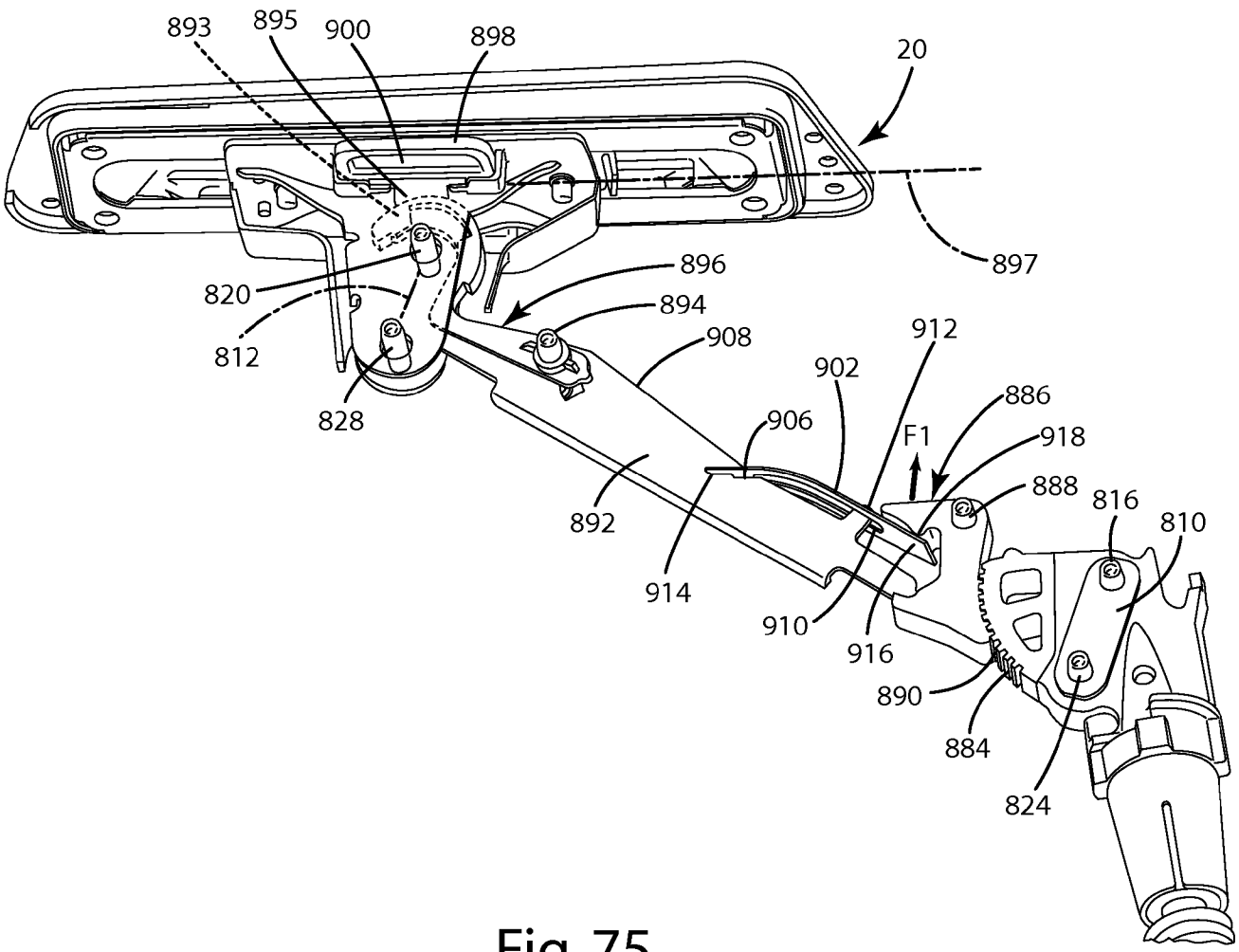
FIG. 75 is a perspective view of an arm assembly including a vertical height adjustment lock.

With further reference to FIGS. 73-75, vertical height adjustment of the arm rest is accomplished by rotating the four-bar linkage formed by the first arm member 806, the second arm member 808, the arm support structure 810 and the arm rest assembly support member 812. A gear member 882 includes a plurality of teeth 884 that are arranged in an arc about the pivot point 816. A lock member 886 is pivotably mounted to the arm 806 at a pivot point 888, and includes a plurality of teeth 890 that selectively engage the teeth 884 of the gear member 882. When the teeth 884 and 890 are engaged, the height of the arm rest 804 is fixed due to the rigid triangle formed between the pivot points 816, 824 and 888. If a downward force F4 is applied to the armrest, a counter clockwise (FIG. 74) moment is generated on the lock member 886. This moment pushes the teeth 890 into engagement with the teeth 884, thereby securely locking the height of the armrest.

An elongated lock member 892 is rotatably mounted to the arm 806 at a pivot point 894. A low friction polymer bearing member 896 is disposed over upper curved portion 893 of the elongated lock member 892. As discussed in more detail below, a manual release lever or member 898 includes a pad 900 that can be shifted upwardly by a user to selectively release the teeth 890 of the lock member 886 from the teeth 884 of the gear member 882 to permit vertical height adjustment of the armrest.

A leaf spring 902 includes a first end 904 that engages a notch 906 formed in an upper edge 908 of the elongated locking member 892. Thus, the leaf spring 902 is cantilevered to the locking member 892 at notch 906. An upwardly-extending tab 912 of the elongated locking member 892 is received in an elongated slot 910 of the leaf spring 902 to thereby locate the spring 902 relative to the locking member 892. The end 916 of the leaf spring 902 bears upwardly (F1) on the knob 918 of the locking member 886, thereby generating a moment tending to rotate the locking member 886 in a clockwise (released) direction (FIG. 75) about the pivot point 888. The leaf spring 902 also generates a clockwise moment on the elongated locking member 892 at the notch 906, and also generates a moment on the locking member 886 tending to rotate the locking member 886 about the pivot point 816 in a clockwise (released) direction. This moment tends to disengage the gears 890 from the gears 884. If the gears 890 are disengaged from the gears 884, the height of the arm rest assembly can be adjusted.

The locking member 886 includes a recess or cut-out 920 (FIG. 74) that receives the pointed end 922 of the elongated locking member 892. The recess 920 includes a first shallow V-shaped portion having a vertex 924. The recess also includes a small recess or notch 926, and a transverse, upwardly facing surface 928 immediately adjacent notch 926.

As discussed above, the leaf spring 902 generates a moment acting on the locking member 886 tending to disengage the gears 890 from the gears 884. However, when the tip or end 922 of the elongated locking member 892 is engaged with the notch 926 of the recess 920 of the locking member 886, this engagement prevents rotational motion of the locking member 886 in a clockwise (released) direction, thereby locking the gears 890 and the gears 884 into engagement with one another and preventing height adjustment of the armrest.

To release the arm assembly for height adjustment of the armrest, a user pulls upwardly on the pad 900 against a small leaf spring 899 (FIG. 74). The release member 898 rotates about an axis 897 that extends in a fore-aft direction, and an inner end 895 of manual release the lever 898 pushes downwardly against the bearing member 896 and the upper curved portion 893 (FIG. 75) of the elongated locking member 892. This generates a downward force causing the elongated locking member 892 to rotate about the pivot point 894. This shifts the end 922 (FIG. 74) of the elongated locking member 892 upwardly so it is adjacent to the shallow vertex 924 of the recess 920 of the locking member 886. This shifting of the locking member 892 releases the locking member 886, such that the locking member 886 rotates in a clockwise (release) direction due to the bias of the leaf spring 902. This rotation causes the gears 890 to disengage from the gears 884 to permit height adjustment of the arm rest assembly.

The arm rest assembly is also configured to prevent disengagement of the height adjustment member while a downward force F4 (FIG. 74) is being applied to the arm rest pad 804. Specifically, due to the four-bar linkage formed by arm members 806, 808, arm support structure 810, and arm rest assembly support member 812, downward force F4 will tend to cause pivot point 820 to move toward pivot point 824. However, the elongated locking member 892 is generally disposed in a line between the pivot point 820 and the pivot point 824, thereby preventing downward rotation of the four-bar linkage. As noted above, downward force F4 causes teeth 890 to tightly engage teeth 884, securely locking the height of the armrest. If release lever 898 is actuated while downward force F4 is being applied to the armrest, the locking member 892 will move, and end 922 of elongated locking member 892 will disengage from notch 926 of recess 920 of locking member 886. However, the moment on locking member 886 causes teeth 890 and 884 to remain engaged even if locking member 892 shifts to a release position. Thus, the configuration of the four-bar linkage and locking members 886 and gear member 882 provides a mechanism whereby the height adjustment of the arm rest cannot be performed if a downward force F4 is acting on the arm rest.

Figure 76:
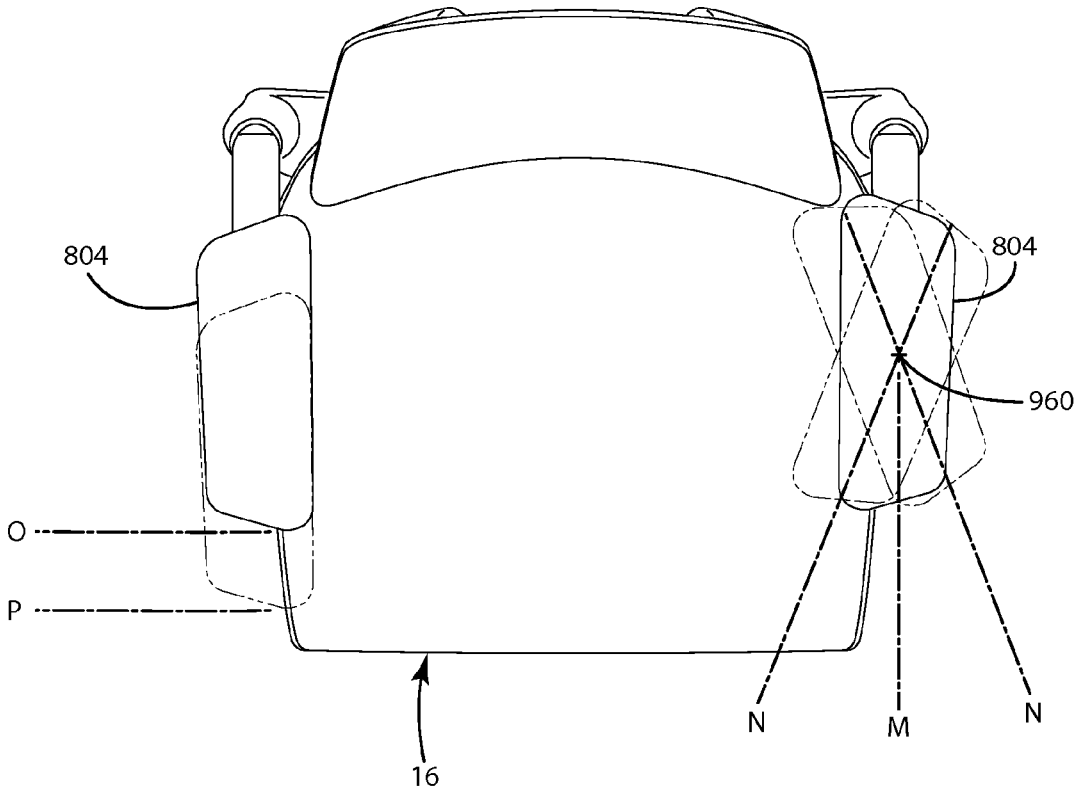
FIG. 76 is a top plan view of the chair assembly showing an arm rest assembly in an in-line position and rotated positions in dashed line, and in a retracted position and an extended position in dashed line.
Figure 77:
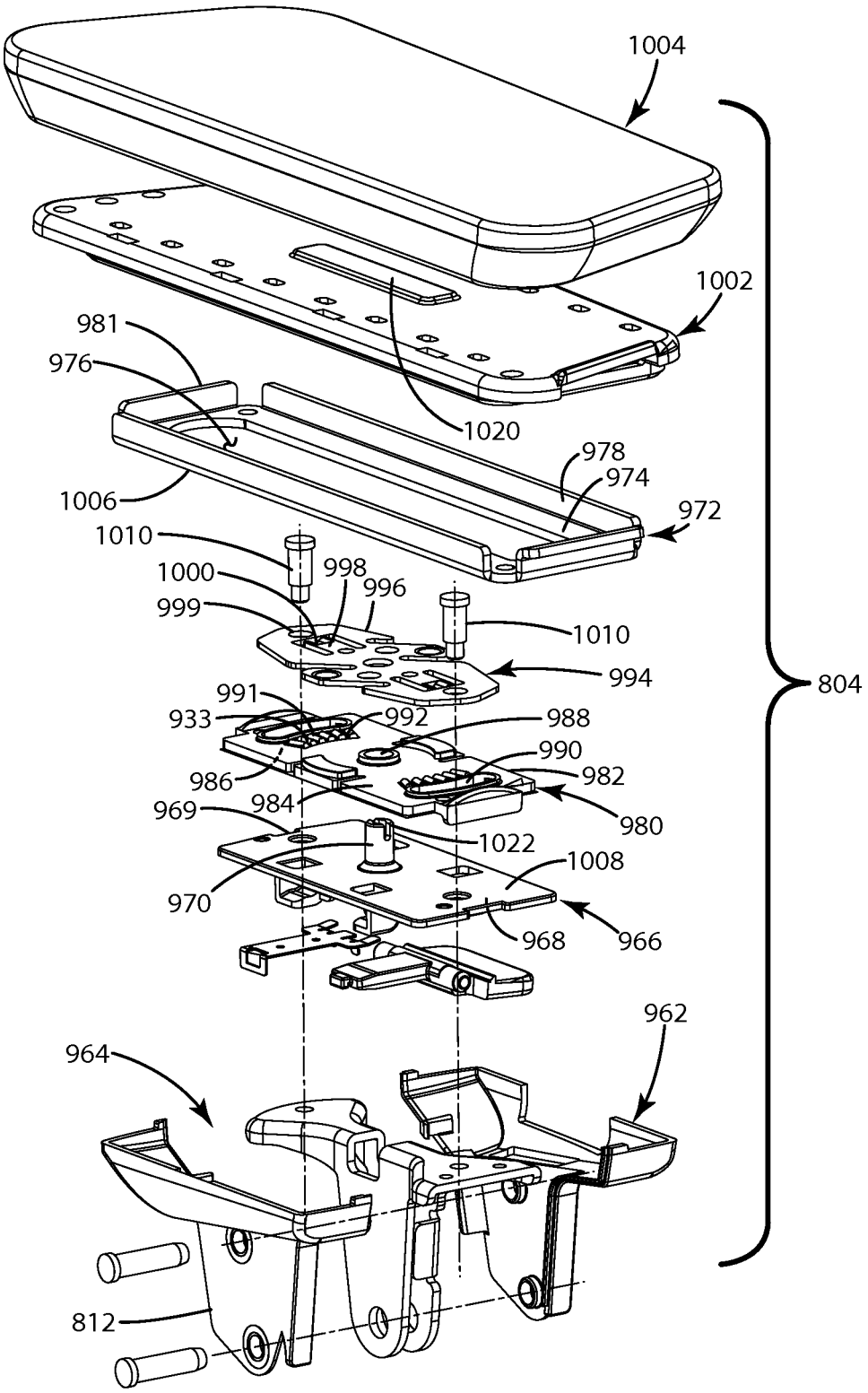
FIG. 77 is an exploded perspective view of the arm rest assembly.
Figure 78:
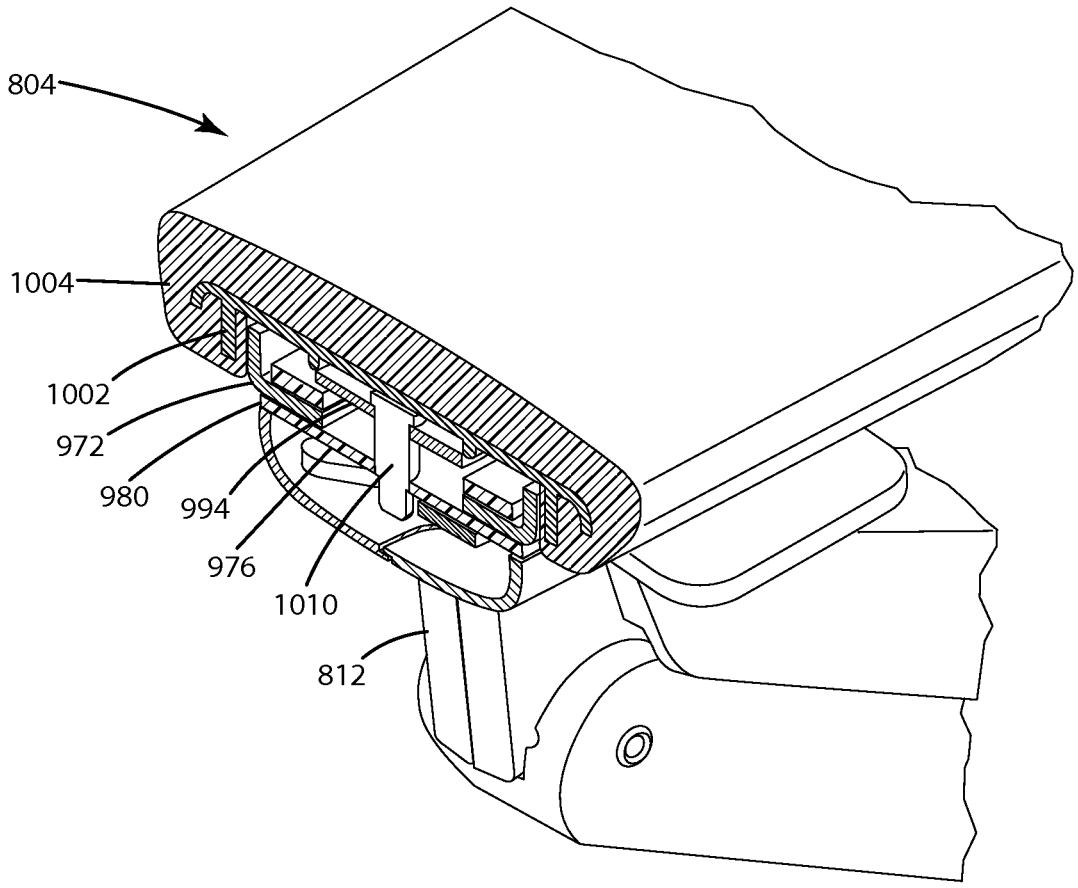
FIG. 78 is a cross-sectional view of the arm rest assembly taken along the line LXXVIII-LXXVIII, FIG. 70.

As best illustrated in FIGS. 76-78, each arm rest assembly 804 is adjustably supported from the associated arm support assembly 800 such that the arm rest assembly 804 may be pivoted inwardly and outwardly about a pivot point 960 between an in-line position M and pivoted positions N. Each arm rest assembly is also linearly adjustable with respect to the associated arm support assembly 800 between a retracted position O and an extended position P. Each arm rest assembly 804 includes an armrest housing assembly 962 integral with the arm rest assembly support member 812 and defining an interior space 964. The arm rest assembly 804 also includes a support plate 966 having a planar body portion 968, a pair of mechanical fastener receiving apertures 969, and an upwardly extending pivot boss 970. A rectangularly-shaped slider housing 972 includes a planar portion 974 having an oval-shaped aperture 976 extending therethrough, a pair of side walls 978 extending longitudinally along and perpendicularly from the planar portion 974, and a pair of end walls 981 extending laterally across the ends of and perpendicularly from the planar portion 974. The arm rest assembly 804 further includes rotational and linear adjustment member 980 having a planar body portion defining an upper surface 984 and a lower surface 986. A centrally located aperture 988 extends through the body portion 982 and pivotally receives the pivot boss 970 therein. The rotational and linear adjustment member 980 further includes a pair of arcuately-shaped apertures 990 located at opposite ends thereof and a pair of laterally spaced and arcuately arranged sets of ribs 991 extending upwardly from the upper surface 984 and defining a plurality of detents 993 therebetween. A rotational selection member 994 includes a planar body portion 996 and a pair of flexibly resilient fingers 998 centrally located therein and each including a downwardly extending engagement portion 1000. Each arm rest assembly 804 further includes an arm pad substrate 1002 and an arm pad member 1004 overmolded onto the substrate 1002.

In assembly, the support plate 966 is positioned over the arm rest housing assembly 962, the slider housing 972 above the support plate 966 such that a bottom surface 1006 of the planar portion 974 frictionally abuts a top surface 1008 of the support plate 966, the rotational and linear adjustment member 980 between the side walls 978 and end walls 980 of the slider housing 972 such that the bottom surface 986 of the rotational and linear adjustment member frictionally engages the planar portion 974 of the slider housing 972, and the rotational selection member 994 is above the rotational and linear adjustment member 980. A pair of mechanical fasteners such as rivets 1010 extend through the apertures 999 of the rotational selection member 994, the arcuately-shaped apertures 990 of the rotational and linear adjustment member 980, and the apertures 969 of the support plate 966, and are threadably secured to the arm rest housing assembly 962, thereby securing the support plate 966, and the rotational and linear adjustment member 980 and the rotational selection member 994 against linear movement with respect to the arm rest housing 962. The substrate 1002 and the arm pad member 1004 are then secured to the slider housing 972. The above-described arrangement allows the slider housing 972, the substrate 1002 and the arm pad member 1004 to slide in a linear direction such that the arm rest assembly 804 may be adjusted between the protracted position O and the extended position P. The rivets 1010 may be adjusted so as to adjust the clamping force exerted on the slider housing 972 by the support plate 966 and the rotational and linear adjustment member 980. The substrate 1002 includes a centrally-located, upwardly-extending raised portion 1020 and a corresponding downwardly-disposed recess having a pair of longitudinally extending sidewalls (not shown). Each sidewall includes a plurality of ribs and detents similar to the ribs 991 and the detents 993 previously described. In operation, the pivot boss 970 engages the detents of the recess as the arm pad 1004 is moved in the linear direction, thereby providing a haptic feedback to the user. In the illustrated example, the pivot boss 970 includes a slot 1022 that allows the end of the pivot boss 970 to elastically deform as the pivot boss 970 engages the detents, thereby reducing wear thereto. The arcuately-shaped apertures 990 of the rotational and linear adjustment member 980 allows the adjustment member 980 to pivot about the pivot boss 970 of the support plate 966, and the arm rest assembly 804 to be adjusted between the in-line position M and the angled positions N. In operation, the engagement portion 1000 of each finger 998 of the rotational selection member selectively engages the detents 992 defined between the ribs 991, thereby allowing the user to position the arm rest assembly 804 in a selected rotational position and providing haptic feedback to the user as the arm rest assembly 804 is rotationally adjusted.

Figure 79:
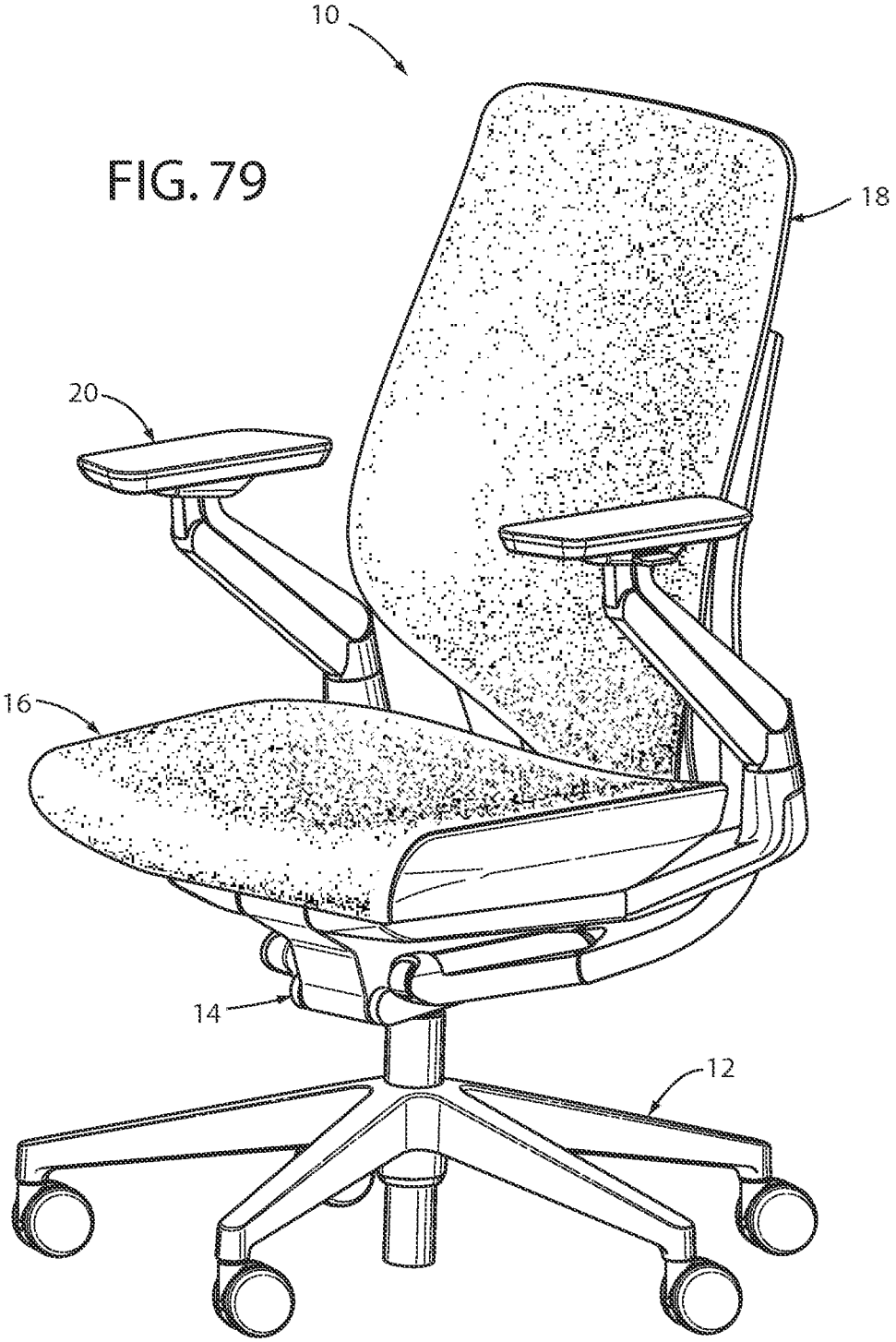
FIG. 79 is a perspective view of a chair assembly.
Figure 80:
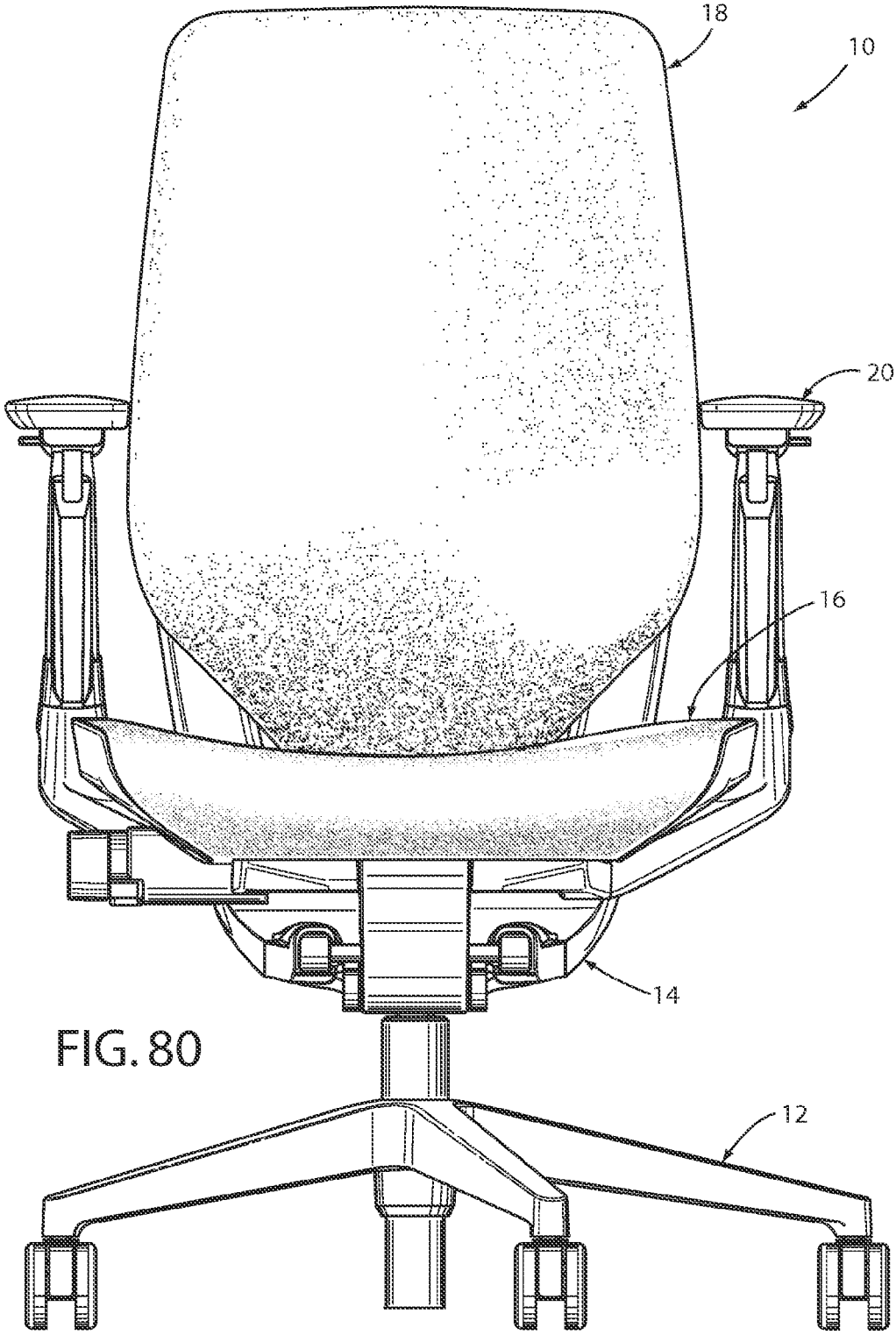
FIG. 80 is a front elevational view of the chair assembly as shown in FIG. 79.
Figure 81:
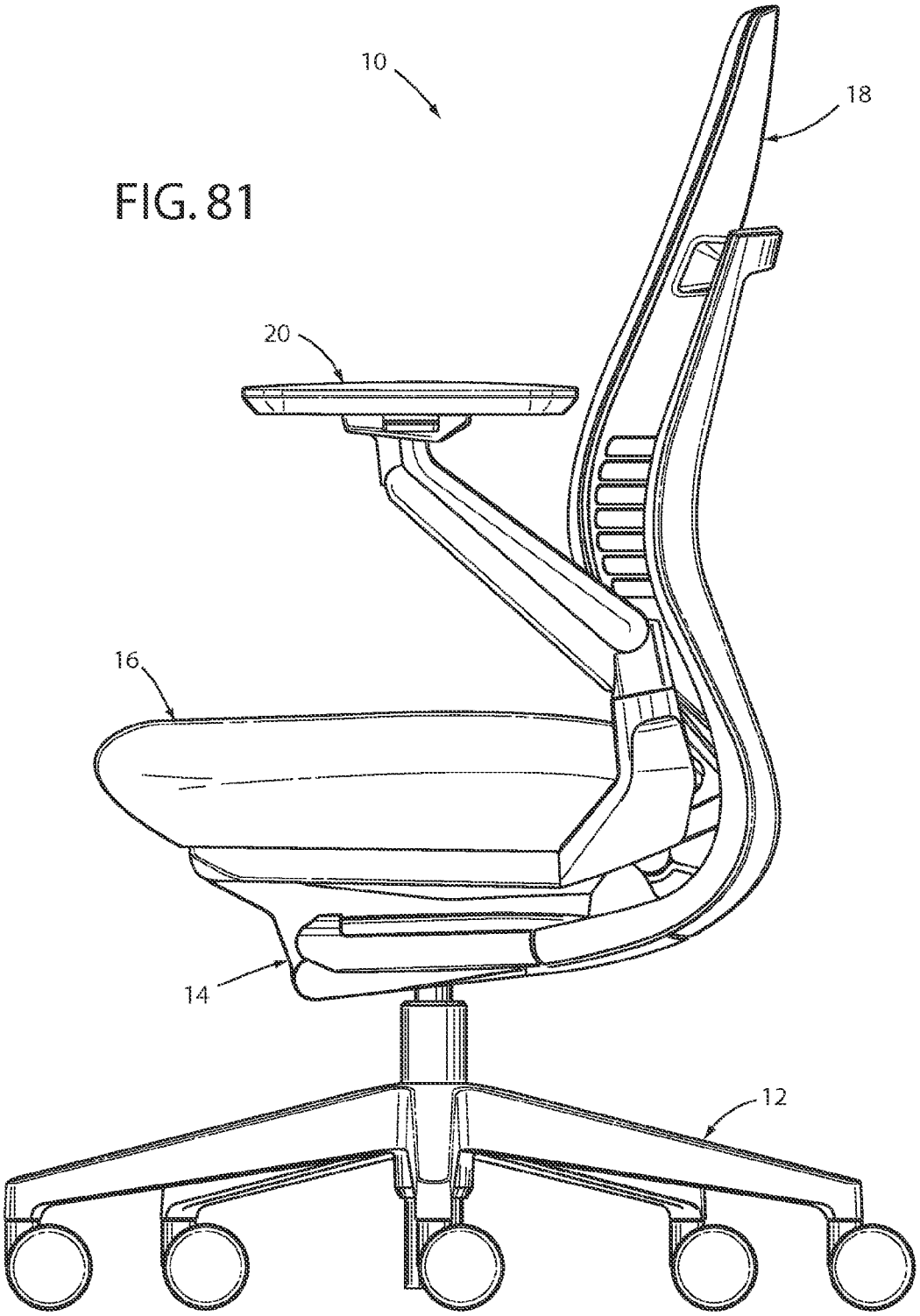
FIG. 81 is a first side elevational view of the chair assembly as shown in FIG. 79.
Figure 82:
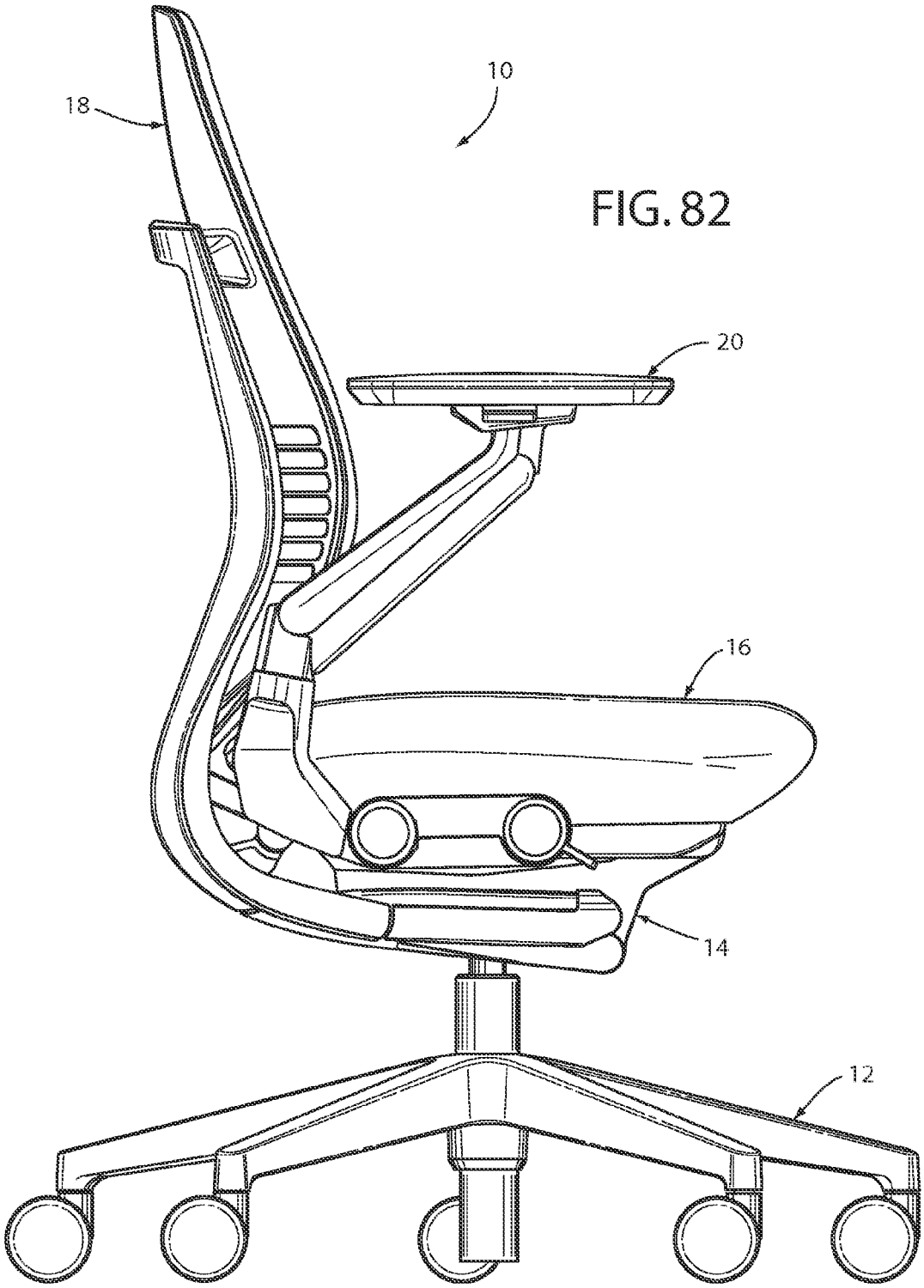
FIG. 82 is a second side elevational view of the chair assembly as shown in FIG. 79.
Figure 83:
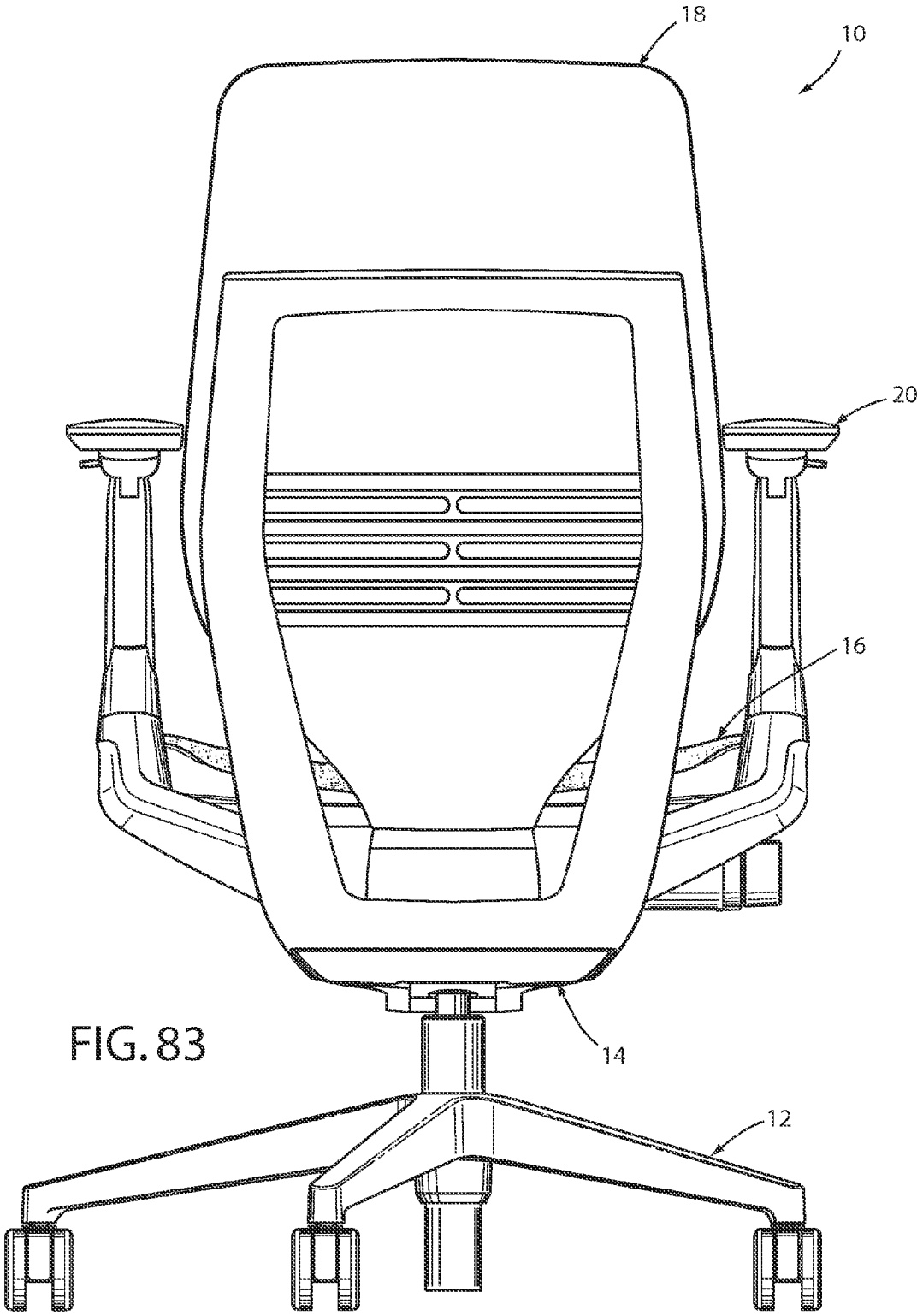
FIG. 83 is a rear side elevational view of the chair assembly as shown in FIG. 79.
Figure 84:
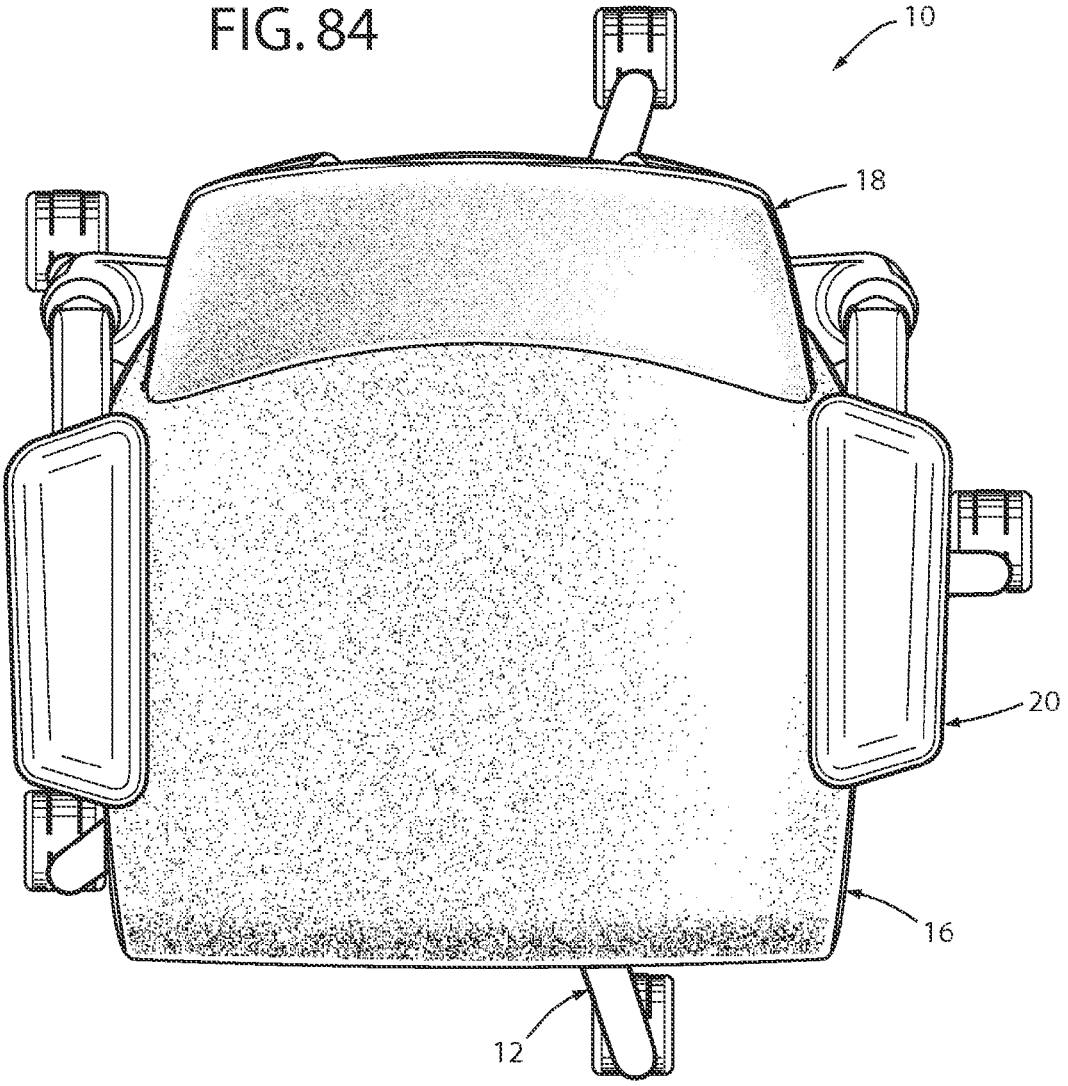
FIG. 84 is a top plan view of the chair assembly as shown in FIG. 79.
Figure 85:
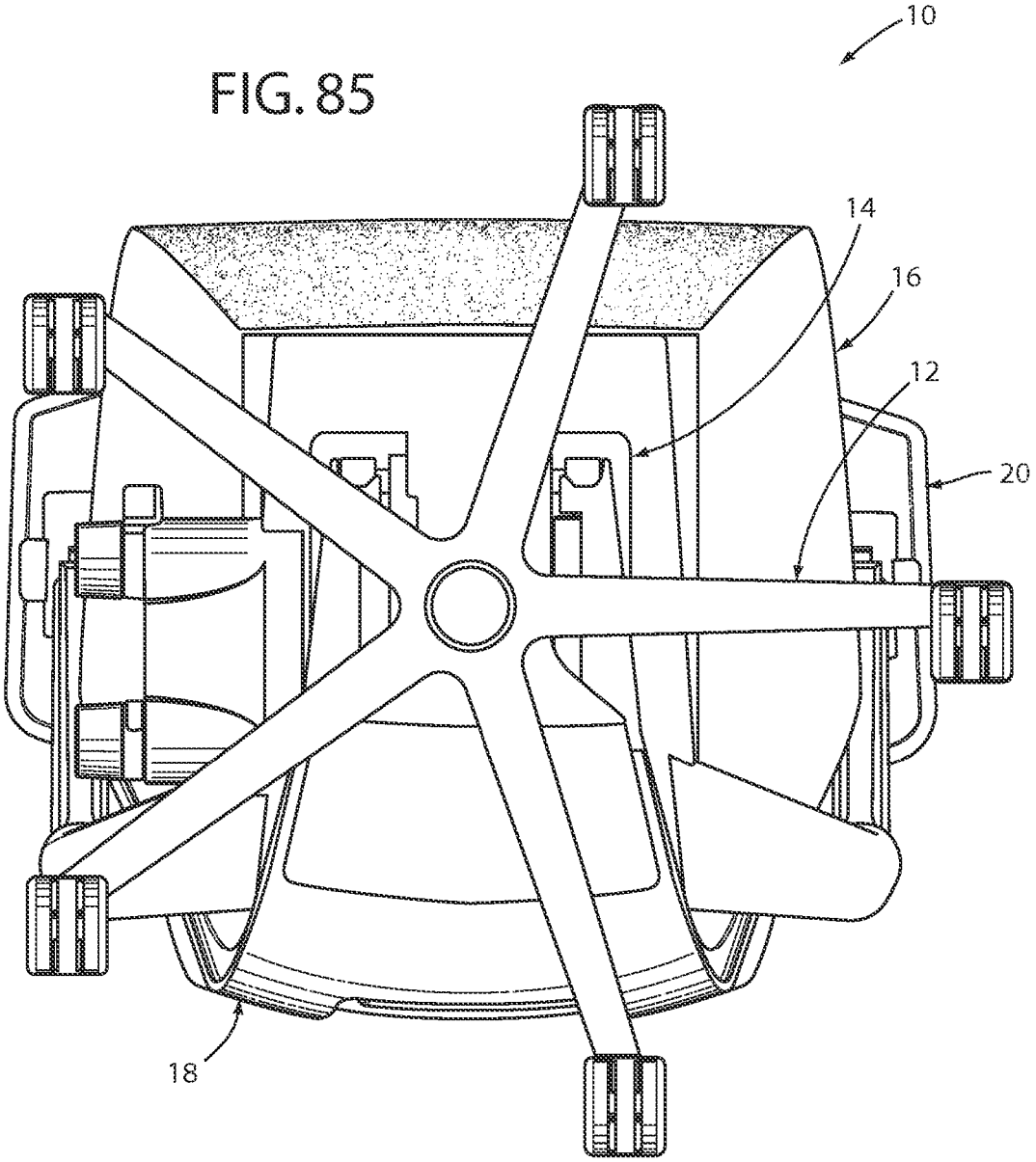
FIG. 85 is a bottom plan view of the chair assembly as shown in FIG. 79.

A chair assembly embodiment is illustrated in a variety of views, including a perspective view (FIG. 79), a front elevational view (FIG. 80), a first side elevational view (FIG. 81), a second side elevational view (FIG. 82), a rear elevational view (FIG. 83), a top plan view (FIG. 84), and a bottom plan view (FIG. 85).

Figure 86:
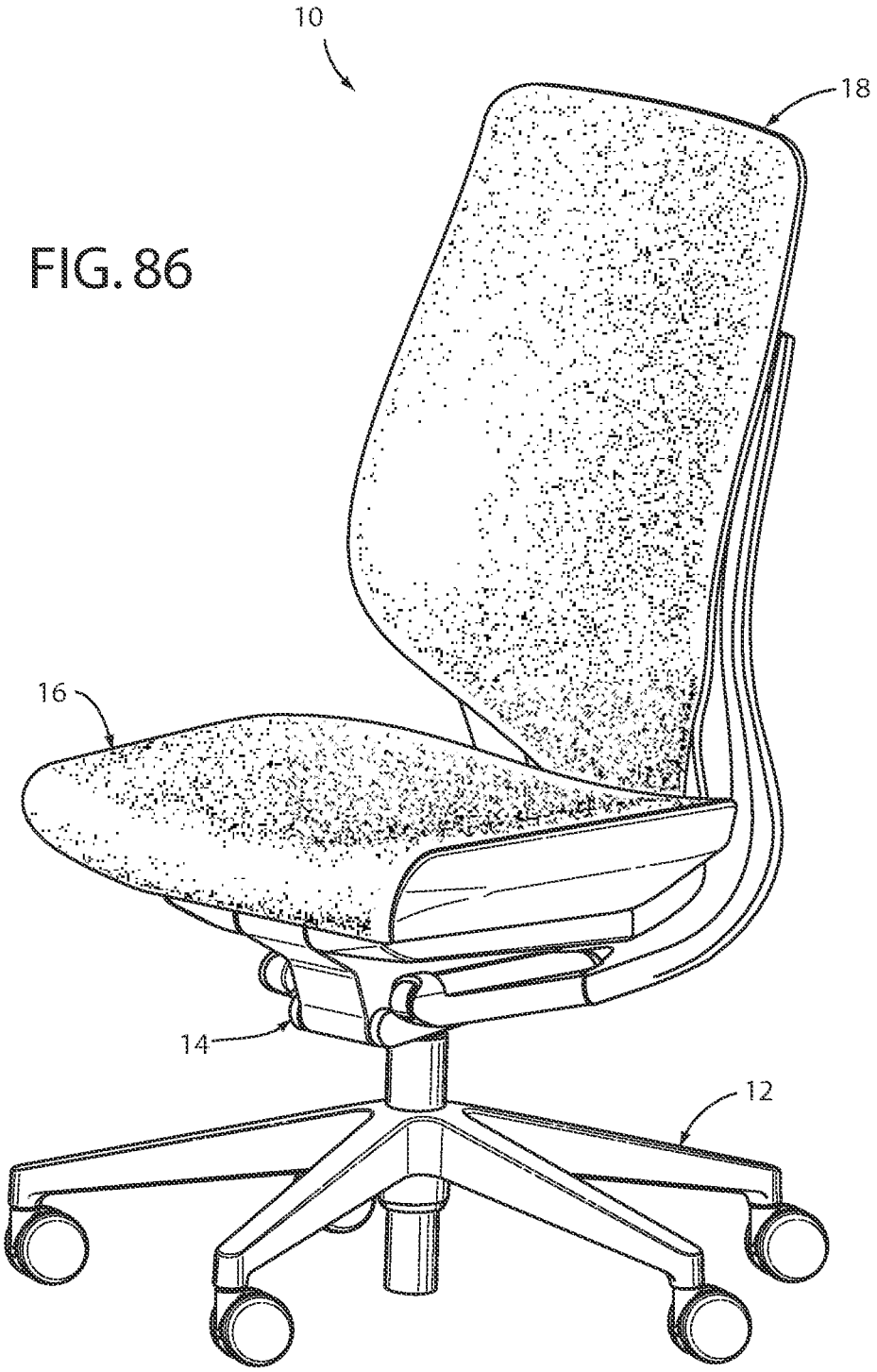
FIG. 86 is a perspective view of a chair assembly without an arm rest assembly.
Figure 87:
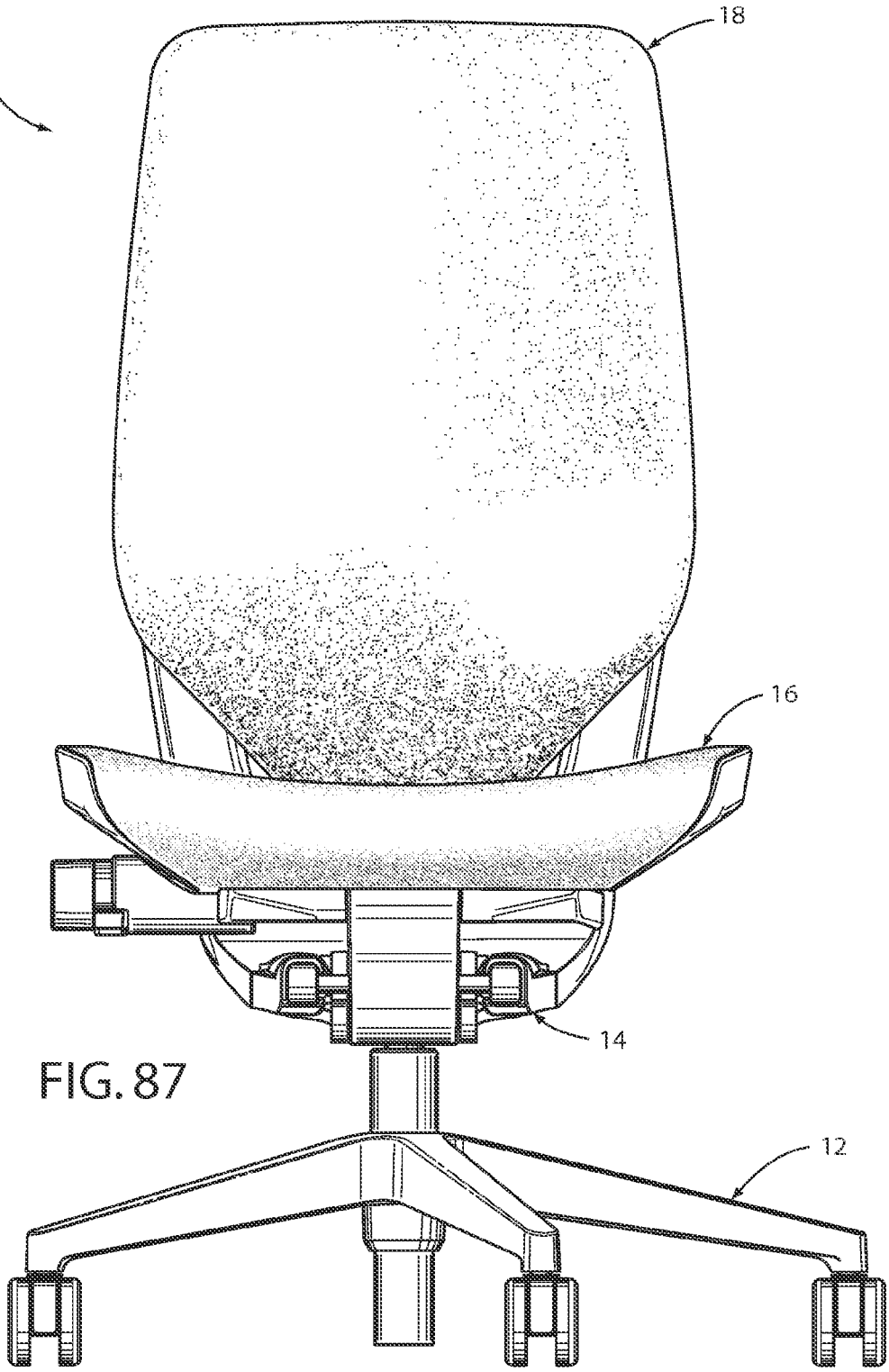
FIG. 87 is a front elevational view of the chair assembly as shown in FIG. 86.
Figure 88:
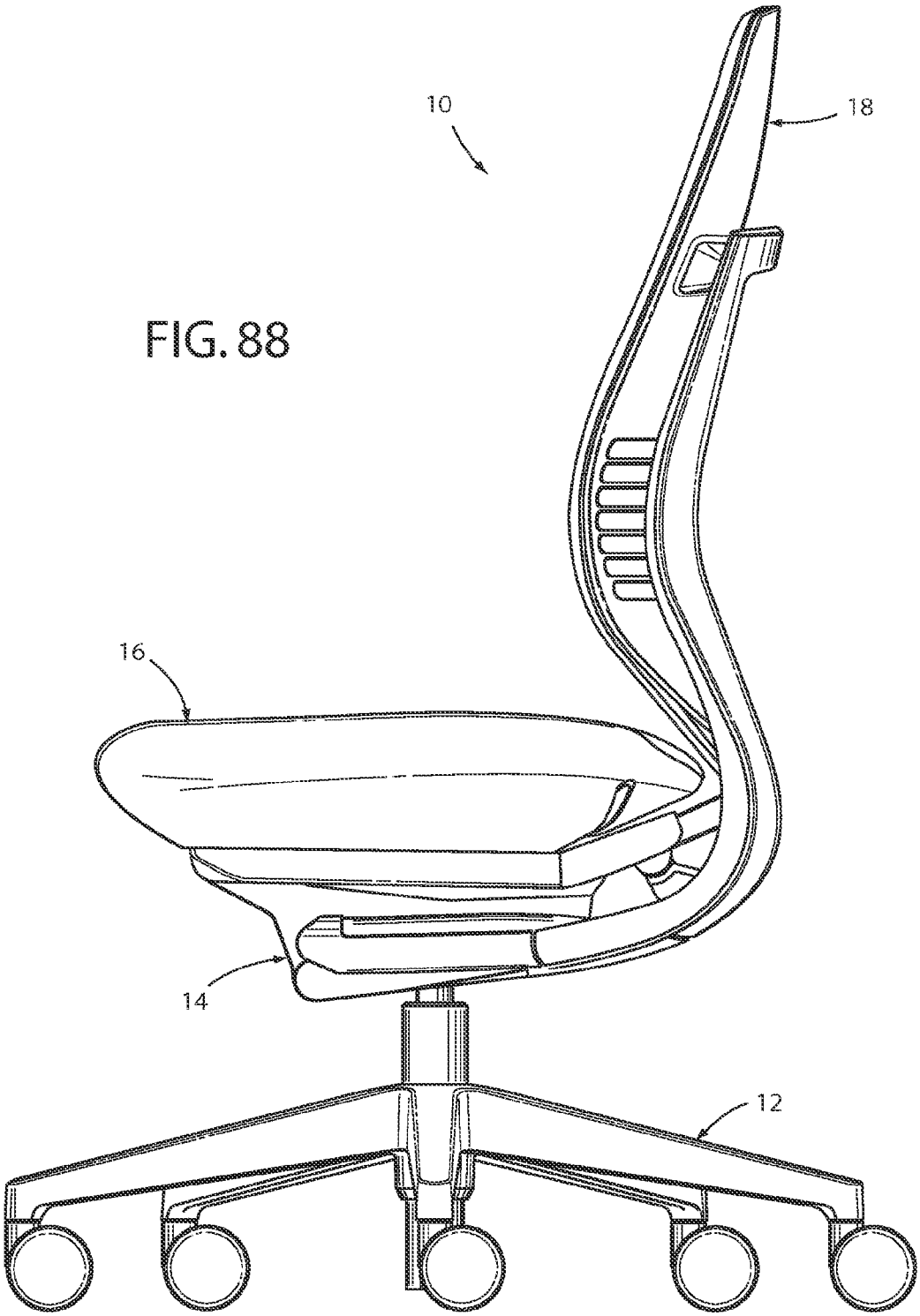
FIG. 88 is a first side elevational view of the chair assembly as shown in FIG. 86.
Figure 89:
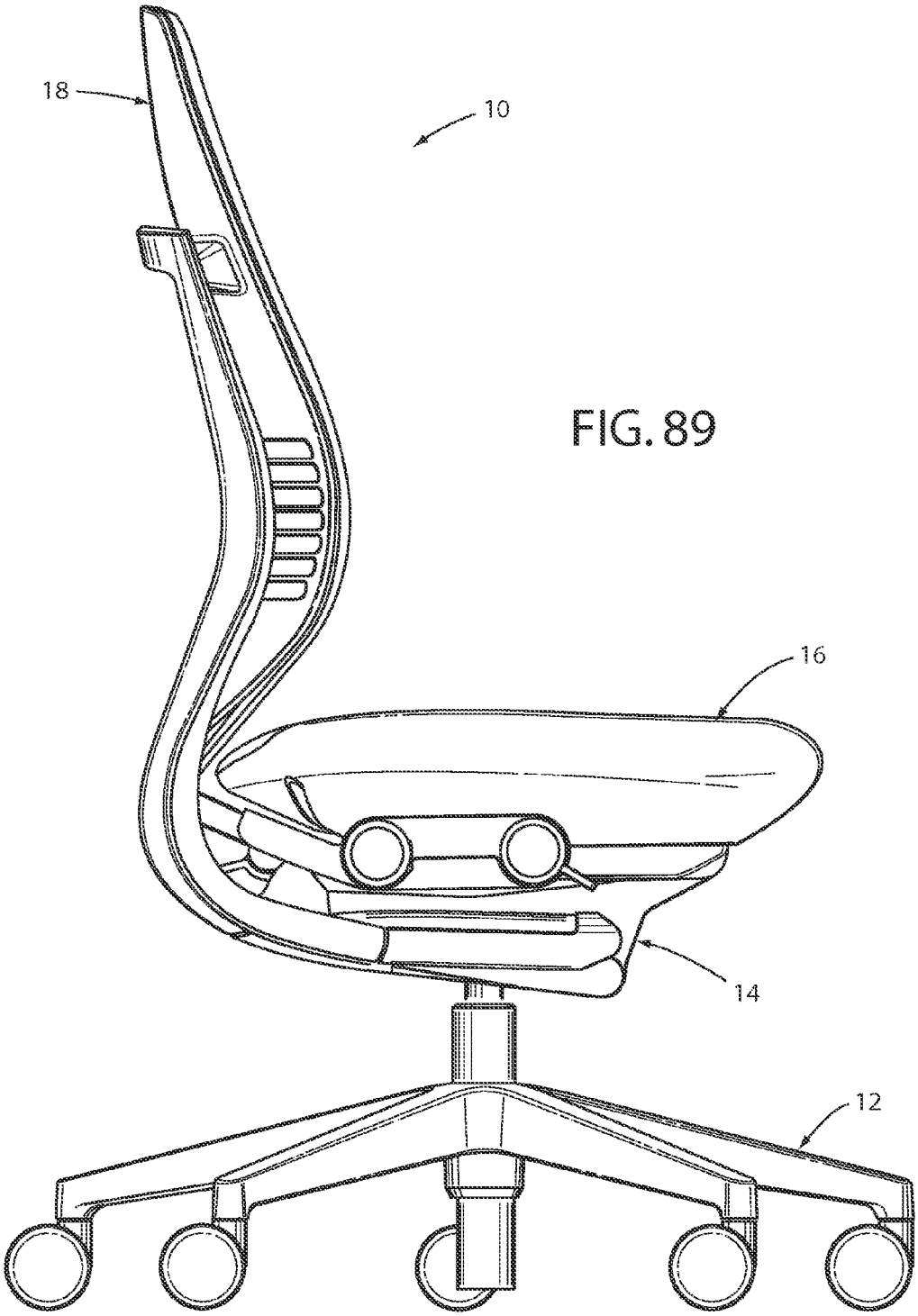
FIG. 89 is a second side elevational view of the chair assembly as shown in FIG. 86.
Figure 90:
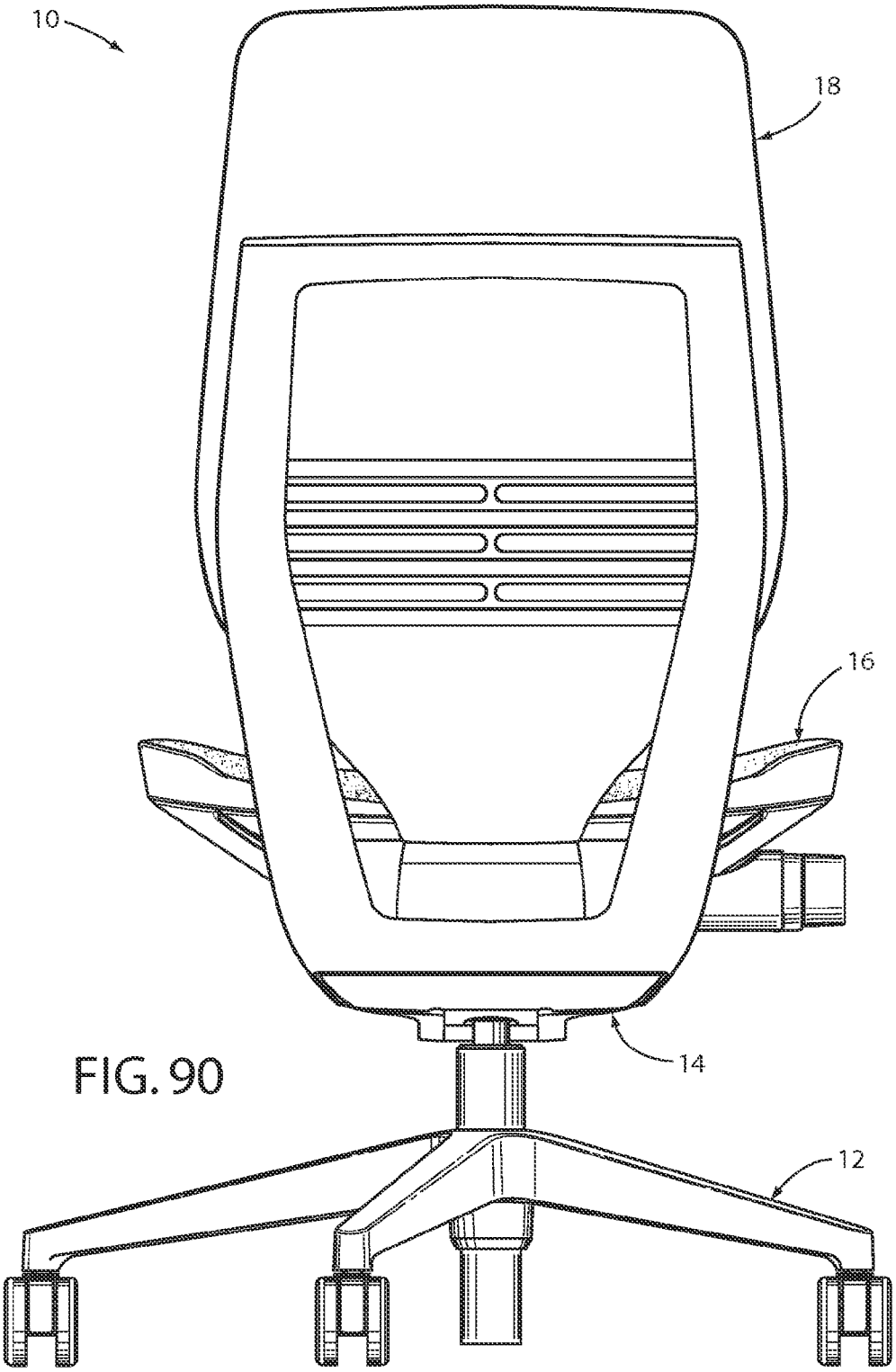
FIG. 90 is a rear side elevational view of the chair assembly as shown in FIG. 86.
Figure 91:
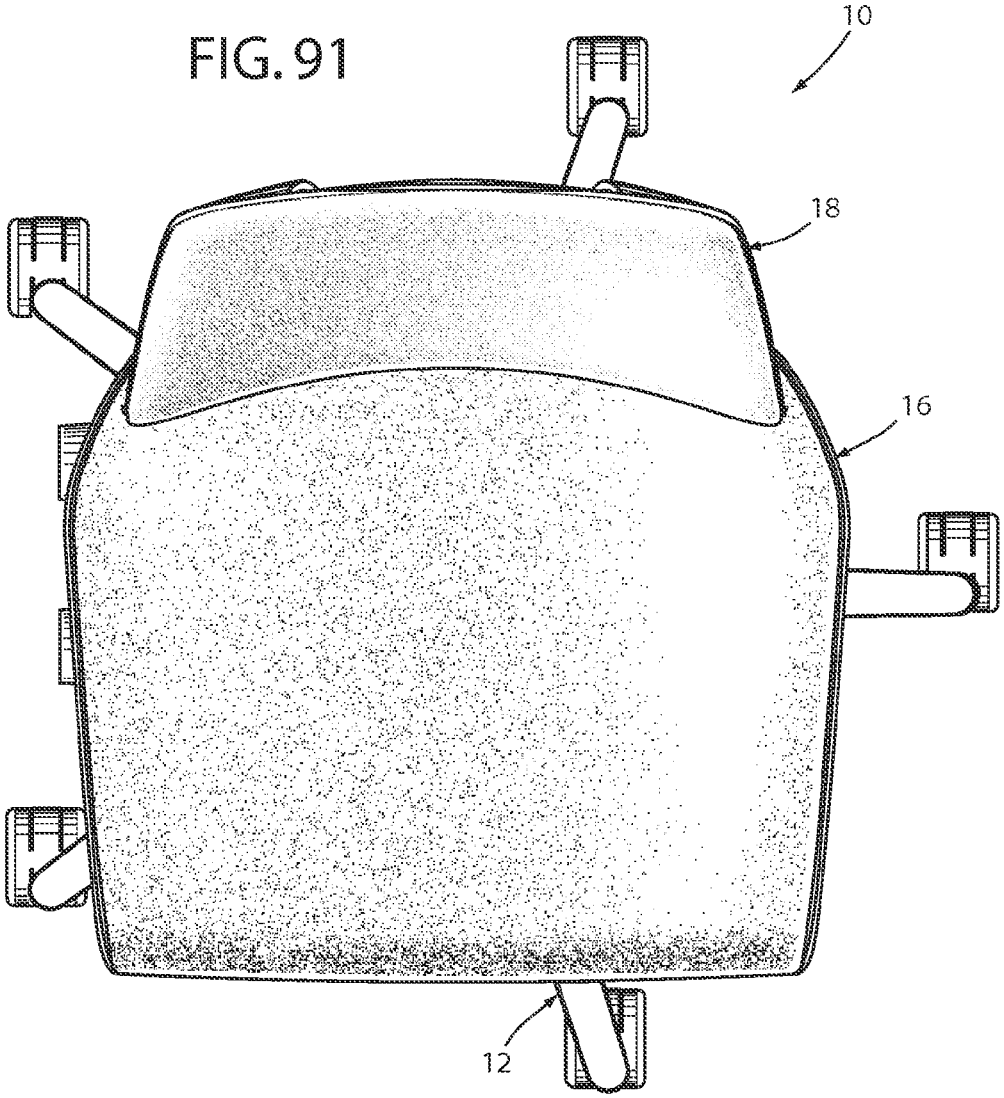
FIG. 91 is a top plan view of the chair assembly as shown in FIG. 86.
Figure 92:
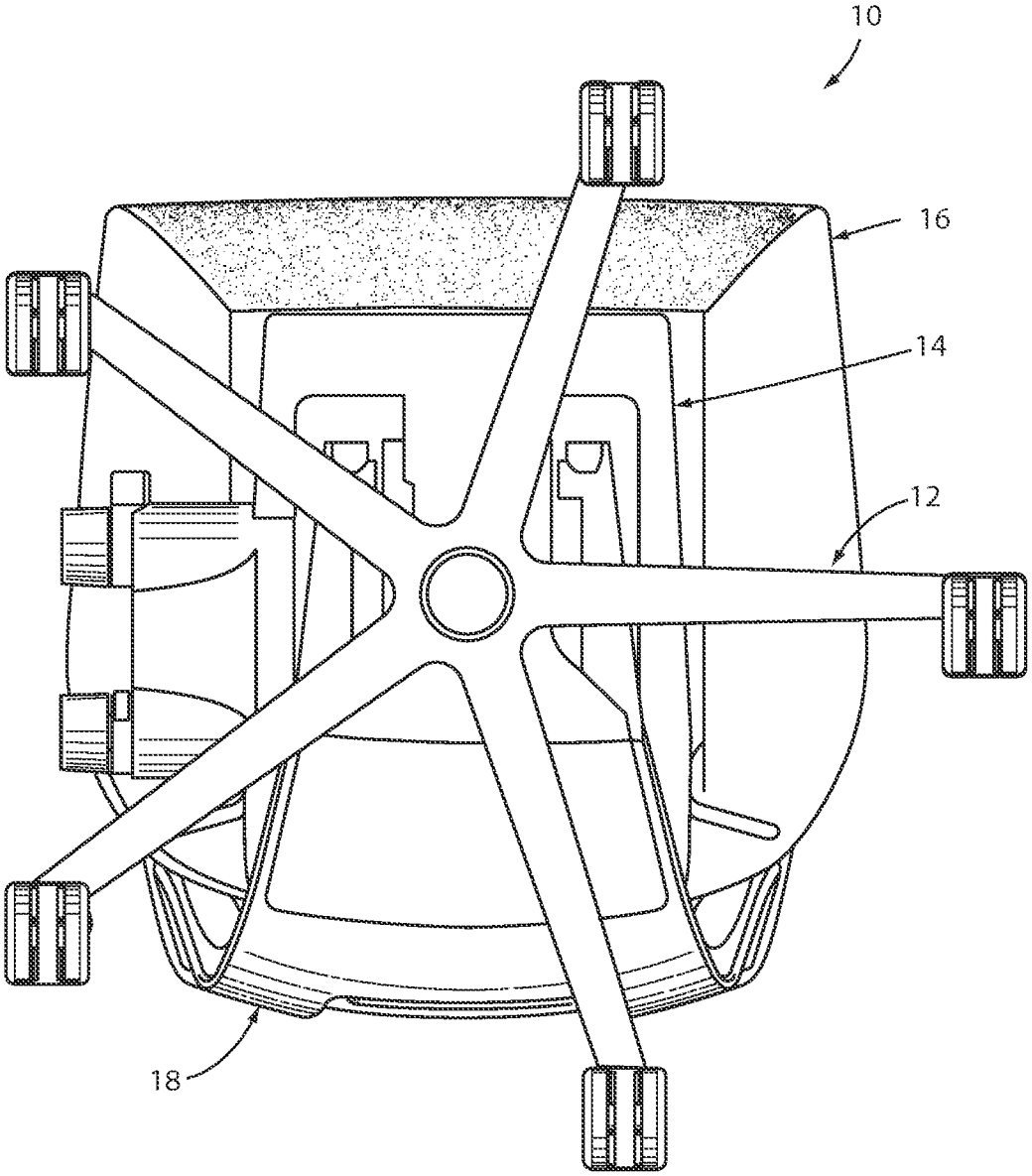
FIG. 92 is a bottom plan view of the chair assembly as shown in FIG. 86.

Another chair assembly embodiment without arms 20 is illustrated in a variety of views, including a perspective view (FIG. 86), a front elevational view (FIG. 87), a first side elevational view (FIG. 88), a second side elevational view (FIG. 89), a rear elevational view (FIG. 90), a top plan view (FIG. 91), and a bottom plan view (FIG. 92). The embodiments of the chair assemblies illustrated in FIGS. 79-92 may include all, some, or none of the features as described herein.

In the foregoing description, it will be readily appreciated by those skilled in the art that alternative combinations of the various components and elements of the invention and modifications to the invention may be made without departing when the concept is disclosed, such as applying the inventive concepts as disclosed herein to vehicle seating, stadium seating, home seating, theater seating and the like. Such modifications are to be considered as included in the following claims, unless these claims by their language expressly state otherwise.

The invention claimed is:

1. A chair assembly, comprising:

a seat support structure operably coupled to a base structure, wherein the seat support structure is adapted to support a seated user thereon, and wherein the seat support structure is adapted to move between a first position and a second position;

a back support structure operably coupled to the base structure, wherein the back support structure is adapted to move between an upright position and a reclined position;

at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude;

an adjustment assembly operably coupled to the at least one biasing assembly allowing a seated user to adjust the biasing force between the first and second magnitudes, wherein the adjustment assembly adjusts the at least one biasing assembly between a first configuration corresponding to the first magnitude of the biasing force and a second configuration corresponding to the second magnitude of the biasing force; and an assist feature exerting an assist force on the biasing assembly, thereby reducing an input force required to be applied by a user to adjust the biasing force from the second magnitude to the first magnitude along at least a majority of a full range of travel of the adjustment assembly.

2. The chair assembly of claim 1, wherein the adjustment assembly includes a movable input member that changes the magnitude of the biasing force upon movement of the movable input member between a first position and a second position.

3. The chair assembly of claim 2, wherein the biasing force is generated by a resilient biasing member that shifts between a first shape corresponding to the first magnitude of the biasing force and a second shape corresponding to the second magnitude of the biasing force.

4. The chair assembly of claim 3, wherein the resilient biasing member comprises a spring member having a first end, a second end and a length defined between the first end and the second end, and wherein a change in the length of the spring member changes the magnitude of the biasing force between the first and second magnitudes.

5. The chair assembly of claim 3, wherein the resilient biasing member generates a force acting on the movable input member in a first direction, and wherein the assist feature exerts the assist force on the movable input member in a second direction substantially opposite to the first direction, thereby reducing the input force required to be applied by a user to the movable input member to adjust the biasing force from the first magnitude to the second magnitude.

6. The chair assembly of claim 5, wherein the spring member of the resilient biasing member comprises a first spring member, and wherein the assist feature includes a second spring member.

7. The chair assembly of claim 6, wherein the second spring member comprises a coil spring.

8. The chair assembly of claim 1, wherein the adjustment assembly includes first and second threaded members, and wherein rotation of the first threaded member adjusts the biasing force between the first and second magnitudes.

9. A chair assembly, comprising:

a seat support structure operably coupled to a base structure, wherein the seat support structure is adapted to support a seated user thereon;

a back support structure operably coupled to the base structure, wherein the back support structure is adapted to move between an upright position and a reclined position;

at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude;

an adjustment assembly operably coupled to the at least one biasing assembly allowing a seated user to adjust the biasing force between the first and second magnitudes, wherein the adjustment assembly adjusts the at least one biasing assembly between a first configuration corresponding to the first magnitude of the biasing force and a second configuration corresponding to the second magnitude of the biasing force; and an assist feature exerting an assist force on the biasing assembly, thereby reducing an input force required to be applied by a user to adjust the biasing force from the second magnitude to the first magnitude along at least a majority of a full range of travel of the adjustment assembly, wherein the biasing force is generated by a resilient biasing member that shifts between a first shape corresponding to the first magnitude of the biasing force and a second shape corresponding to the second magnitude of the biasing force.

10. The chair assembly of claim 9, wherein the resilient biasing member comprises a spring member having a first end, a second end and a length defined between the first end and the second end, and wherein a change in the length of the spring member changes the magnitude of the biasing force between the first and second magnitudes.

11. The chair assembly of claim 9, wherein the resilient biasing member generates a force acting on the movable input member in a first direction, and wherein the assist feature exerts the assist force on the movable input member in a second direction substantially opposite to the first direction, thereby reducing the input force required to be applied by a user to the movable input member to adjust the biasing force from the first magnitude to the second magnitude.

12. The chair assembly of claim 1, wherein the assist feature includes a spring member.

13. The chair assembly of claim 12, wherein the spring member comprises a coil spring.

14. The chair assembly of claim 1, wherein the adjustment assembly includes first and second threaded members, and wherein rotation of the first threaded member adjusts the biasing force between the first and second magnitudes.

15. The chair assembly of claim 1, wherein the chair assembly comprises an office chair assembly.

16. A chair assembly, comprising:

a seat support structure operably coupled to a base structure, wherein the seat support structure is adapted to support a seated user thereon, and wherein the seat support structure is adapted to move between a first position and a second position;

a back support structure operably coupled to the base structure, wherein the back support structure is adapted to move between an upright position and a reclined position;

at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude; and an adjustment assembly operably coupled to the at least one biasing assembly allowing a seated user to adjust the biasing force between the first and second magnitudes by exerting an input force, wherein the adjustment assembly adjusts the at least one biasing assembly between a first configuration corresponding to the first magnitude of the biasing force and a second configuration corresponding to the second magnitude of the biasing force, and wherein the input force required to adjust the biasing force from the first magnitude to the second magnitude increases as the biasing force is increased along a substantial full range of travel of the adjustment assembly.

17. The chair assembly of claim 16, further comprising:

an assist feature exerting an assist force on the biasing assembly, thereby reducing the input force required to adjust the biasing force from the second magnitude to the first magnitude.

18. The chair assembly of claim 17, wherein the assist feature includes a spring member.

19. The chair assembly of claim 18, wherein the spring member comprises a coil spring.

20. The chair assembly of claim 16, wherein the adjustment assembly includes a movable input member that changes the magnitude of the biasing force upon movement of the movable input member between a first position and a second position.

21. A chair assembly, comprising:

a seat support structure operably coupled to a base structure, wherein the seat support structure is adapted to support a seated user thereon, and wherein the seat support structure is adapted to move between a first position and a second position;

a back support structure operably coupled to the base structure, wherein the back support structure is adapted to move between an upright position and a reclined position;

at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude; and an adjustment assembly operably coupled to the at least one biasing assembly allowing a seated user to adjust the biasing force between the first and second magnitudes by exerting an input force, wherein the adjustment assembly adjusts the at least one biasing assembly between a first configuration corresponding to the first magnitude of the biasing force and a second configuration corresponding to the second magnitude of the biasing force, wherein the input force required to adjust the biasing force from the first magnitude to the second magnitude increases as the biasing force is increased along a substantial full range of travel of the adjustment assembly, and, wherein the biasing force is generated by a resilient biasing member that shifts between a first shape corresponding to the first magnitude of the biasing force and a second shape corresponding to the second magnitude of the biasing force.

22. The chair assembly of claim 21, wherein the resilient biasing member comprises a spring member having a first end, a second end and a length defined between the first end and the second end, and wherein a change in the length of the spring member changes the magnitude of the biasing force between the first and second magnitudes.

23. The chair assembly of claim 21, wherein the resilient biasing member generates a force acting on the movable input member in a first direction, and wherein the assist feature exerts the assist force on the movable input member in a second direction substantially opposite to the first direction, thereby reducing the input force required to be applied by a user to the movable input member to adjust the biasing force from the first magnitude to the second magnitude.

24. The chair assembly of claim 16, wherein the adjustment assembly includes first and second threaded members, and wherein rotation of the first threaded member adjusts the biasing force between the first and second magnitudes.

25. The chair assembly of claim 16, wherein the chair assembly comprises an office chair assembly.

26. A chair assembly, comprising:

a seat support structure operably coupled to a base structure, wherein the seat support structure is adapted to support a seated user thereon, and wherein the seat support structure is adapted to move between a first position and a second position;

a back support structure operably coupled to the base structure, wherein the back support structure is adapted to move between an upright position and a reclined position;

at least one biasing assembly exerting a biasing force that biases the back support structure from the reclined position towards the upright position, wherein the biasing force is adjustable between first and second magnitudes when the back support structure is in the upright position, and wherein the second magnitude is greater than the first magnitude; and an adjustment assembly operably coupled to the at least one biasing assembly allowing a seated user to adjust the biasing force between the first and second magnitudes, wherein the adjustment assembly adjusts the at least one biasing assembly between a first configuration corresponding to the first magnitude of the biasing force and a second configuration corresponding to the second magnitude of the biasing force; and an assist feature exerting an assist force on the biasing assembly, thereby substantially reducing an input force required to be applied by a user to adjust the biasing force from the second magnitude to the first magnitude.

27. The chair assembly of claim 26, wherein the assist feature exerts the assist force along a substantial portion of a full range of travel of the adjustment assembly.

* * * * *

UNITED STATES PATENT AND TRADEMARK OFFICE

CERTIFICATE OF CORRECTION

PATENT NO. : 9,492,013 B2
APPLICATION NO. : 14/624884
DATED : November 15, 2016
INVENTOR(S) : Battey et al.

It is certified that error appears in the above-identified patent and that said Letters Patent is hereby corrected as shown below:

In the Specification

Column 4, Line 3:
"FIG." should be – FIGS. –

Column 4, Line 57:
After "perspective" insert -- view --

Column 7, Line 5:
"maybe" should be – may be –

Column 10, Line 1:
After "alternatively" delete ","

Column 11, Line 40:
"are" should be – is –

Column 14, Line 25:
"298" (2nd occurrence) should be – 216 –

Column 14, Line 54:
"for" (2nd occurrence) should be – of –

Column 16, Line 17:
"stay-member" should be – stay member –

Column 18, Line 30:
"illustrates" should be – illustrate –

Signed and Sealed this
Fourteenth Day of November, 2017

Joseph Matal

Joseph Matal
*Performing the Functions and Duties of the*
*Under Secretary of Commerce for Intellectual Property and*
*Director of the United States Patent and Trademark Office*

Column 18, Line 43:
"preferable" should be – preferably –

Column 19, Line 25:
"link control" should be – control link –

Column 19, Line 56:
"tend" should be – tends –

Column 19, Line 57:
"2126" should be – 216 –

Column 19, Line 64:
Delete "," after – when –

Column 22, Line 47:
After "reclined" insert -- position --

Column 23, Line 2:
"730" should be – 730' –

Column 23, Line 23:
"730" should be – 730' –

Column 23, Line 30:
"736" should be – 736' –

Column 25, Line 59:
Delete "that"

Column 27, Line 17:
"fore-and-aft" should be – fore-to-aft –

Column 27, Line 29:
After "second" insert -- member --

Column 28, Line 3:
"arm-base" should be – arm base –

Column 28, Line 37:
After "of" insert -- the --

Column 29, Line 57:
Delete "the"

Column 29, Line 67:
"(release)" should be – (released) –

Column 31, Line 22:
"protracted" should be – retracted –

Column 31, Line 67; Column 32, Line 1:
"without departing when the concept is disclosed" should be – without departing from the concepts as disclosed –

In the Claims

Column 35, Claim 21, Line 4:
Delete "," after – and –

Column 36, Claim 26, Line 14:
Delete "and"